US005098805A

United States Patent [19]

Furutachi et al.

[11] Patent Number: 5,098,805

[45] Date of Patent: Mar. 24, 1992

[54] COLOR PHOTOGRAPHS, A PROCESS FOR PREPARING THEM AND COLOR PHOTOGRAPHIC MATERIAL EMPLOYED THEREFOR

[75] Inventors: Nobuo Furutachi; Osamu Takahashi; Masakazu Morigaki, all of Minami-ashigara, Japan

[73] Assignee: Fuji Photo Film Co., Ltd., Kanagawa, Japan

[21] Appl. No.: 501,400

[22] Filed: Mar. 19, 1990

Related U.S. Application Data

[63] Continuation of Ser. No. 149,275, Jan. 28, 1988, abandoned.

[30] Foreign Application Priority Data

Jan. 28, 1987 [JP] Japan ..... 62-17628
Jun. 25, 1987 [JP] Japan ..... 62-158643

[51] Int. Cl.[5] ..... G03C 5/26

[52] U.S. Cl. ..... 430/9; 430/17; 430/372; 430/429; 430/463; 430/551

[58] Field of Search ..... 430/372, 17, 429, 463, 430/551, 552, 553, 554, 555, 556, 557, 558, 9

[56] References Cited

U.S. PATENT DOCUMENTS

| | | | |
|---|---|---|---|
| 2,356,486 | 8/1944 | Weissberger et al. | 430/372 |
| 2,401,713 | 6/1946 | Vittum et al. | 430/372 |
| 3,725,063 | 4/1973 | Wolfarth et al. | 430/551 |
| 3,876,428 | 4/1975 | Murin et al. . | |
| 4,128,427 | 12/1978 | Monbaliu et al. . | |
| 4,204,876 | 5/1980 | Kuffner et al. . | |
| 4,358,525 | 11/1982 | Mooberry et al. | 430/217 |
| 4,410,619 | 3/1976 | Kubbota et al. . | |
| 4,465,762 | 8/1984 | Ishikawa et al. | 430/376 |
| 4,489,155 | 12/1984 | Sakaroue et al. | 430/551 |
| 4,522,917 | 6/1985 | Ichijima et al. | 430/564 |
| 4,562,146 | 12/1985 | Masuda et al. | 430/551 |
| 4,704,350 | 11/1987 | Morigaki et al. | 430/546 |
| 4,745,047 | 5/1988 | Asami et al. | 430/372 |
| 4,766,056 | 8/1988 | Takahashi et al. | 430/551 |

FOREIGN PATENT DOCUMENTS

| | | |
|---|---|---|
| 0230048 | 8/1960 | European Pat. Off. . |
| 0115305 | 7/1964 | European Pat. Off. . |
| 0135506 | 6/1967 | European Pat. Off. . |
| 0228655 | 7/1987 | European Pat. Off. . |
| 104641 | 6/1984 | Japan . |
| 861138 | 2/1961 | United Kingdom . |
| 1203832 | 9/1970 | United Kingdom . |

OTHER PUBLICATIONS

Gerhard W. Klumpp, "Reactivity In Organic Chemistry", John Wiley & Sons, New York, USA, 1982, pp. 103 to 113, 120 and 121.

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

There is provided a color photograph improved in preservability that has been obtained by making chemically inactive the aromatic amine type color developing agents and their oxidized product that remains in the silver halide photographic materials after color development processing. The color photograph exhibits excellent performance in that its white background can be prevented from discoloring even during long-term storage or display, and deterioration of a dye image caused by the remaining color developing agent being taken into the photographic material after the color development, bleaching, and fixing processes, or due to its oxidized product, can be prevented.

21 Claims, No Drawings

COLOR PHOTOGRAPHS, A PROCESS FOR PREPARING THEM AND COLOR PHOTOGRAPHIC MATERIAL EMPLOYED THEREFOR

This is a continuation of application Ser. No. 07/149,275, filed Jan. 28, 1988, now abandoned.

BACKGROUND OF THE INVENTION (1) Field of the Invention

The present invention relates to color photographs improved in preservability, and particularly to color photographs improved in preservability that have been obtained by making chemically inactive the aromatic amine type color developing agents (hereinafter referred to as aromatic amine developing agents) and their oxidized product that remain in the silver halide photographic materials after color development processing, and to a process of the production of said color photographs and silver halide color photographic materials employed therefor.

(2) Description of the Prior Art

In the field of silver halide color photographic materials, for example, as dye image forming couplers (hereinafter referred to as couplers), there have been developed, along with couplers that give bright cyan, magenta, and yellow dyes with less subsidiary absorption that afford good color reproduction, highly active couplers through which color development completes within a short time. New additives and other agents to draw further enhance the excellent performance of these couplers are also being developed. However, in actualy this new performance caused a deterioration of the preservability of the color photographs due to interaction with the components of the processing solutions that remain in the photosensitive material after the processing.

It is known that, of the processing solution components remaining in the photographic material after the development processing, in particular the aromatic primary amine compound, that is, a developing agent and the compounds derived therefrom, damages the fastness of the image under the influence, for example, of light, heat, and oxygen during long-term storage, or they themselves cause self-coupling or interact with coexistents to change to colored materials, resulting in so-called "stain". This can be considered a fatal defect in a color photograph.

On the other hand, many studies have been made to prevent images from deteriorating and to prevent stain. For example, ideas have been suggested to employ couplers that fade out less, to use fading preventive agents to prevent fading due to light, or to use ultraviolet absorbing agents to prevent an image from being deteriorated by ultraviolet rays.

Although it is recognized that the above compounds have an effect as agents to prevent a dye image from fading or discoloring, the compounds cannot successfully meet the customer demand for high quality images, and they have not yet achieved overall excellence due to their problems of changing the hue, causing fogging or defective dispersion, or forming fine crystals after the application of the emulsion.

However, the stain in question in the invention is produced when aromatic amine compounds taken into the color photograph after the development processing are oxidized with oxygen or the like during prolonged storage of the color photograph, and which at the same time react with contained colorless compounds, such as color image forming compounds (couplers), to form colored compounds. The inventors of this invention tried to develop methods for scavenging aromatic amine compounds taken into the color photograph or the oxidized product of such aromatic amine compounds. However, since the effect of these scavenging compounds also often decreased, for example due to decomposition or deterioration during long-term storage of the color photograph, and the amount of the aromatic amine compounds taken into the color photograph changed notably with the type of development processing, in actual fact the compounds intended to scavenge either the involved aromatic amine compounds or the oxidized product thereof had been unsatisfactory.

BRIEF SUMMARY OF THE INVENTION

Therefore an object of the invention is to provide a process of the production of a color photograph wherein the white background is prevented from discoloring during long-term storage or display after color development, bleaching, and fixing of the silver halide color photographic material.

Another object of the present invention is to provide a color photograph which is prevented from deterioration of the dye image due to a remaining color developing agent taken into the photographic material after the color development, bleaching, and fixing.

Still another object of the invention is to provide a process of forming a color image of a color photographic material wherein even if the color photographic material is processed with a processing solution in a running state, a processing solution that will be washed with less water or will not be washed with water, a processing solution that is substantially free from benzyl alcohol, such as a color developing solution, and whose components will be brought into the photographic material in a greater amount, or other processing solutions that will, for example, impose a burden on the color development, image deterioration due to the remaining aromatic amine developing agent or its oxidized product and the occurrence of stain or the side effects therefrom can be prevented.

Other and further objects, features and advantages of the invention will appear more fully from the following description.

DETAILED DESCRIPTION OF THE INVENTION

The inventors have studied intensively to attain the above objects by tracing accurately aromatic amines that have been brought into the color photograph during the photographic processing and the resultant reaction species which change with time and by quickly making inactive the aromatic amines or the subsequent reaction species using scavenging compounds relevant to the reaction species, which have resulted in the present invention.

Thus the present invention provides (1) a color photograph improved in preservability that contains both a compound (A) that can combine chemically with the aromatic amine developing agent remaining after the color development processing to produce a chemically inactive and substantially colorless compound, and a compound (B) that can combine chemically with the oxidized product of the aromatic amine developing agent remaining after the color development processing to produce a chemically inactive and substantially colorless compound, (2) a process of the production of a color photograph improved in preservability by processing a silver halide color photographic material in the presence of compound (A) and compound (B), and (3) a silver halide color photographic material that contains compound (A) and compound (B) in at least one layer of the hydrophilic colloid layers on a base of the silver halide color photographic material.

In the specification and claims, "chemically inactive compound" means (1) a compound that does not or hardly decompose chemically for a long period of time or (2) a compound that does not promote the fading of the dye, does not generate colored materials by the acceleration of the decomposition of the residual coupler, or does not form colored materials, even if it decomposes. In the specification and claims, "substantially colorless compound" means (1) a compound that has no absorption at the visible ray range longer than 350 nm (2) a compound that has a molecular extinction coefficient of 1,000 or below at the visible ray range longer than 350 nm or (3) a compound that gives a color photograph having a white background with reflection density (optical density) of 0.01 or below in respect of a yellow, magenta or cyan dye.

Methods of allowing the preservative compound (A) and the preservative compound (B) to coexist in a color photograph (e.g., a color print and a color film) obtained by processing a silver halide color photographic material to attain the objects of the present invention include:

1) a method wherein at least one of compounds (A) and (B) is previously contained during a step of the production of the photographic material, and compound (A) and/or compound (B) are contained in one or more layers of the hydrophilic colloid layers on the base, and if both compound (A) and compound (B) are contained they may be contained in the same layer or different layers, with the former being preferable. The hydrophilic colloid layers include photosensitive layers and non-photosensitive layers, such as silver halide emulsion layers, ultraviolet absorbing layers, and protective layers, 2) a method wherein before, during, or after the color development processing the photographic material is processed with a processing solution to which compound (A) and/or compound (B) has been added, to allow compound (A) and/or compound (B) to be contained in the color photograph, which compound (A) may essentially be added to a color developing solution, but compound (A) is preferably added to a processing solution after the development processing with a view to avoiding the reaction of compound (A) with the color developing agent in the color developing solution, and 3) a method wherein one of compounds (A) and (B) is contained in a step of the production of the photographic material, and the other compound is added to any processing solution used before, during, or after the color development processing.

The aromatic amine developing agents in this specification and claim herein include aromatic primary, secondary, and tertiary amine compounds, and more particularly phenylenediamine type compounds and aminophenol type compounds. Typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-methyl-2-amino-N,N-diethylaniline, 4-methyl-2-amino-N-ethyl-N-β-methanesulfonamidoethylaniline, 2-amino-N-ethyl-N-β-hydroxylethylaniline, 3-methyl-4-methylamino-N-ethyl-N-β-hydroxyethylaniline, 3-methyl-4-dimethylamino-N-ethyl-N-β-methanesulfonamidoethylaniline, 3-methyl-4-butylamino-N,N-diethylaniline, 3-methyl-4-acetylamino-N-ethyl-N-β-hydroxyethylaniline, 3-methyl-4-methanesulfonamido-N-ethyl-N-β-methanesulfonamidoethylaniline, 3-methyl-4-benzylamino-N-ethyl-N-β-methanesulfonamidoethylaniline, and 3-methyl-4-cyclohexylamino-N-ethyl-N-methylaniline, and their sulfates, hydrochlorides, phosphates, or p-toluenesulfonates, tetraphenyl borates, p-(t-octyl)benzenesulfonates, o-aminophenol, p-aminophenol, 4-amino-2-methylphenol, 2-amino-3-methylphenol, and 2-oxy-3-amino-1,4-dimethylbenzene.

As other examples can be mentioned those described in L. F. A. Mason, "Photographic Processing Chemistry" Focal Press (1966), pages 226 to 229, U.S. Pat. Nos. 2,193,015 and 2,592,364, and Japanese Patent Application (OPI) No. 64933/1973.

The oxidized products of the aromatic amine developing compounds in this specification and claims means oxidized products derived chemically by removing one or two electrons from the aromatic amine developing agents.

Of the compounds (A) that can chemically bond with the aromatic amine developing agent after the color development processing to form substantially colorless compounds, preferable ones are compounds that can react with the rate constant $k_2$ (at 80° C.) of the secondary reaction with p-anisidine within the range of 1.0 l/mol.sec to $1\times10^{-5}$ l/mol.sec.

If the $k_2$ is too great the compounds themselves become unstable and react with gelatin and water to decompose. On the other hand, if the $k_2$ is too small the reaction of the compounds with the aromatic amine developing agents is slow, and as a result the side effect of the remaining aromatic amine developing agents that the invention intends to obviate cannot be prevented.

Of such compounds (A), preferable ones can e represented by the following general formula (I) or (II):

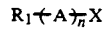

General formula (I)

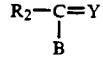

General formula (II)

wherein $R_1$ and $R_2$ each represent an aliphatic group (preferably one having 1~60 carbon atoms, more preferably having 10~50 carbon atoms), an aromatic group (preferably one having 6~60 carbon atoms, more preferably having 16~50 carbon atoms), or a heterocyclic group (preferably one having 2~60 carbon atoms), X represents a group that can react with the aromatic amine developing agent to split off, A represents a group that can react with the aromatic amine developing agent to form a chemical bond, n is 1 or 0, B represents a hydrogen atom, an aliphatic group (preferably one having 1~60 carbon atoms, more preferably having 10~50 carbon atoms), an aromatic group (preferably one having 6~60 carbon atoms, more preferably having 16~50 carbon atoms), a heterocyclic group (preferably one having 2~60 carbon atoms, more preferably having 10~50 carbon atoms), or an acyl or a sulfonyl group (preferably one having 1~50 carbon atoms, more preferably one having 2~50 carbon atoms), Y represents a group that can facilitate the addition of the aromatic amine developing agent to the compound having general formula (II), and $R_1$ and X together or Y and $R_2$ or B together may combine to form a ring structure.

Of ways wherein the remaining aromatic amine developing agent and the compound (A) chemically combine, typical ways are substitution reactions and addition reactions.

Groups of the compounds represented by general formulae (I) and (II) are described further.

The aliphatic groups represented by $R_1$, $R_2$ and B may be straight chain, branched chain or cyclic alkyl groups, alkenyl group or alkynyl groups that may be substituted. The aromatic groups represented by $R_1$, $R_2$ and B may be any of the carbocyclic aromatic group (e.g., phenyl and naphtyl), and the heterocyclic aromatic group (e.g., furyl, thienyl, pyrazolyl, pyridyl and indolyl), may be of a monocyclic type or a condensed ring type (e.g., benzofuryl and phenanthridinyl). These groups may be further substituted.

The heterocyclic groups represented by $R_1$, $R_2$ and B are preferably groups having a 3- to 10-membered ring structure comprising carbon atoms, oxygen atoms, nitrogen atoms, sulfur atoms, or hydrogen atoms, and the hetero ring may itself be a saturated or unsaturated ring, and may be substituted (e.g., chromanyl, pyrrolidinyl, pyrrolinyl, and morpholinyl).

X represents a group that can react with the aromatic amine developing agent to split off, and preferably represents a group that attaches to A via an oxygen atom, a sulfur atom, a nitrogen atom (e.g., 2-pyridyloxy, 2-pyrimidyloxy, 4-pyrimidyloxy, 2-(1,2,3-triazine)oxy, 2-benzimidazolyl, 2-imidazolyl, 2-thiazolyl, 2-benzthiazolyl, 2-furyloxy, 2-thiophenyloxy, 4-pyridyloxy, 3-isooxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazolin-5-oxy, aryloxy, alkoxy, alkylthio, arylthio, and substituted N-oxy), or a halogen atom.

A represents a group that can react with the aromatic amine developing agent to form a chemical bond, and it includes a group containing a low electron density atom such as

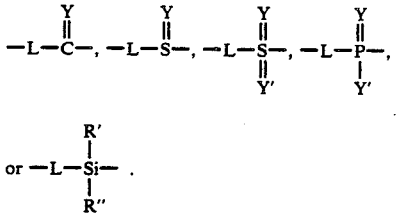

When X is a halogen atom, n is 0. L represents a single bond, an alkylene group, —O—, —S—,

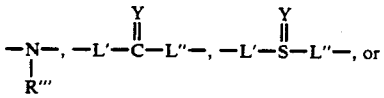

-continued

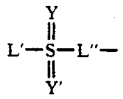

(e.g., carbonyl, sulfonyl, sulfinyl, oxycarbonyl, phosphonyl, thiocarbonyl, aminocarbonyl and silyloxy).

Y has the same meaning as that of Y in general formula (II), and Y' has the same meaning as that of Y.

R' and R'' may be the same or different, and each represents —L'''—$R_0$.

$R_0$ has the same meaning as that of $R_1$. R''' represents a hydrogen atom, an aliphatic group (e.g., methyl, isobutyl, t-butyl, vinyl, benzyl, octadecyl, and cyclohexyl), an aromatic group (e.g., a phenyl, pyridyl, and naphthyl), a heterocyclic group (e.g., piperidinyl, pyranyl, furanyl, and chromanyl), an acyl group (e.g., acetyl, and benzoyl), or a sulfonyl group (e.g., methanesulfonyl and benzenesulfonyl).

L', L'' and L''' each represent —O—, —S— or

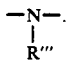

In particular, A represents preferably a divalent group represented by

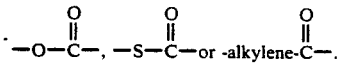

Preferred componds of those represented by the general formula (I) are these represented by general formula (I-a), (I-b), (I-c) or (I-d) that can react with the rate constant $K_2$ (at 80° C.) of the secondary reaction with p-anisidine within the range of $1\times10^{-1}$ to $1\times10^{-5}$ l/mol.sec.

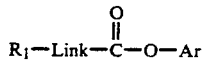

(I-a)

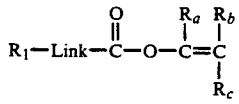

(I-b)

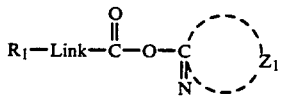

(I-c)

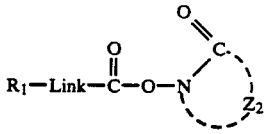

(I-d)

In the above formulae, $R_1$ has the same meaning as $R_1$ in general formula (I); Link represents a single bond or —O—; Ar represents an aromatic group having the same meanings as defined in $R_1$, $R_2$ and B, provided that the group released as a result of reaction with an aromatic amine developing agent is not a group useful as a photographic reducing agent such as catechol derivative. Ra, Rb and Rc, which may be the same or different, each represent a hydrogen atom, an aliphatic, aromatic or heterocyclic group having the same meaning as defined in $R_1$, $R_2$ and B. Further, Ra, Rb and Rc each represent an alkoxy group, aryloxy group, heterocyclooxy group, alkylthio group, arylthio group, heterocyclothio group, amino group, alkylamino group, acyl group, amido group, sulfonamide group, sulfonyl group, alkoxycarbonyl group, sulfo group, carboxyl group, hydroxyl group, acyloxy group, ureido group, urthane group, carbamoyl group or sulfamoyl group. Ra and Rb, or Rb and Rc may combine together to form a 5- to 7-membered heterocyclic ring which may be further subsituted by a substituent, may form, a spirocyclic ring or bicyclo ring, or may be condensed by an aromatic ring, $Z_1$ and $Z_2$ each represent a non-metal atom group necessary to form a 5- to 7-membered heterocyclic ring which may be further substituted by a substituent, may form a spirocyclic ring or bicyclo ring, or may be condensed by an aromatic ring. The compound released as a result of the reaction of $Z_1$ with an arommatic amine developing agent is not a coupler or 1-phenyl-3-pyrazolidones.

The adjustment of the rate constant $k_2$ (at 80° C.) of the secondary reaction with p-anisidine within the range $1\times10^{-1}$ to $1\times10^{-5}$ l/mol.sec for the compounds represented by general formulae (I-a)~(I-d), especially for the compound represented general formula (I-a), can be attained by selecting a substituent, when Ar is a cyclocarbon aromatic group. In this case, the sum total of Hammett's $\sigma$-value of substituents, which may be dependent on the kind of group of $R_1$, is preferably 0.2 or greater, more preferably 0.4 or greater, most preferably 0.6 or greater.

It is preferable that the sum total of carbon atoms of the compound is more than 13, when a compound represented by the general formula (I-a) to (I-b) is added to produce a photographic material. It is not desirable that these compounds decompose during the development processing, in order to achieve the object of the invention.

Y in general formula (II) is preferably an oxygen atom, a sulfur atom, $=N-R_4$ or

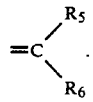

Herein, $R_4$, $R_5$ and $R_6$ each represent a hydrogen atom, an aliphatic group (preferably having 1~30 carbon atoms, more preferably having 1~20 carbon atoms, e.g., methyl, isopropyl, t-butyl, vinyl, benzyl, octadecyl and cyclohexyl), an aromatic group (preferably having 6~40 carbon atoms, more preferably having 6~30 carbon atoms, e.g., phenyl, pyridyl, and naphthyl), a heterocyclic group (preferably having 2~30 carbon atoms, more preferably having 2~20 carbon atoms, e.g., piperidyl, pyranyl, furanyl and chromanyl), an acyl group (preferably having 2~30 carbon atoms, more preferably having 2~20 carbon atoms, e.g., acetyl and benzoyl), or a sulfonyl group (preferably having 1~30 carbon atoms, more preferably having 1~20 carbon atoms, e.g., methanesulfonyl, and benzenesulfonyl), and $R_5$ and $R_6$ may bond together to form a ring structure.

Of the compounds represented by general formulae (I) and (II), the compounds of general formula (I) are especially preferable. In these compounds, the compound represented by general formula (I-a) or (I-c) is more preferable, and the former is more preferable.

Typical examples of these compounds are given below, but the invention is not limited to these compounds.

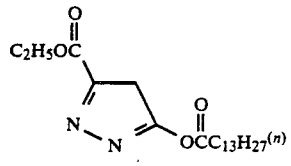

(I-1)

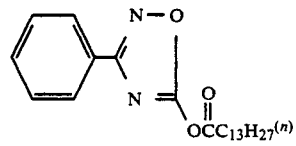

(I-2)

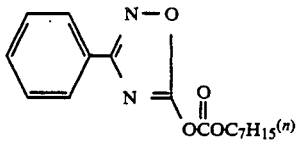

(I-3)

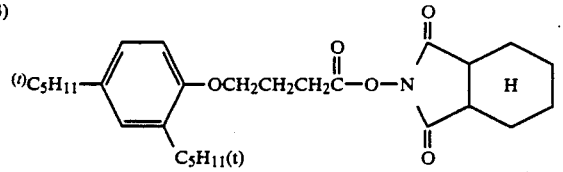

(I-4)

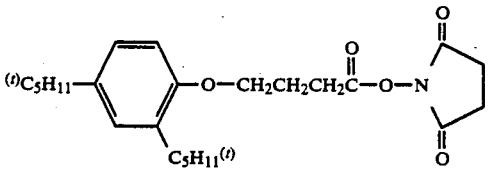

(I-5)

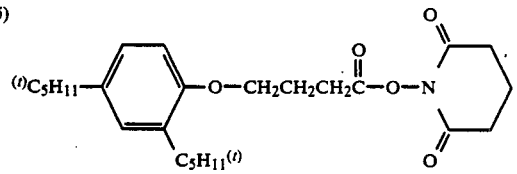

(I-6)

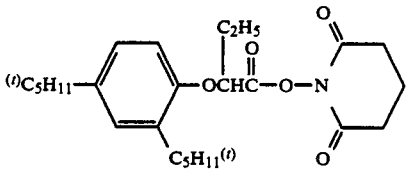

(I-7)

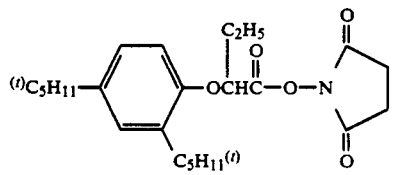

(I-8)

-continued
(I-9)
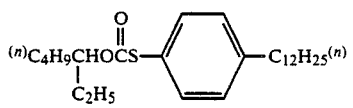
(I-10)
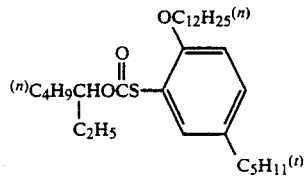
(I-11)
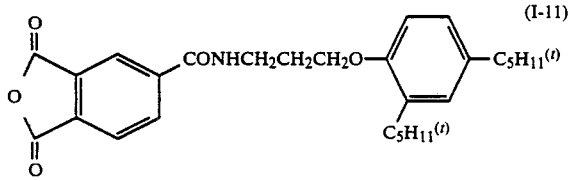
(I-12)
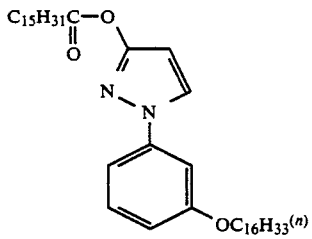
(I-13)
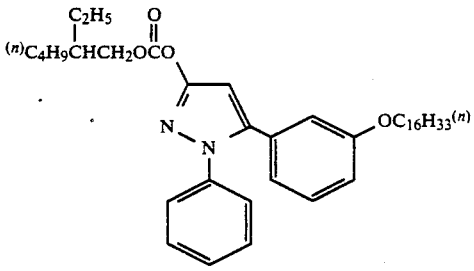
(I-14)
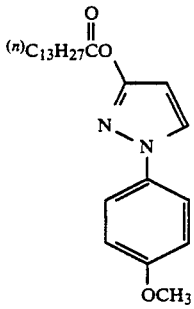
(I-15)
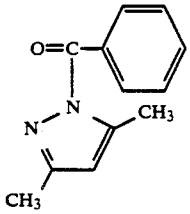
(I-16)
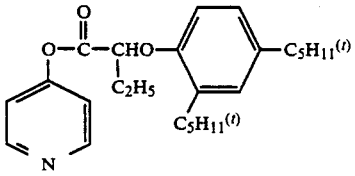
(I-17)
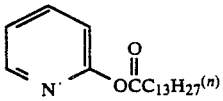
$^{(n)}C_{18}H_{37}I$ (I-18)
$^{(n)}C_{18}H_{37}Br$ (I-19)
(I-20)
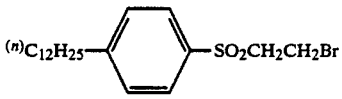
(I-21)
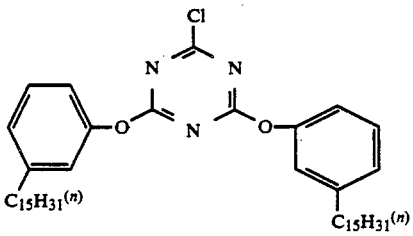
(I-22)
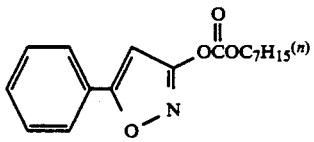
(I-23)
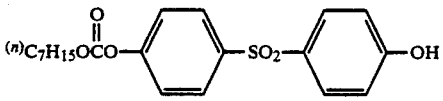
(I-24)
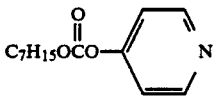

-continued
(I-25)
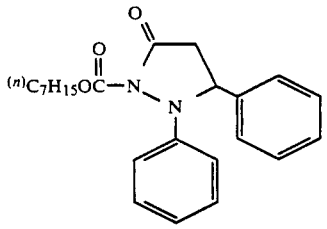
(I-26)
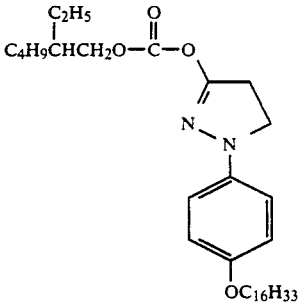
(I-27)
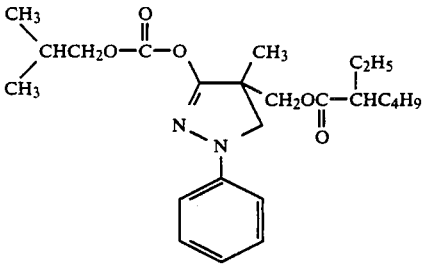
(I-28)
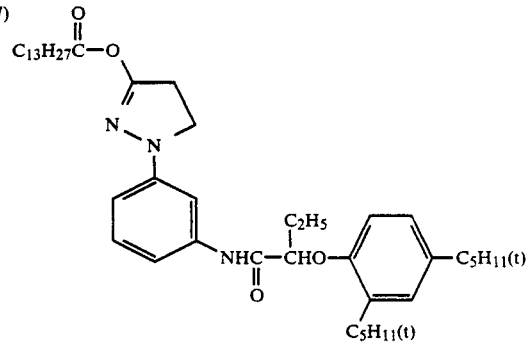
(I-29)
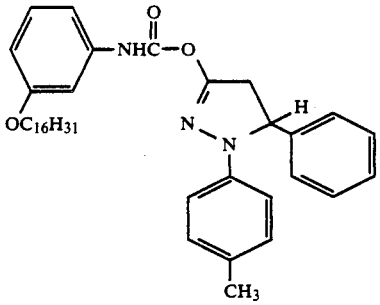
(I-30)
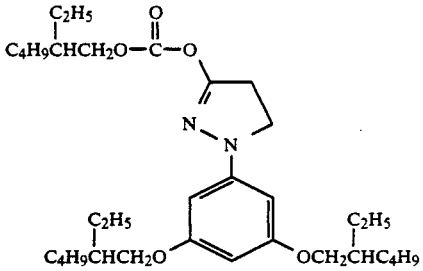
(I-31)
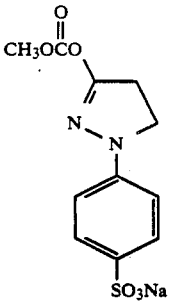
(I-32)
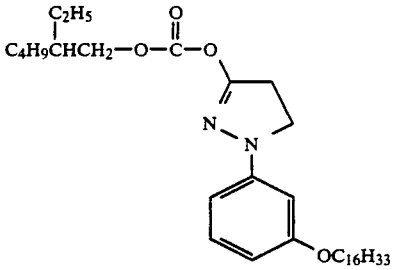
(I-33)
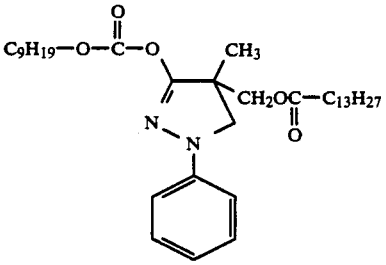

-continued
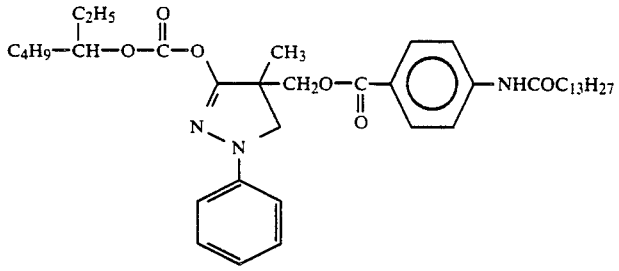
(I-34)
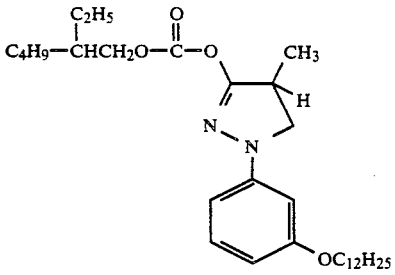
(I-35)
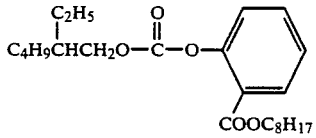
(I-36)
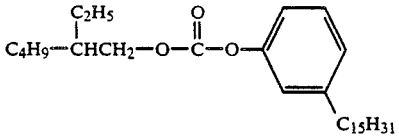
(I-37)
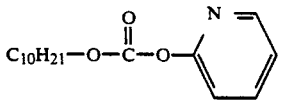
(I-38)
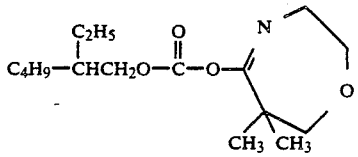
(I-39)
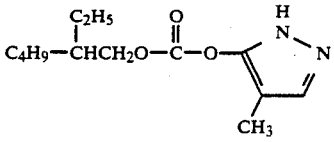
(I-40)
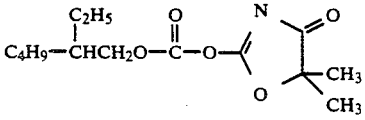
(I-41)
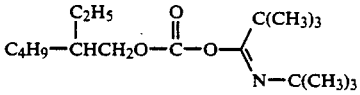
(I-42)
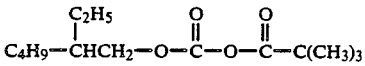
(I-43)
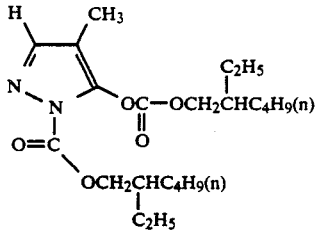
(I-44)
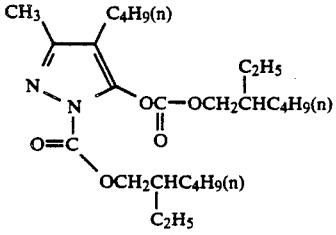
(I-45)
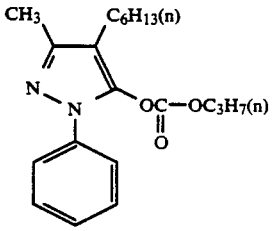
(I-46)

-continued
(I-47)
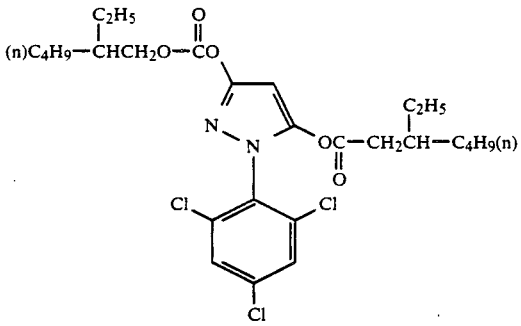
(I-48)
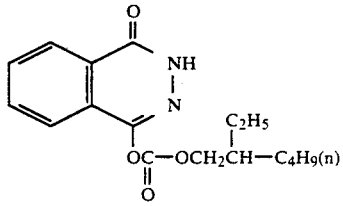
(I-49)
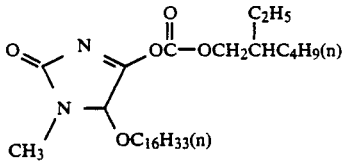
(I-50)
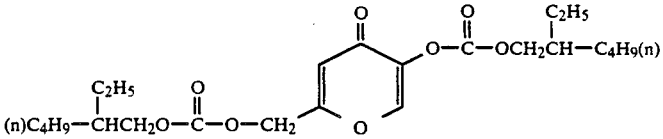
(I-51)
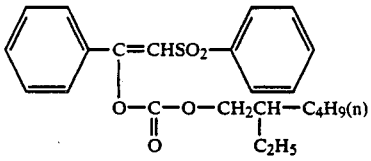
(I-52)
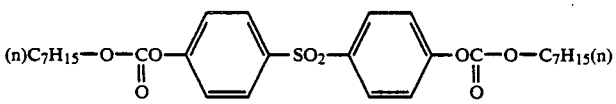
(I-53)
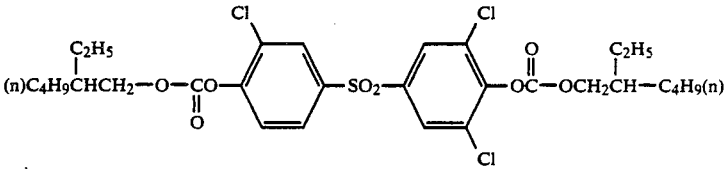
(I-54)
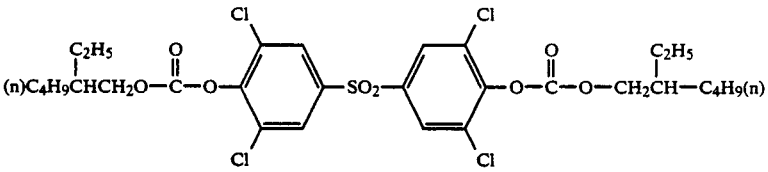
(I-55)
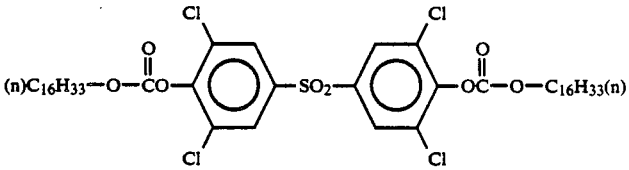
(I-56)
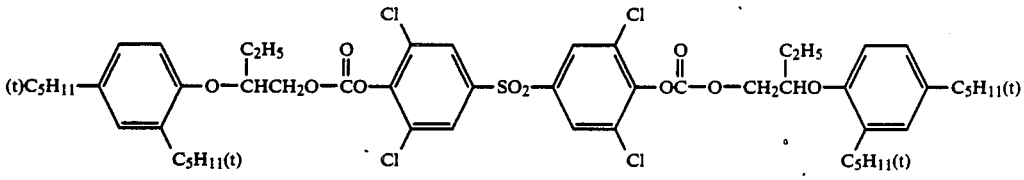

-continued
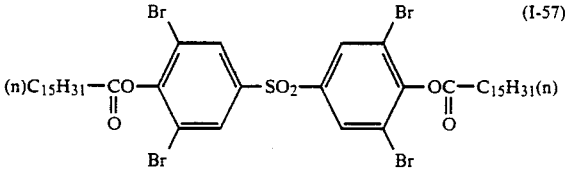
(I-57)
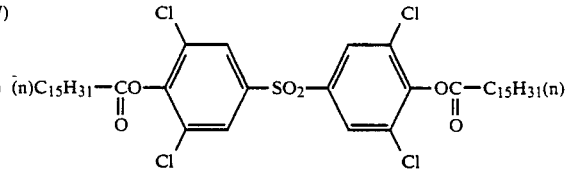
(I-58)
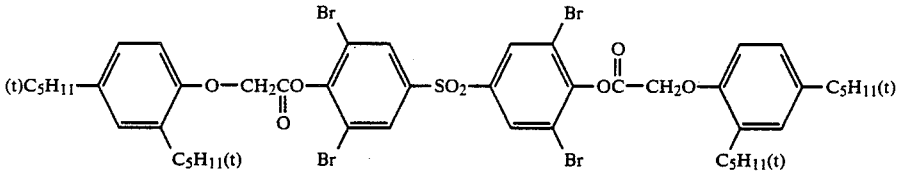
(I-59)
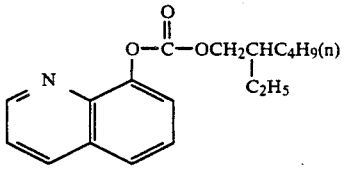
(I-60)
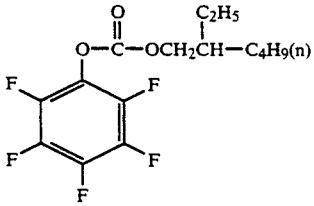
(I-61)
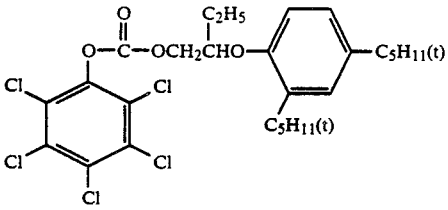
(I-62)
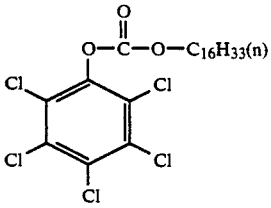
(I-63)
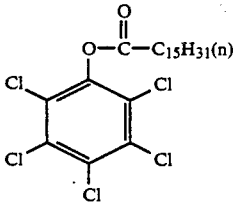
(I-64)
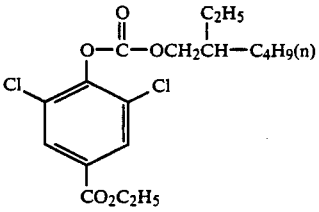
(I-65)
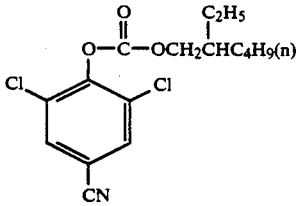
(I-66)
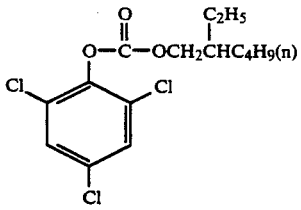
(I-67)
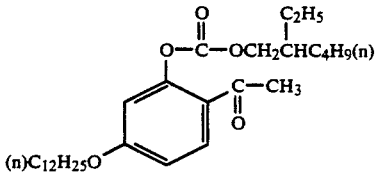
(I-68)
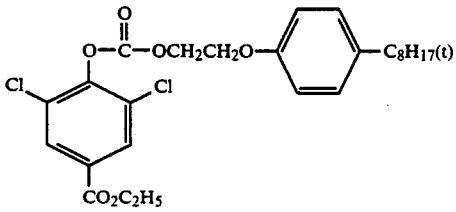
(I-69)

-continued
(I-70)
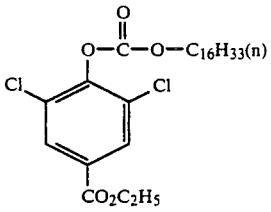
(I-71)
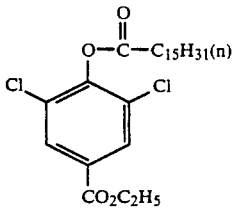
(I-72)
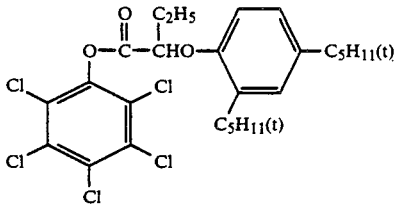
(I-73)
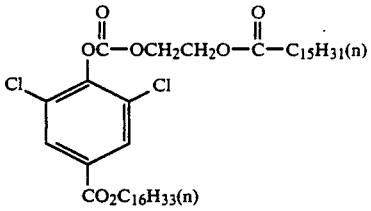
(I-74)
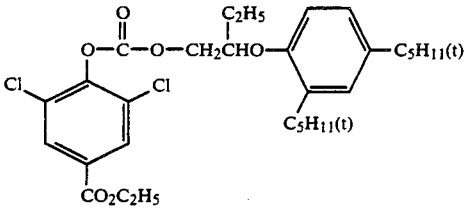
(I-75)
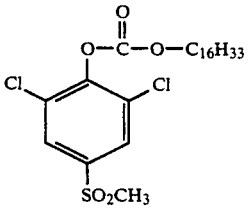
(I-76)
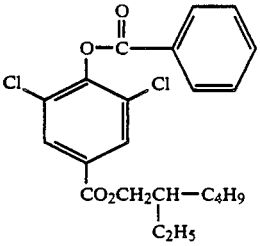
(I-77)
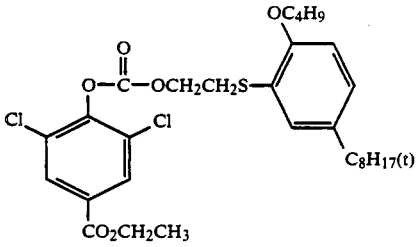
(I-78)
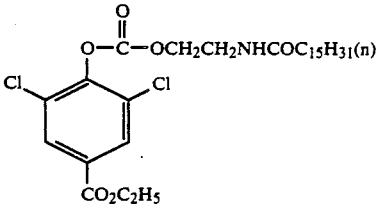
(I-79)
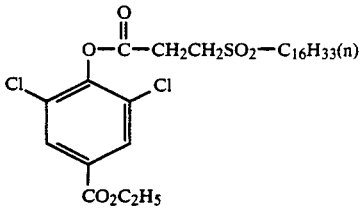
(I-80)
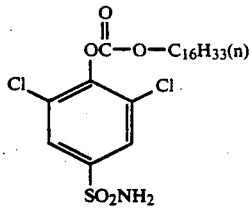
(I-81)
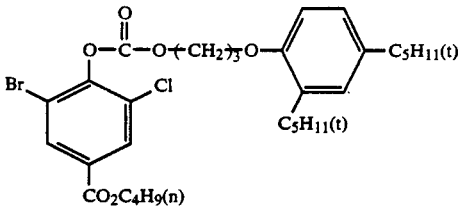
(I-82)
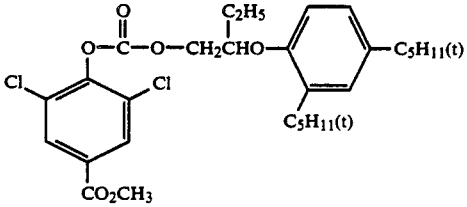
(I-83)
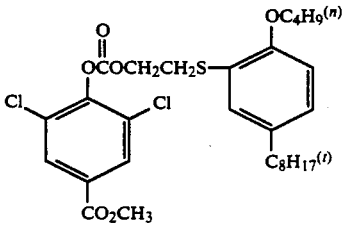

-continued
(I-84)
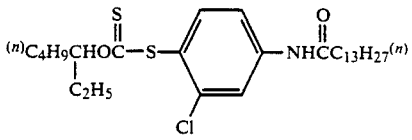
(I-85)
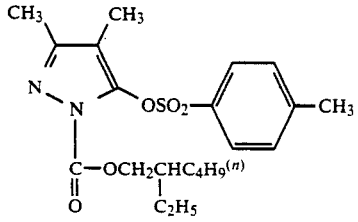
(I-86)
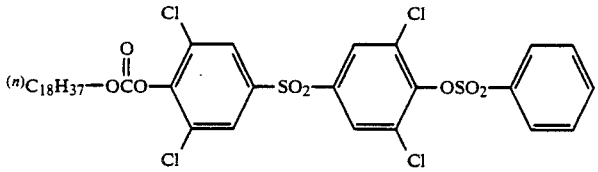
(I-87)
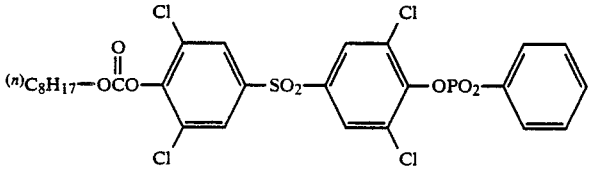
(I-88)
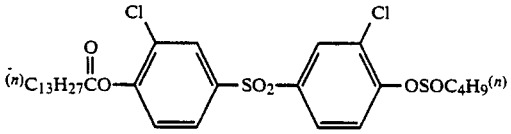
(I-89)
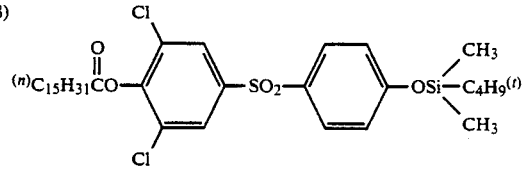
(I-90)
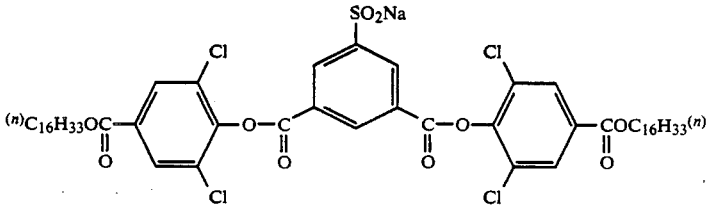
(II-1)
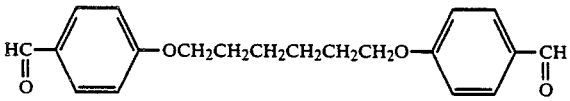
(II-2)
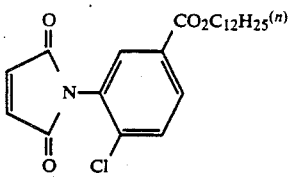
(II-3)
$CH_2{=}CH{-}SO_2{-}C_{18}H_{37}{}^{(n)}$
(II-4)
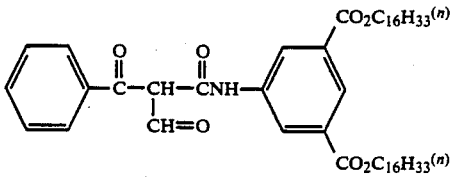
(II-5)
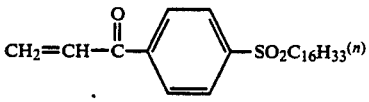
Synthesis examples of representative compounds of the present invention will now be described.

Synthesis of 2-ethylhexyl 4-dodecylbenzenethiocarbonate (exemplified compound I-9)

150 ml of chloroform and 9.9 ml (0.071 mol) of tiethylamine were added to 18 g (0.065 mol) of 4-dodecylbenzenethiol to dissolve it, and the solution was stirred at 25° C. 13.3 g (0.068 mol) of 2-ethylhexyl chlorocarbonate was added to the solution dropwise. After stirring for 30 min, cold aqueous hydrochloric acid was added thereto. After separation, the resulting chloroform layer was washed three times with cold water and then dried over Glauber's salt. The Glauber's salt was filtered out, and the chloroform was then removed by distillation. The product thus obtained was purified by column chromatography, thereby obtaining 17.2 g of exemplified compound I-9 as an oil in a yield of 61.2%.

Results of elementary analysis ($C_{27}H_{46}O_2S_2$):

| | C | H | S |
|---|---|---|---|
| Found (%) | 74.34 | 10.66 | 14.91 |
| Calculated (%) | 74.60 | 10.67 | 14.75 |

SYNTHESIS EXAMPLE 2 (SYNTHESIS OF EXEMPLIFIED COMPOUND I-13)

i) Synthesis of 5-(3-hexadecyloxyphenyl)-3-hydroxy-1-pyenylpyrazole 60 ml of toluene and 10 g (0.12 mol) of manganese dioxide were added to 6.3 g (0.013 mol) of 4,5-dihydroxy-5-(3-hexadecyloxyphenyl-3-hydroxy-1-phenylpyrazole, and the mixture was heated in a steam bath for 2 hours with stirring. Inorganic substances were filtered out. The filtrate thus obtained was evaporated to dryness, followed by crystallization from 20 ml of ethyl acetate, thereby obtaining 5.8 g of a product having a melting point of 108° to 109° C. in a yield of 92.5%.

ii) Synthesis of 3-(2-ethylhexyloxycarbonyloxy)-5-(3-hexadecyloxypenyl)-1-phenyl-pyrazole (exemplified compound I-13)

50 ml of chloroform and 1.9 ml (0.014 mol) of triethylamine were added to 5.3 g (0.011 mol) of 5-(3-hexadecyloxyphenyl)-3-hydroxy-1-phenylpyrazole to dissolve it, and the solution was stirred at 25° C. 2.3 g (0.012 mol) of 2-ethylhexyl chlorocarbonate was added to the solution dropwise. After stirring for 30 min, cold water was added thereto, and the separated chloroform layer was washed twice with 50 ml of cold water and then dried over Glauber's salt. The Glauber's salt was filtered out, and the chloroform was then removed by distillation. The product thus obtained was purified by column chromatography to produce 5.7 g of exemplified compound I-13 as an oil in a yield of 82%.

Results of elementary analysis ($C_{40}H_{60}N_2O_4$):

| | C | H | N |
|---|---|---|---|
| Found (%) | 76.13 | 9.47 | 4.11 |
| Calculated (%) | 75.91 | 9.56 | 4.43 |

SYNTHESIS EXAMPLE 3 (SYNTHESIS OF EXEMPLIFIED COMPOUND I-24)

Synthesis of 4-heptyloxycarbonyloxypyridine (exemplified compound I-24)

100 ml of chloroform and 7.3 ml (0.052 mol) of triethylamine were added to 4.5 g (0.040 mol) of 4-hydroxypyridine monohydrate to dissolve it, and the solution was stirred at 25° C. 8.9 g (0.050 mol) of heptyl chlorocarbonate was added to the solution dropwise. After stirring for 30 min, cold aqueous hydrochloric acid was added thereto. After separation the resulting chloroform layer was washed twice with cold water and then dried over Glauber's salt. After filtering out the Glauber's salt, the chloroform was removed by distillation, and the obtained product was purified by column chromatography, followed by crystallization from ethanol, thereby obtaining 7.5 g of exemplified compound I-24 having a melting point of 44° to 50° C. in a yield of 83%.

Results of elementary analysis ($C_{13}H_{19}NO_3$):

| | C | H | N |
|---|---|---|---|
| Found (%) | 69.52 | 8.47 | 6.03 |
| Calculated (%) | 69.31 | 8.55 | 6.22 |

SYNTHESIS EXAMPLE 4 (SYNTHESIS OF EXEMPLIFIED COMPOUND I-54)

150 ml acetonitrile was added to 19.4 of 3,3',5,5'-tetrachloro-4,4'-dihydroxybiphenylsulfone and 16.8 g of triethylamine, followed by stirring. 21.2 g of 2-ethylhexyl chloroformate was added thereto dropwise at room temperature. The stirring was continued for 3 hours, followed by extraction with ethyl acetate. The ethyl acetate layer was washed with water and then dried. Then the dried ethyl acetate layer was concentrated and the concentrate was purified by silica gel column chromatography to produce 20.5 g (58.4%) of white crystalline exemplified compound I-54. The melting point of the compound was 65° to 66° C.

Results of elementary analysis ($C_{30}H_{38}Cl_4O_8S$):

| | C | H | Cl | S |
|---|---|---|---|---|
| Found (%) | 51.41 | 5.47 | 20.21 | 4.61 |
| Calculated (%) | 51.44 | 5.47 | 20.24 | 4.58 |

SYNTHESIS EXAMPLE 5-1 (SYNTHESIS OF EXEMPLIFIED COMPOUND I-57)

300 ml of acetonitrile was added to 11.3 g of 3,3,5,5-tetrabromobiphenylsulfone and 6.1 ml of triethylamine, followed by stirring. 12.3 g palmitic acid chloride was added thereto dropwise at room temperature. After the stirring was continued for 5 hours, the reaction mixture was poured into 500 ml of water. The precipitated crystals were collected by filtration, washed with water and dried, followed by recrystallization from chloroform-/ethyl acetate mixed solvent to produce 175 g (84.0%) of crystalline exemplified compound I-57. The melting point of the product was 125° to 126° C.

| Results of elementary analysis ($C_{44}H_{66}Br_4O_6S$) | | | | |
|---|---|---|---|---|
| | C | H | Br | S |
| Found (%) | 50.60 | 6.21 | 30.39 | 3.11 |
| Calculated (%) | 50.68 | 6.38 | 30.66 | 3.07 |

SYNTHESIS EXAMPLE 5-2 (SYNTHESIS OF EXEMPLIFIED COMPOUND I-70)

14.3 ml of triethylamine was added to a solution consisting of 23.1 g of ethyl 3,5-dichloro-4-hydroxybenzoate and 100 ml of acetonitrile, and the solution was stirred at room temperature. Then, 30 g of hexadecyl chloroformate was added to the solution dropwise. After stirring for 1 hour, the solution was poured into ice-water, and the resulting crystals were separated by filtration. By recrystallization of crude crystal from isopropyl alcohol the desired compound I-70 was obtained as 43.5 g (yield 87.9%) of white crystal. Melting point: 42°~43° C.

| Results of elementary analysis ($C_{26}H_{40}Cl_2O_5$) | | | |
|---|---|---|---|
| | C | H | Cl |
| Found (%) | 62.11 | 7.98 | 14.02 |
| Calculated (%) | 62.01 | 8.01 | 14.08 |

The compounds (B) that can chemically combine with the oxidized product of the aromatic amine developing agent to form a substantially colorless compound are preferably those having a nucleophilic group derived from a nucleophilic functional group that have a Pearson's nucleophilic $^{n}CH_3$ I value [R. G. Pearson et al., J. Am. Chem. Soc., 90, 319(1968)] of 5 or more.

More preferable examples of the compound (B) are those represented by the following general formula (III): General formula (III)

$$R_7—Z.M$$

wherein $R_7$ represents an aliphatic group (preferably one having 10~80 carbon atoms, more preferably having 20~60 carbon atoms), an aromatic group (preferably one having 16~86 carbon atoms, more preferably having 26~66 carbon atoms), or a heterocyclic group (preferably one having 12~82 carbon atoms, more preferably having 22~62 carbon atoms), Z represents a nucleophilic group, and M represents a hydrogen atom, a metal cation, an ammonium cation or a protective group.

The aliphatic group represented by $R_7$ is a straight chain, branched chain, or cyclic alkyl, alkenyl or alkynyl group. These group may be further substituted. The aromatic group represented by $R_7$ may be any of a carbocyclic aromatic group (e.g., phenyl, and naphthyl), and a heterocyclic aromatic group (e.g., furyl, thienyl, hydrazolyl, pyridyl, and indolyl), which may be of monocyclic type or condensed ring type (e.g., benzofuryl and phenanthridinyl). Further, these aromatic rings may have a substituent.

The heterocyclic group represented by $R_7$ is preferably one having a 3- to 10-membered ring structure comprising carbon atoms, oxygen atoms, nitrogen atoms, sulfur atoms, or hydrogen atoms. The heterocyclic ring itself may be a saturated ring or an unsaturated ring, and it may be substituted further with a substituent (e.g., chromanyl, pyrrolidyl, pyrrolinyl, and morpholinyl).

Z represents a nucleophilic group. The nucleophilic groups includes a group having an oxygen atom, a sulfur atom, or a nitrogen atom as an atom that will directly chemically combine with the oxidized product of the aromatic amine developing agent (Examples of the nucleophilic group include amine compounds, azide compounds, hydrazine compounds, mercapto compounds, sulfide compounds, sulfinic acid compounds, cyano compounds, thiocyano compounds, thiosulfuric acid compounds, seleno compounds, halide compounds, carboxy compounds, hydroxamic acid compounds, active methylene compounds, phenol compounds, and nitrogen heterocyclic compounds.

M represents a hydrogen atom, a metal cation, an ammonium cation or a protective group.

The compound represented by general formula (III) reacts with the oxidized product of the aromatic amine developing agent by a nucleophilic reaction (typically a coupling reaction).

Of compounds represented by general formula (III), the most preferable ones are those represented by the following general formula (IV):

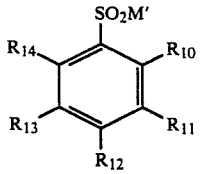

General formula (IV)

In the formula M' represents an atom or an atomic group that can form an inorganic salt (e.g., salts of Li, Na, K, Ca and Mg) or can form an organic salt (e.g., salts of triethyl amine, methylamine and ammonia),

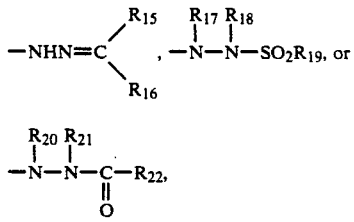

in which $R_{15}$ and $R_{16}$, which may be the same or different, each represent a hydrogen atom, an aliphatic group, an aromatic group, or a heterocyclic group that has the same meaning as defined for $R_1$, or $R_{15}$ and $R_{16}$ may bond together to form a 5- to 7-membered ring; $R_{17}$, $R_{18}$, $R_{20}$ and $R_{21}$, which may be the same or different, each represent a hydrogen atom, an aliphatic group, an aromatic group, or a heterocyclic group that has the same meaning as denied for $R_7$, or an acyl group, an alkoxycarbonyl group, a sulfonyl group, a ureido group, or a urethane group, provided that at least one of $R_{17}$ and $R_{18}$ and at least one of $R_{20}$ and $R_{21}$ are hydrogen atoms; $R_{19}$ and $R_{22}$ represents a hydrogen atom, an aliphatic group, an aromatic group, or a heterocyclic group that has the same meaning as defined for $R_7$; $R_{22}$ further represents an alkylamino group, an arylamino group, an alkoxy group, an aryloxy group, an acyl group, and alkoxycarbonyl group, or an aryloxycarbonyl group having 1~20 carbon atoms; at least two of $R_{17}$, $R_{18}$ and $R_{19}$ may bond together to form a 5- to 7-membered ring; at least two of $R_{20}$, $R_{21}$ and $R_{22}$ may bond together to form a 5- to 7-membered ring;

$R_{10}$, $R_{11}$, $R_{12}$, $R_{13}$ and $R_{14}$, which may be the same or different, each represent a hydrogen atom, an aliphatic group (preferably having 2~74 carbon atoms, more preferably having 12~54 carbon atoms, e.g., methyl, isopropyl, t-butyl, vinyl, benzyl, octadecyl, and cyclohexyl), an aromatic group (preferably having 6~76 carbon atoms, more preferably having 12~56 carbon atoms, e.g., phenyl, pyridyl and naphthyl), a heterocyclic group (preferably having 2~60 carbon atoms, more preferably having 10~50 carbon atoms, e.g., piperidyl, pyranyl, furanyl and chromanyl), a halogen atom (e.g., chlorine and bromine), $-SR_8$, $-OR_8$ or $$-\underset{\underset{R_9}{|}}{N}-R_8$$

(preferably having 1~60 carbon atoms), an acyl group (preferably having 2~60 carbon atoms, e.g., acetyl and benzoyl), an alkoxycarbonyl group (e.g., methoxycarbonyl, butoxycarbonyl, cyclohexylcarbonyl, and octyloxycarbonyl), an aryloxycarbonyl group (e.g., phenyloxycarbonyl and naphthyloxycarbonyl), a sulfonyl group (e.g., methanesulfonyl, and benzenesulfonyl), a sulfonamido group (e.g., methanesulfonamido, and benzenesulfonamido), a sulfamoyl group, a ureido group, a urethane group, a carbamoyl group, a sulfo group, a carboxyl group, a nitro group, a cyano group, an alkoxalyl (e.g., methoxalyl, isobutoxalyl, octyloxyxalyl, and benzoyloxyxalyl group), an aryloxalyl group (e.g., phenoxyxalyl and naphthoxyxalyl), a sulfonyloxy group (e.g., methanesulfonyloxy and benzenesulfonyloxy), $-P(R_8)_3$, $$-\overset{O}{\overset{\|}{P}}(R_8)_2,\ -\overset{S}{\overset{\|}{P}}(R_8)_2,$$

$P(OR_8)_3$ or a formyl group, wherein $R_8$ and $R_9$ each represent a hydrogen atom, an aliphatic group, an alkoxy group, or an aromatic group. The alkoxycarbonyl, aryloxycarbonyl, sulfonyl, sulfonamido, sulfamoyl, urethane group, carbamoyl, alkoxalyl, aryloxalyl group or sulfonyloxy group preferably has 1~60 carbon atoms of $R_{10}$, $R_{11}$, $R_{12}$, $R_{13}$ and $R_{14}$ with respect to $-SO_2M'$.

Typical examples of the compounds represented by general formula (III) are given below:

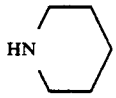

(III-1)

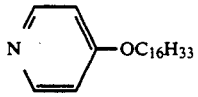

(III-2)

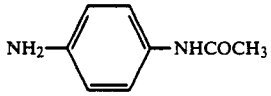

(III-3)

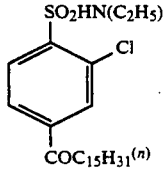

(III-4)

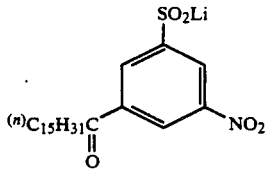

(III-5)

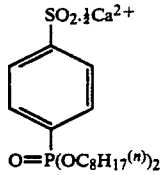

(III-6)

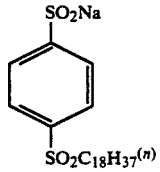

(III-7)

-continued
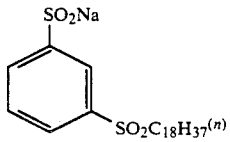
(III-8)
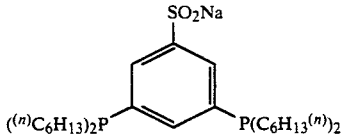
(III-9)
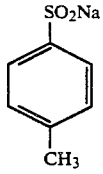
(III-10)
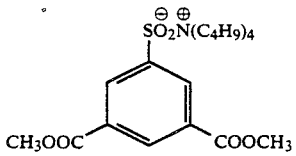
(III-11)
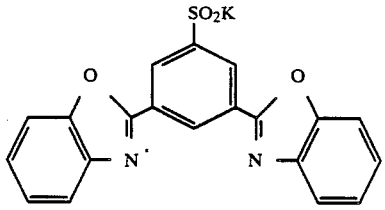
(III-12)
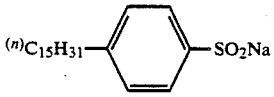
(III-13)
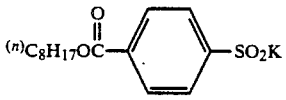
(III-14)
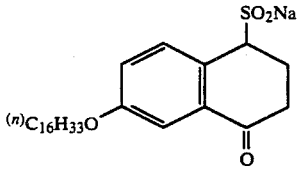
(III-15)
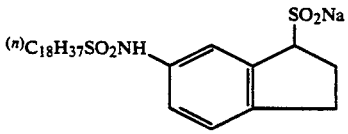
(III-16)
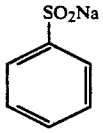
(III-17)

-continued
(III-18)
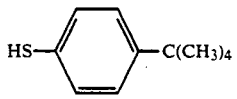
(III-19)
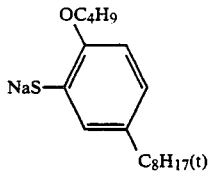
(III-20)
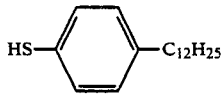
(III-21)
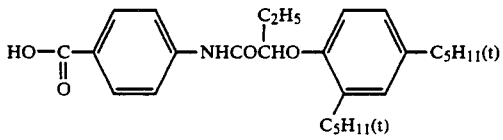
(III-22)
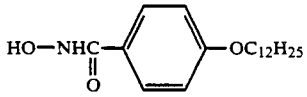
(III-23)
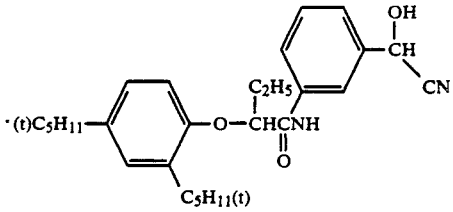
$NaN_3$ (III-24)
(III-25)
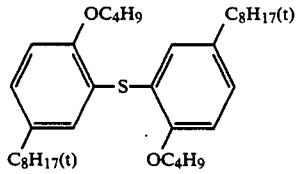
(III-26)
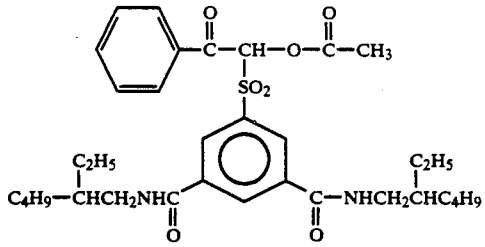
(III-27)
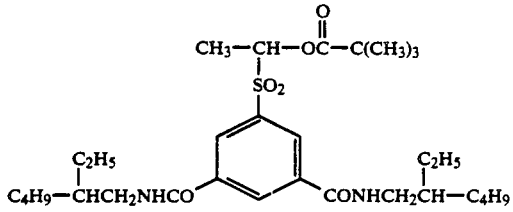

-continued
(III-28)
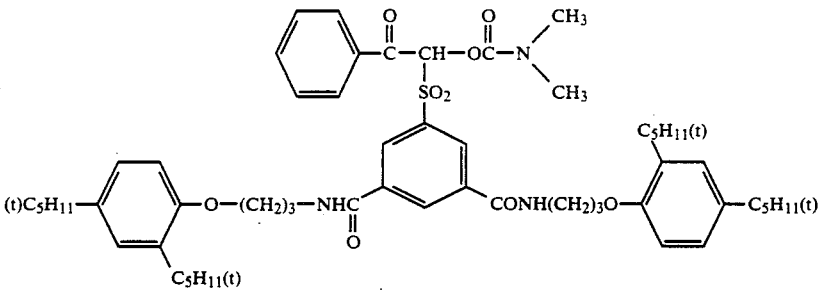
(III-29)
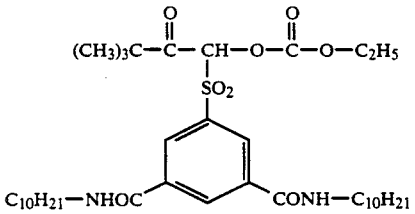
(III-30)
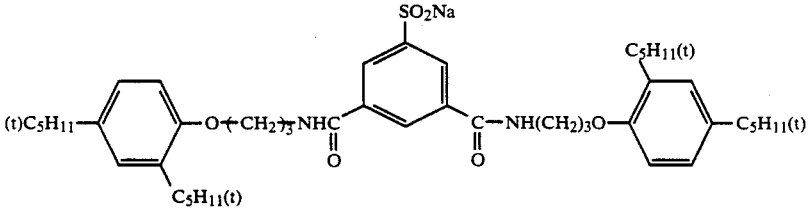
(III-31)
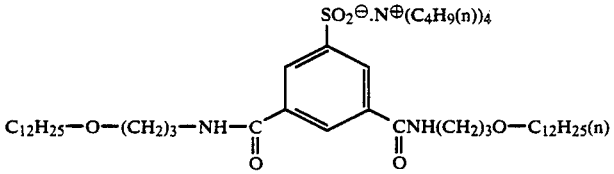
(III-32)
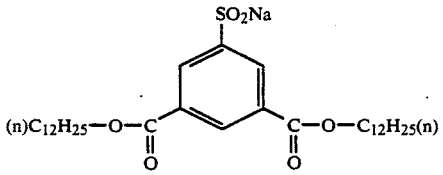
(III-33)
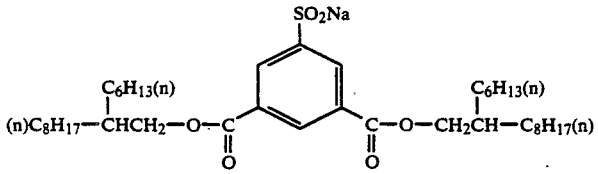
(III-34)
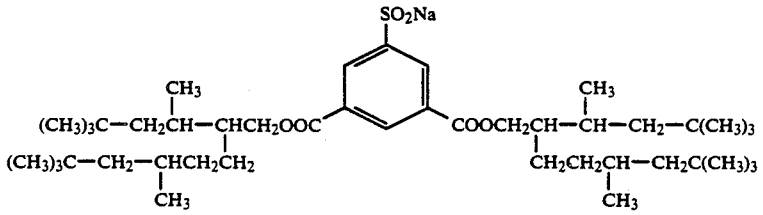

-continued
(III-35)
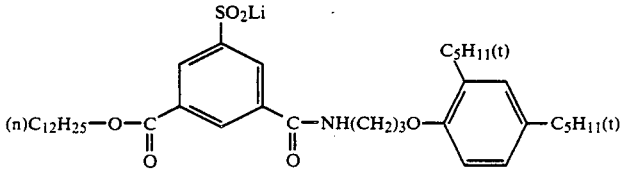
(III-36)
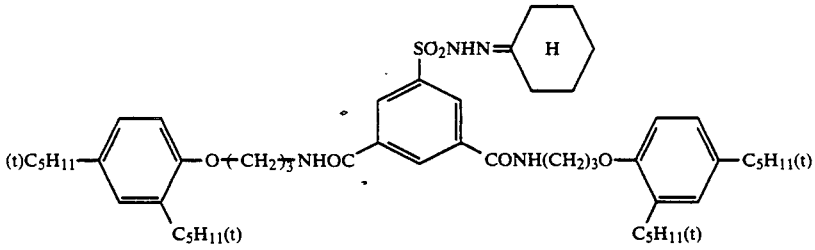
(III-37)
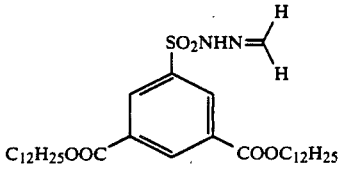
(III-38)
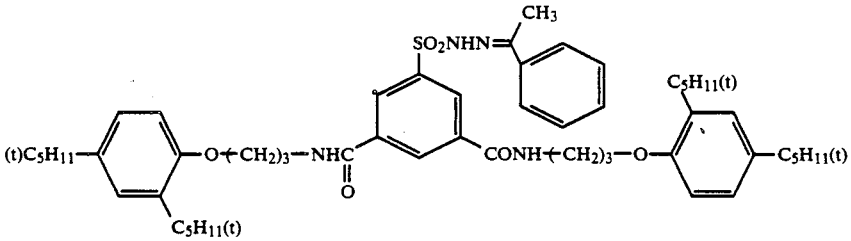
(III-39)
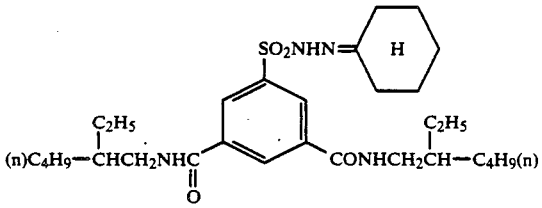
(III-40)
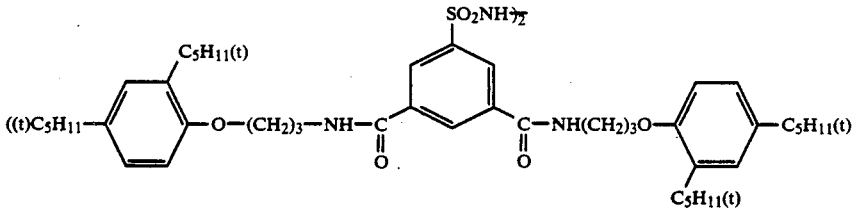
(III-41)
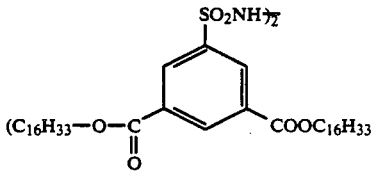

-continued

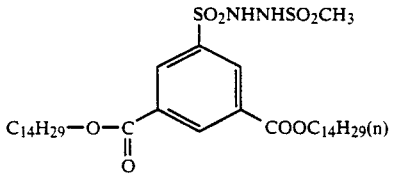

(III-42)

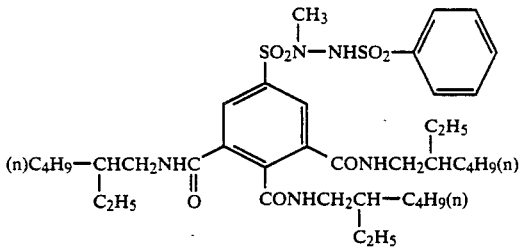

(III-43)

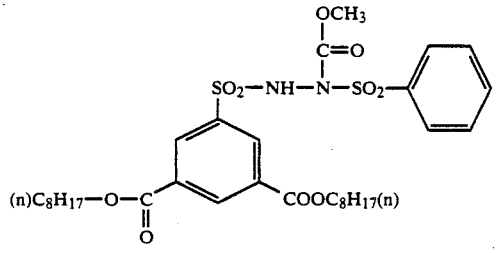

(III-44)

SYNTHESIS EXAMPLE 6 (SYNTHESIS OF EXEMPLIFIED COMPOUND III-30)

i) Synthesis of 3,5-di-(2,4-di-tertiary-acylphenoxypropylcarbamoyl)-benzenesulfonyl chloride 100 ml of toluene, 16 ml (0.080 mol) of a methanol solution containing 28% of sodium methylate and 24.7 g (0.085 mol) of 2,4-di-tertiary-amylphenoxypropylamine were added to 10 g (0.034 mol) of sodium dimethyl 5-sulfoisophthalate, followed by heating to 100° C. The reaction mixture was heated for 3 hours while the methanol was distilled off, and after cooling, cold water was added thereto. The separated toluene layer was washed twice with cold water and then dried over Glauber's salt. The Glauber's salt was filtered out, followed by condensation, and to the resulting dried concentrate were added 100 ml of N,N-dimethylacetamide (DMAC) and 50 ml of acetonitrile to dissolve it, followed by stirring at room temperature. 30 ml (0.326 mol) of phosphorus oxychloride was added thereto, followed by heating to 50° to 60° C. for 1 hour. Ice-water was added to the reaction mixture, extraction was carried out with 300 ml of ethyl acetate, and the ethyl acetate layer was washed three times with cold water and then dried over Glauber's salt. The Glauber's salt was filtered out, the ethyl acetate was removed by distillation, and the product was purified by column chromatography. The yield was 11.5 g (41.9% of theory).

ii) Synthesis of sodium 3,5-di-(2,4-ditertiary-aminopheoxypropylcarbaboyl)-benzenesulfinate (exemplified compound III-30)

100 ml of water and 20 ml of acetonirile were added to 2 g (0.016 mol) of sodium sulfite and 2.4 g (0.029 mol) of sodium hydrogen carbonate, followed by stirring at 30° C. A solution of 10.5 g (0.013 mol) of 3,5-di-(2,4-ditertiary-amylphenoxycarbamoyl)benzenesulfonyl-chloride in 100 ml of acetonitrile was added thereto dropwise. After stirring for 1 hour it was poured into ice-water, followed by extraction with 150 ml of ethyl acetate. The ethyl acetate layer was washed with cold water three times and then dried over Glauber's salt. The Glauber's salt was filtered out, followed by concentrating to dryness to produce 8.6 g of exemplified compound III-30 as a solid in a yield of 82.8%.

Results of elementary analysis ($C_{46}H_{67}N_2O_6SNa$)

| | C | H | N | S |
|---|---|---|---|---|
| Found (%) | 68.75 | 8.39 | 3.32 | 3.92 |
| Calculated (%) | 69:14 | 8.45 | 3.51 | 4.01 |

SYNTHESIS EXAMPLE 7 (SYNTHESIS OF EXEMPLIFIED COMPOUND III-41)

15 ml of ethyl acetate was added to 1.0 g of 3,5-dihexadecyloxycarbonylbenzenesulfonyl hydrazide and 5 ml of dimethylacetamide, followed by stirring at room temperature, and 1.01 g of crystals of 3,5-dihexadecyloxycarbonylbenzenesulfonic acid chloride was added thereto. After stirring for 30 min at room temperature 0.2 ml of pyridine was added thereto, followed by stirring for 5 hours. After the completion of the reaction the reaction liquid was poured into 100 ml of water, and the deposited crystals were filtered and dried. The crystals were purified by silica gel column chromatography to produce 0.4 g (20.5%) of crystals of exemplified compound III-41, melting point 148° to 150° C.

The reaction between the aromatic amine developing agent and the compound represented by general formula (I) or (II) can be shown by the following formula (1), and the reaction between the oxidized product of the aromatic amine developing agent and the compound represented by general formula (III) can be shown by the following formula (2). These reactions proceed gradually during the storage of a color photograph.

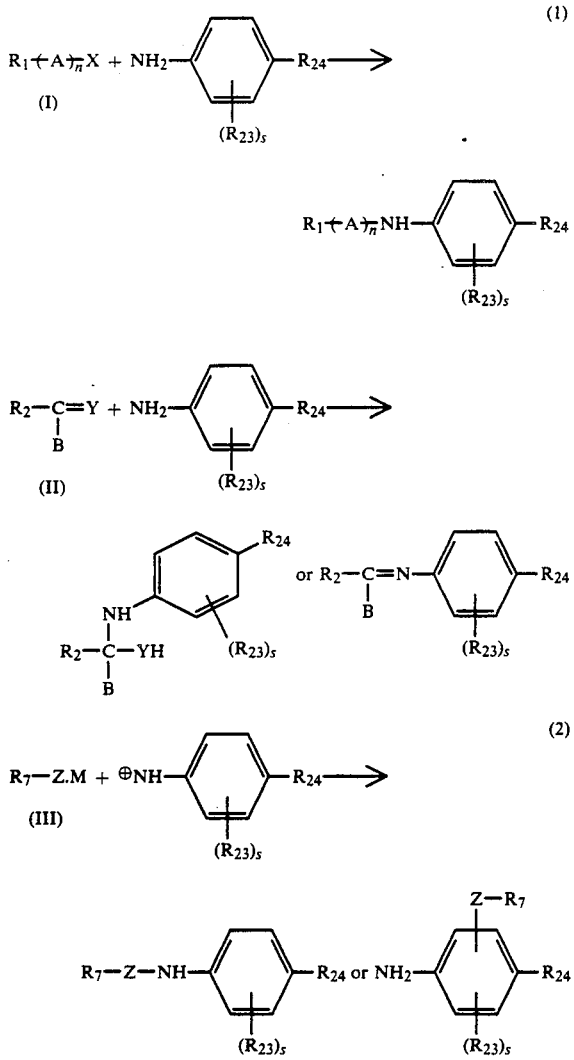

In formulae (1) and (2) shown above, the groups in general formulae (I) to (III) have the same meaning as defined above. $R_{23}$ represents a hydrogen atom, an alkyl group (including a substituted alkyl group, e.g., methyl, ethyl or hydroxymethyl), or an alkoxy group (including a substituted alkoxy group, e.g., methoxy, ethoxy, or methoxyethoxy); $R_{24}$ represents a hydroxy grouup or an amino group (including a substituted amino group, e.g., amino, N-methylamino, N,N-dimethylamino, N,N-diethyl, N-ethyl-N-(2-methanesulfonamidoethyl)amino, N-ethyl-(2-hydroxyethyl)amino and N-ethyl-N-(2-methoxyethyl)amino); and s is an integer of 1 to 4.

In the present invention, if compound (A) or (B) has a low molecular weight or is readily soluble in water, it may be added to a processing solution so that the compound may be taken into the photographic material during the development processing. It is a preferable method wherein the compound is added to the hydrophilic colloid layer of the photographic material in a step of the production of the photographic material. In the latter method, the compound is dissolved in a single high-boiling solvent (oil) that has a boiling point of 170° C. or over at atmospheric pressure, or a single low boiling solvent, or a solvent mixture of said oil and a low boiling solvent, and the resulting solution is emulsified and dispersed in an aqueous hydrophilic colloid solution, such as an aqueous gelatin solution. In the present invention it is preferable that compound (A) or (B) is dissolvable in a high boiling organic solvent. The particle diameter of this emulsified dispersion is not particularly limited, but preferably the particle diameter is 0.05 to 0.5 μm, more preferable 0.1 to 0.3 μm. It is preferable that compound (A) or (B) be co-emulsified with a coupler. In this case the oil/coupler weight ratio is preferably from 0.01 to 2.0.

In the present invention the proportion of compound (A) or (B) is such that $1\times10^{-2}$ to 10 mol, preferably $3\times10^{-2}$ to 5 mol, be present per mol of a coupler. If the amount of compound (A) or (B) is too small, the exhibited effect of the invention tends to lower, whereas if the amount of compound (A) or (B) is too large, the color forming reaction is liable to be hampered or the decomposition of compound (A) or (B) becomes noticeable and tends to damage the color image. In particular, the amount of compound (B) added is preferably in the range of $2\times10^{-2}$ to $2\times10^{-1}$ per mol of a coupler.

Specific examples of the above-mentioned oils include alkyl phthalates (e.g., dibutyl phthalate, dioctyl phthalate, diisodecyl phthalate, and a dimethoxyethyl phthalate), phosphates (e.g., diphenyl phosphate, triphenyl phosphate, tricresyl phosphate, dicotylbutyl phosphate, and monophenyl-p-t-butylphenyl phosphate), citrates (e.g., tributyl acetylcitrate), benzoates (e.g., octyl benzoate), alkylamides (e.g., diethyllaurylamide and dibutyllaurylamide), fatty acid esters (e.g., dibutoxyethyl succinate, diethyl azelate, and dioctyl sebasate), trimesate (e.g., tributyl trimesate), compounds containing epoxy rings (e.g., compounds described in U.S. Pat. No. 4,540,657), and phenols (e.g.,

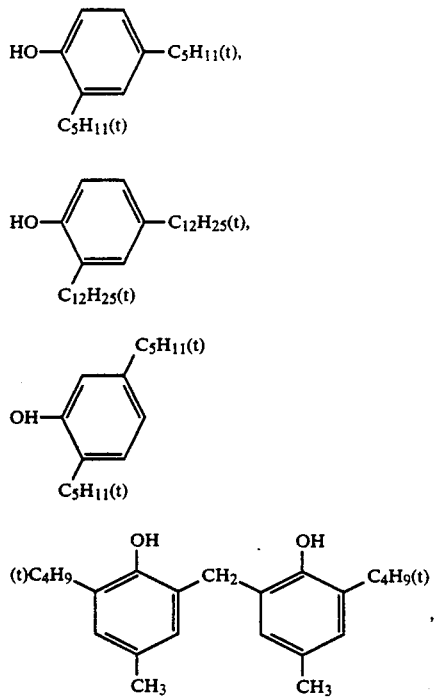

-continued

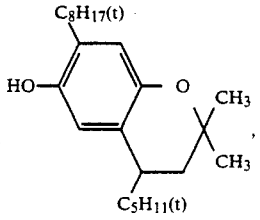

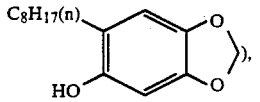

ethers (e.g., phenoxyethanol, and diethylene glycol monophenyl ether). Low boiling solvents used as auxiliary solvents include organic solvents that have a boiling point of about 30° C.–150° C. under atmospheric pressure, such as lower alkyl acetates (for example, ethyl acetate, isopropyl acetate, and butyl acetate) ethyl propionate, methanol, ethanol, sec-butyl alcohol, cyclohexanol, fluorinated alcohols, methyl isobutyl ketone, β-ethoxyethyl acetate, methyl cellosolve acetate acetone, methyl acetone, acetonitrile, dioxane, dimethylformamide, dimethylsulfoxide, cloroform, and cyclohexane.

Instead of high boiling organic solvents, not only oil solvents (including ones that are solid at room temperature, such as waxes) that are additives for couplers, etc., but also latex polymers can be used, and additives such as couplers, color mixing preventive agents, and ultraviolet absorbing agents can also serve as oil solvents.

As latex polymers, use can be made of latex polymers produced by using one or more monomers such as acrylic acid and methacrylic acid, and their esters (e.g., methyl acrylate, ethyl acrylate and butyl acrylate), acrylamide, t-butylacrylamide, methacrylamide, vinyl esters (e.g., vinyl acetate, and vinyl propionate), acrylonirile, styrene, divinylbenzene, vinyl alkyl ether (e.g., vinyl ethyl ether), maleic acid esters (e.g., methyl maleate), N-vinyl-2-pyrrolidone, and N-vinyl pyridine, 2- and 4-vinyl pyridine.

In the present invention, examples of surface active agents used for dispersing into an aqueous protective colloid solution, solutions in which compound (A) or (B) optionally with a coupler is dissolved include saponin, sodium alkylbenzenesulfosuccinates, and sodium alkylbenezenesulfonates.

Preferably anionic surface active agents having a sulfonic acid group such as compounds shown below are used alone or in combination:

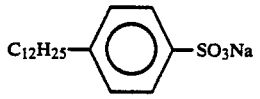

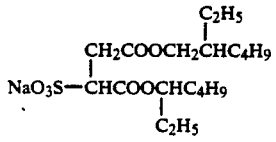

Preferred combination of compounds (A) and (B) for use in the present invention is the combination of a compound (A) selected from compounds represented by general formula (I) and a compound (B) selected from compounds represented by general formula (IV), and especially preferred combination is that of a compound (A) selected from compounds represented (I-a) or (I-c) and a compound (B) selected from compounds represented by general formula (IV). A combination of compounds (A) and (B) selected from compounds represented by general formula (I-a) and (IV) respectively is most preferable.

In the present invention, compound (A) or (B) may be added to any of a color developing solution, a bleaching solution, a fixing solution, a washing solution, and a rinsing solution. In this case, the concentration of compound (A) or (B) in the processing solution is $10^{-5}$ mol/l to $10^{-1}$ mol/l.

The compound of the present invention can be used together with the following oxidation inhibitors and fading preventive agents.

Representative patents in which these fading preventive agents and oxidation inhibitors are described include: U.S. Pat. Nos. 3,935,016, 3,982,944, 3,700,455, 3,764,337, 3,432,300, 3,574,627, 3,573,050, and 4,254,216, Japanese Patent Application (OPI) Nos. 21004/1980, 145530/1979, 152225/1977, 20327/1978, 17729/1978, 72246/1986, 73152/1986, 90155/1986, 90156/1986, 145554/1986, and 6321/1980, Japanese Patent Publication Nos. 12337/1979, and 31625/1973, British Patent No. 1,347,556, and British Patent Application (OPI) No. 2,066,975.

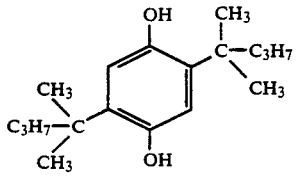

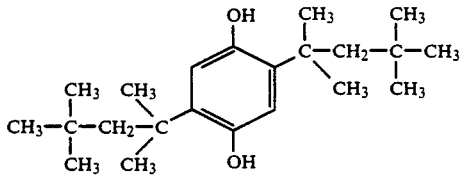

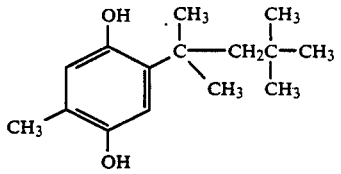

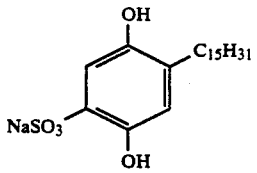

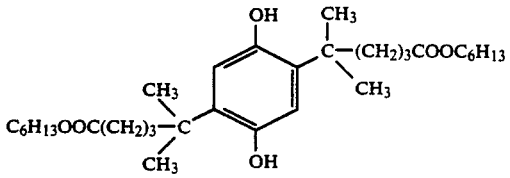

-continued
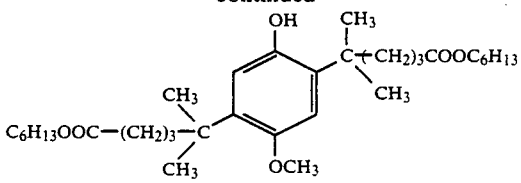
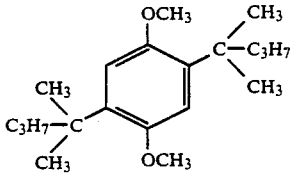
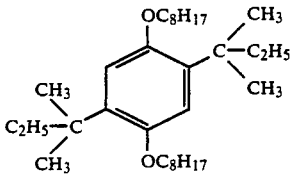
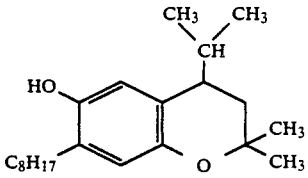
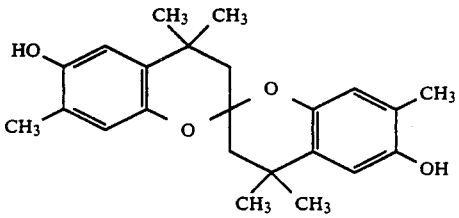
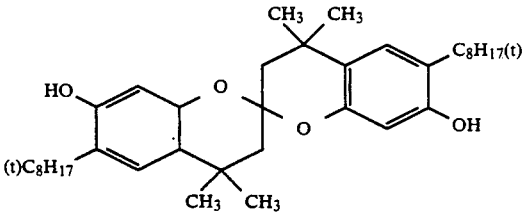
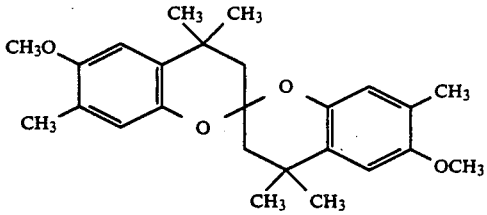
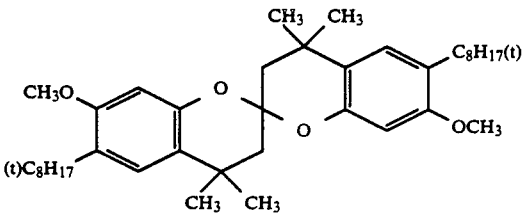
-continued
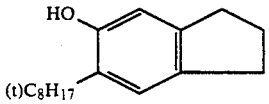
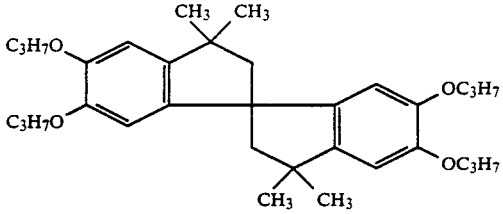
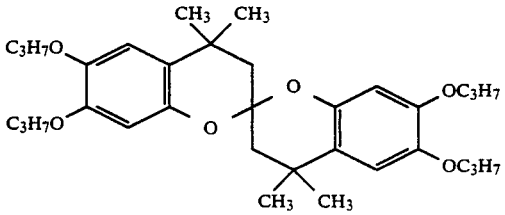
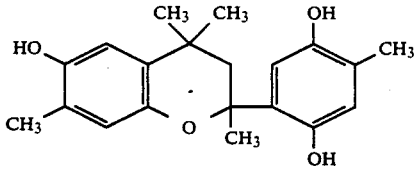
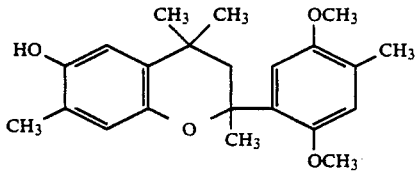
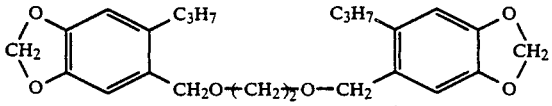
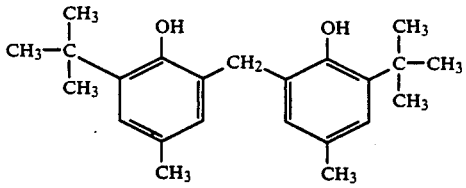
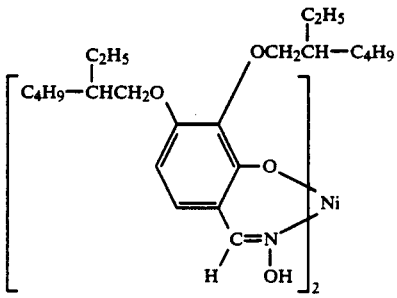

-continued
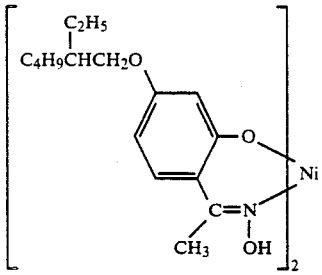
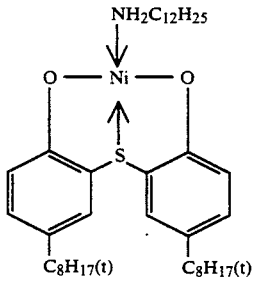
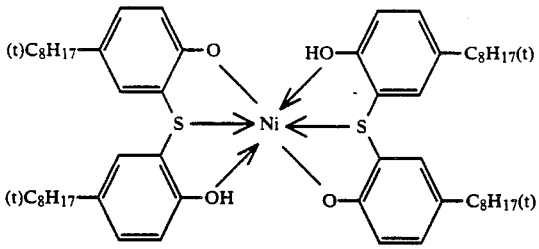
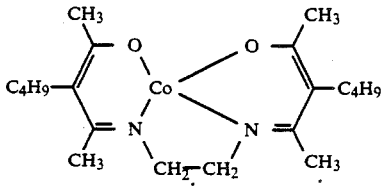
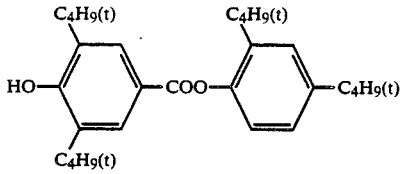
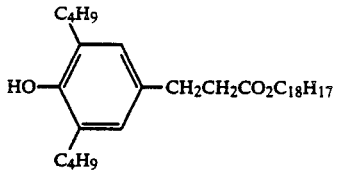
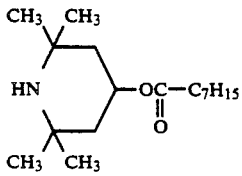
-continued
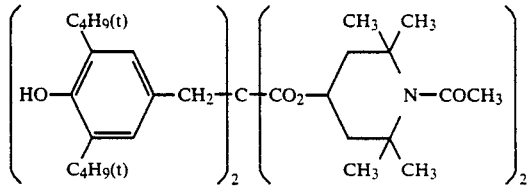
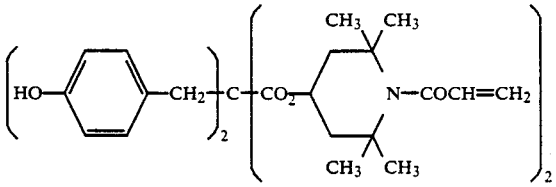
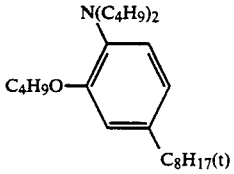
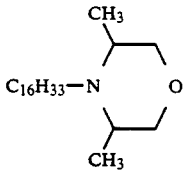
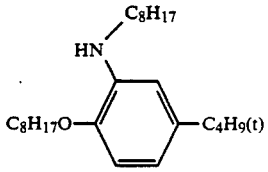
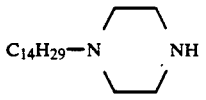
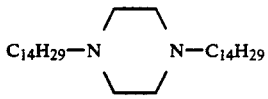
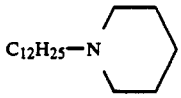
Ultraviolet absorbers that can be used in the present invention include those listed in Research Disclosure (R.D.) No. 17643, VII-C, and preferably are benzotriazole derivatives represented by the following general formula (XVII):

General formula (XVII)

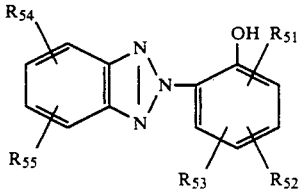

In the formula $R_{51}$, $R_{52}$, $R_{53}$, $R_{54}$, and $R_{55}$, which may be the same or different, each represent a hydrogen atom, an alkoxy group, an alkyl group, a halogen atom, or an alkoxycarbonyl group.

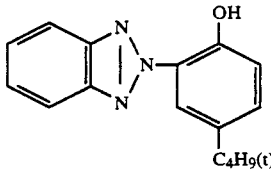

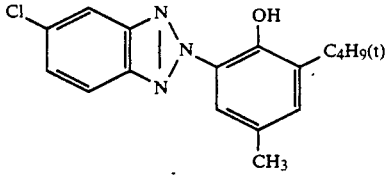

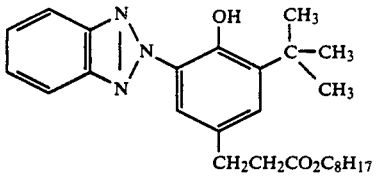

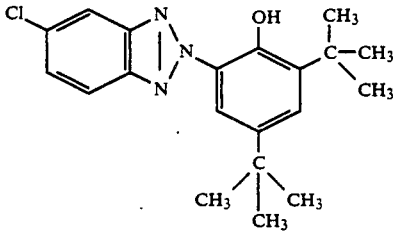

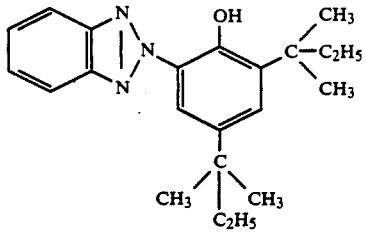

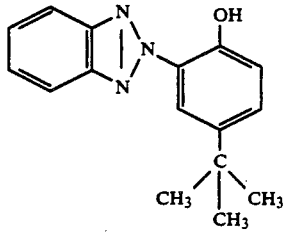

-continued

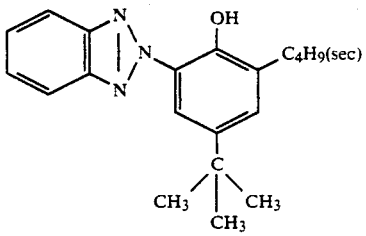

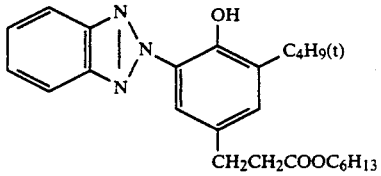

The process for the production of a color photograph of the present invention is the same as the conventional process for the production of a color photograph, except that compound (A) or (B) is employed in the manner described above.

Color photographic materials to which the present process for the production of a color photograph will be applied are not particularly limited, and typical examples of the color photographic materials include color papers, color negative film for general purposes and movies, color reversal films for slides and television, color positive films, and color reversal papers. The present invention can also be applied to black and white photographic materials that use a mixture of three color couplers, as described in Research Disclosure 17123 (June 1978).

Therefore, there is no particular limit to the couplers employed in the color photographic materials, and examples include:

(a) Yellow couplers

Couplers represented by the general formulae (Y-I) and (Y-II):

General formula (Y-I)

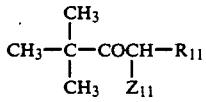

wherein $R_{11}$ represents a substituted or unsubstituted N-phenylcarbamoyl group, and $Z_{11}$ represents a group that can split off in the reaction with the oxidized product of the aromatic primary amine color developing agent.

General formula (Y-II)

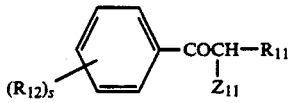

wherein $R_{11}$ represents a substituted or unsubstituted N-phenylcarbamoyl group, $Z_{11}$ represents a group that can split off in the reaction with the oxidized product of the aromatic primary amine color developing agent, $R_{12}$ represents a hydrogen atom or a substituent group, and s is an integer of 1 to 5.

In more detail, typical chemical structures of the yellow couplers represented by general formulae (Y-I)

and (Y-II) are the same ones as described, for example, in U.S. patent specifications given below, wherein the numbers in parentheses indicate the columns describing the chemical structures: U.S. Pat. Nos. 3,894,875 (1-2), 3,408,194 (2-3), 4,404,274 (3-17), 4,022,620 (3-7) and 4,057,432 (1-4).

(b) Magenta couplers

Couplers represented by the following general formulae (M-I) and (M-II):

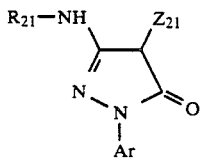

General formula (M-I)

wherein $R_{21}$ represents an alkyl group, an aryl group, an acyl group, or a carbamoyl group; Ar represents a phenyl group or a phenyl group substituted by one or more of halogen atoms, alkyl groups, cyano groups, alkoxy groups, alkoxycarbonyl groups, or acylamino groups; and $Z_{21}$ represents a hydrogen atom or a group that can split off in the reaction with the oxidized product of the aromatic primary amine color developing agent.

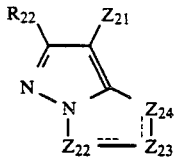

General formula (M-II)

wherein $R_{22}$ represents a hydrogen atom or a substituent group; $Z_{21}$ represents a hydrogen atom or a group that can split off in the reaction with the oxidized product of the aromatic primary amine color developing agent; $Z_{22}$, $Z_{23}$ and $R_{24}$ represent

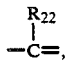

—N= or —NH—; one of the $Z_{24}$-$Z_{23}$ bond and the $Z_{23}$-$Z_{22}$ bond is a double bond and the other is a single bond; and when the $Z_{23}$-$Z_{22}$ is a carbon-carbon double bond, the double bond may be part of an aromatic ring.

In more detail, typical chemical structures of the magenta couplers represented by general formulae (M-I) and (M-II) are the same ones as described in U.S. patent specifications, etc. given below, wherein the numbers in parentheses indicate the columns or the pages describing the chemical structures: U.S. Pat. Nos. 3,519,429 (2-6), 3,558,319 (2-3), 3,725,067 (2-8), 3,935,015 (3-7), 4,241,168 (2-14), 4,351,897 (2-6), 4,367,282 (3-10), and 4,540,654 (2-8), Japanese Patent Application (OPI) No. 65245/1986 (pages 378–384), and WO-86-1915 (pages 5–10).

(c) Cyan couplers

Cyan couplers represented by the general formula (C-I):

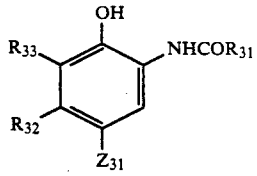

General formula (C-I)

wherein $R_{31}$ represents an alkyl group, a cycloalkyl group, an aryl group, an amino group, or a heterocyclic group; $R_{32}$ represents an acylamino group or an alkyl group; $R_{33}$ represents a hydrogen atom, a halogen atom, an alkyl group or an alkoxy group; $R_{33}$ and $R_{32}$ may bond together to form a ring; and $Z_{31}$ represents a hydrogen atom, a halogen atom, or a group that can split off in the reaction with the oxidized product of the aromatic primary amine color developing agent.

In more detail, typical chemical structures of the cyan couplers represented by general formula (C-I) are the same ones as described, for example, in U.S. patent specifications given below, wherein the numbers in parentheses indicates the columns describing the chemical structures: U.S. Pat. Nos. 2,920,961 (1), 3,772,002 (1-3), 3,864,366 (2-6), 4,124,396 (2), 4,333,996 (2-8), 4,565,777 (3-5) and 4,564,586 (2-4).

The above couplers may form a dimer or an even higher polymer.

Preferred couplers for use in combination with preservability improving compounds (A) and (B) of the present invention are couplers represented by general formula (Y-I), (M-II) or (C-I), of which especially preferable being couplers represented by general formula (M-II) or (C-I).

Specific examples of these couplers are given below, but the invention is not limited to them.

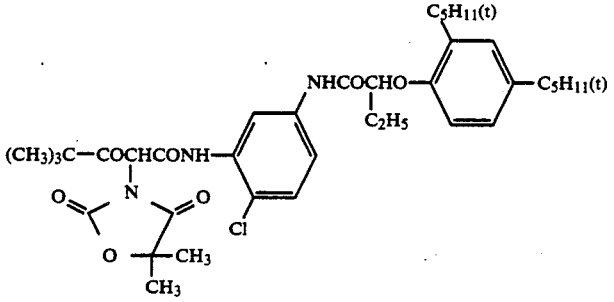

(Y-I)

-continued
(Y-2)
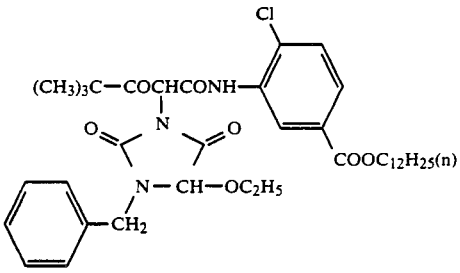
(Y-3)
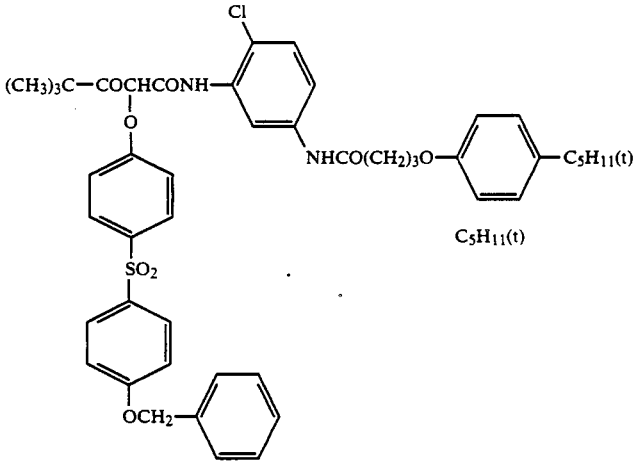
(Y-4)
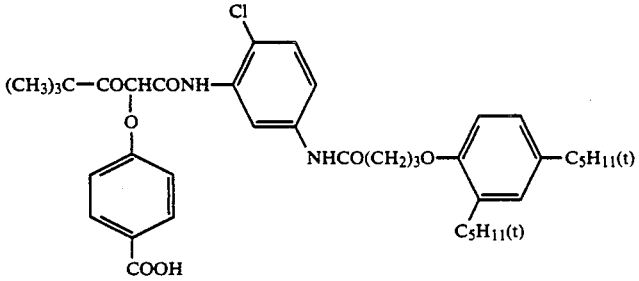
(Y-5)
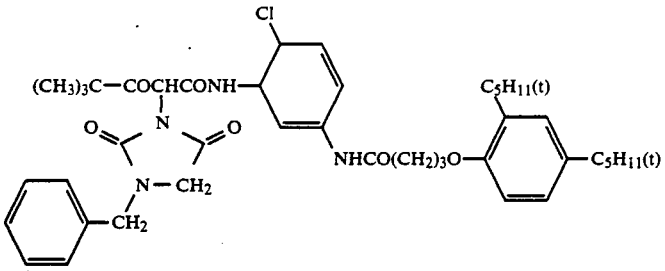
(Y-6)
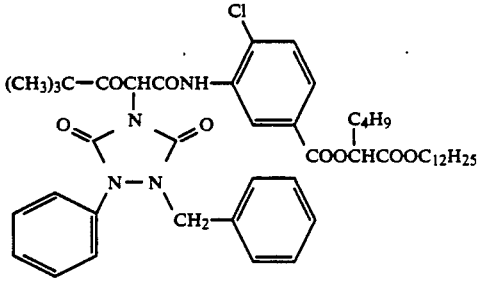

-continued
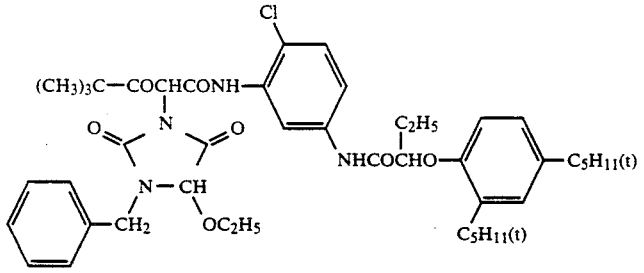
(Y-7)
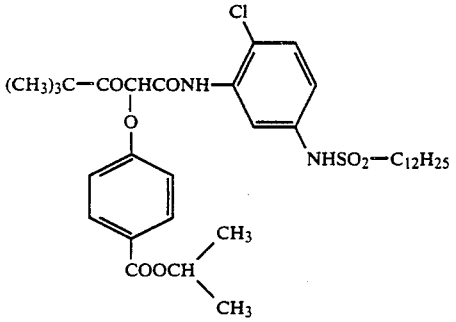
(Y-8)
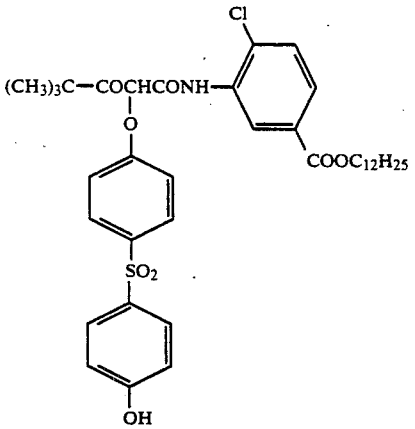
(Y-9)
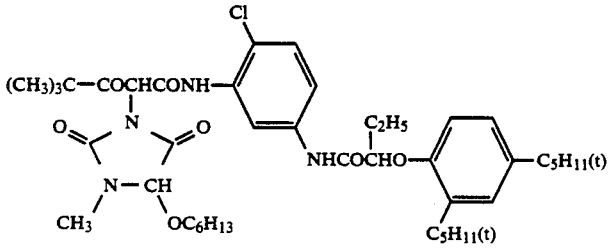
(Y-10)

-continued
(Y-11)
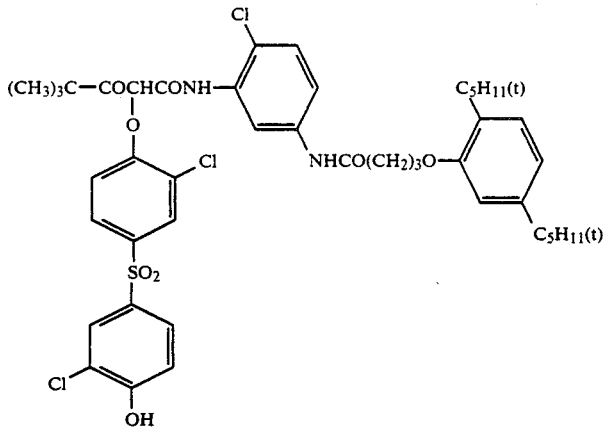
(Y-12)
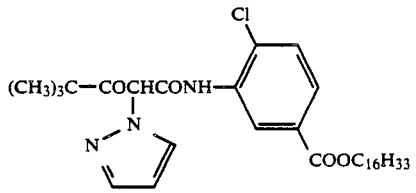
(Y-13)
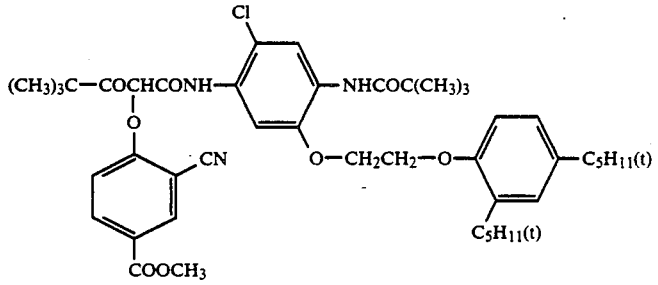
(Y-14)
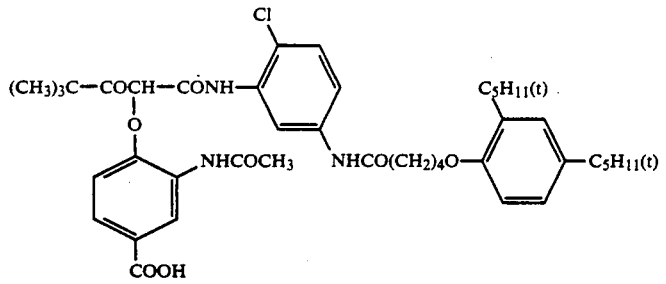
(Y-15)
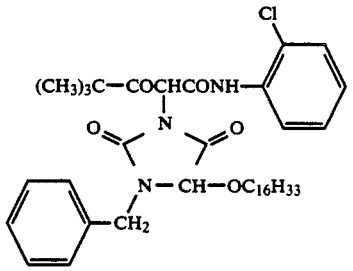

-continued
(Y-16)
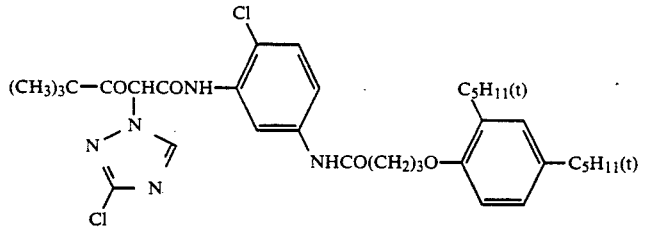
(Y-17)
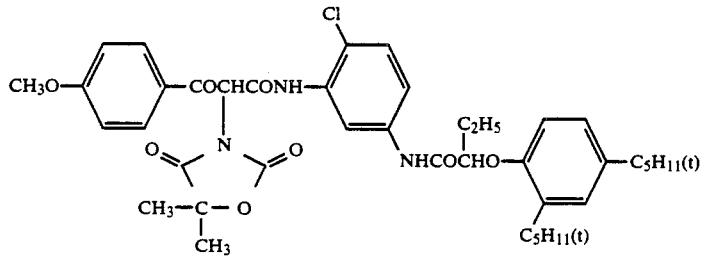
(Y-18)
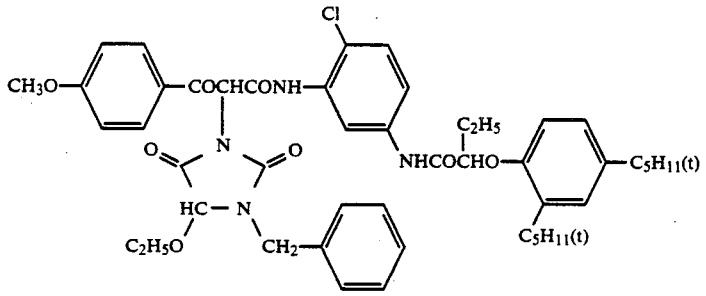
(Y-19)
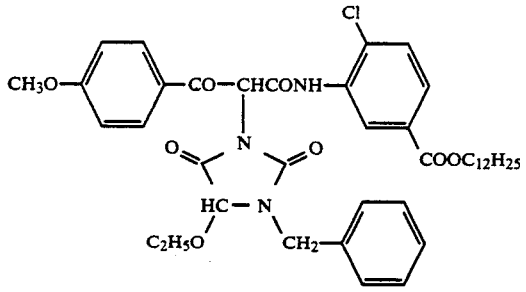
(Y-20)
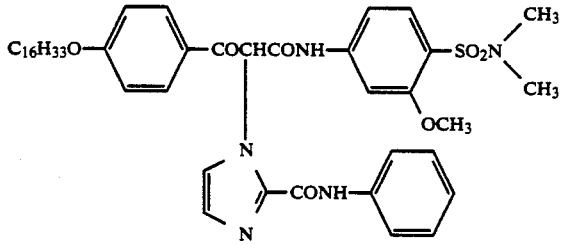

-continued
(Y-21)
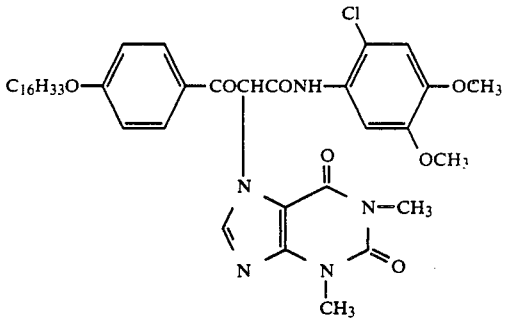
(Y-22)
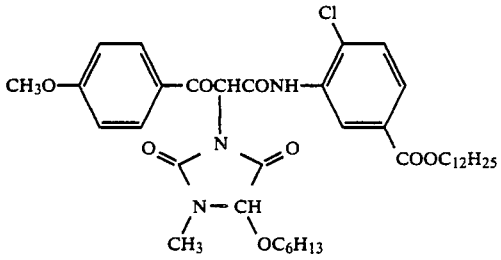
(Y-23)
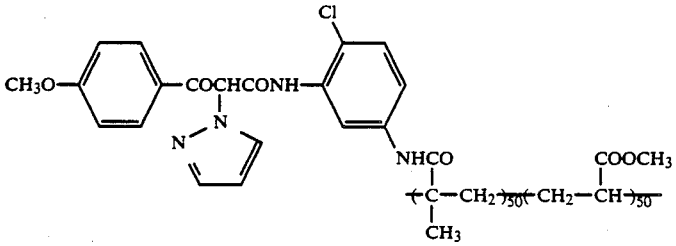
(Y-24)
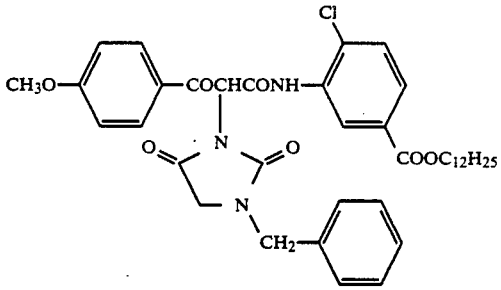
(Y-25)
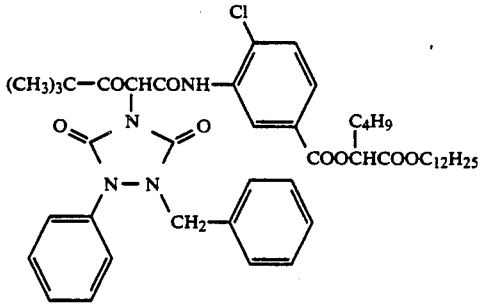

-continued
(Y-26)
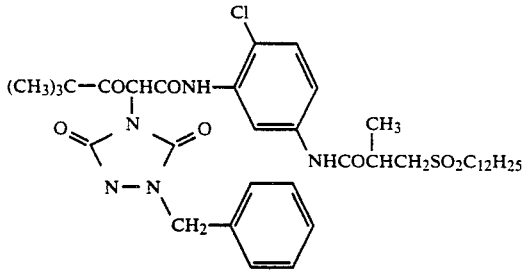
(Y-27)
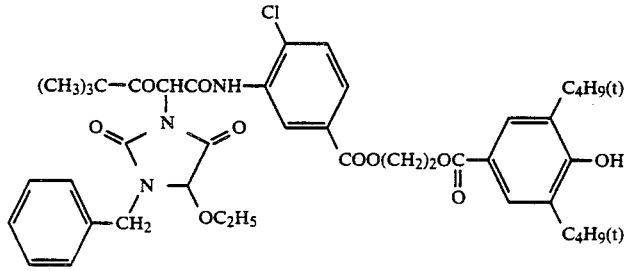
(Y-28)
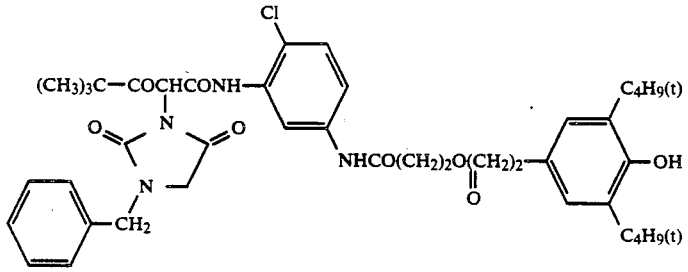
(M-1)
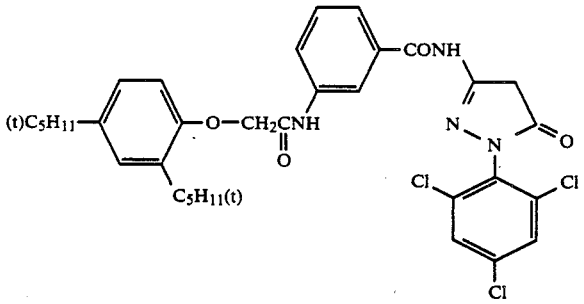
(M-2)
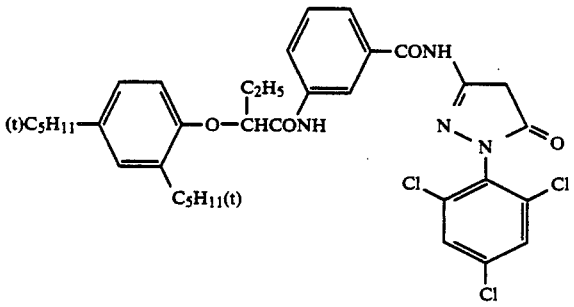

-continued
(M-3)
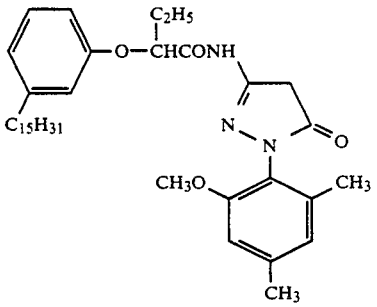
(M-4)
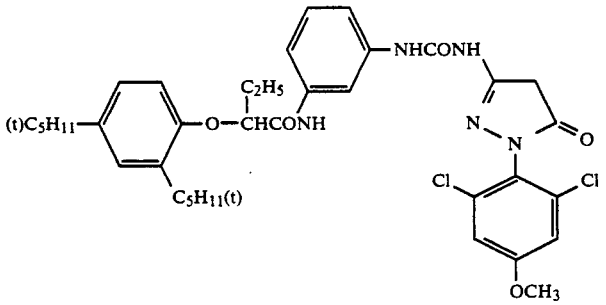
(M-5)
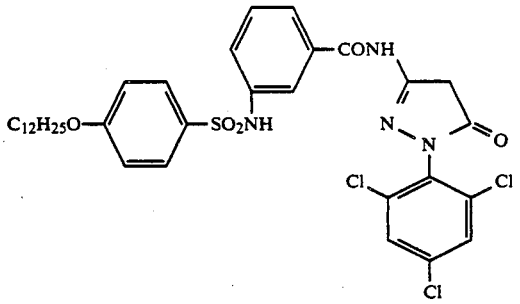
(M-6)
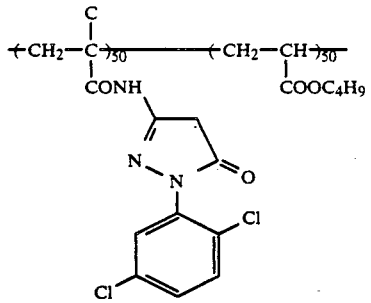
(M-7)
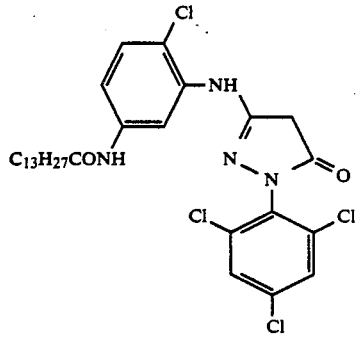

-continued
(M-8)
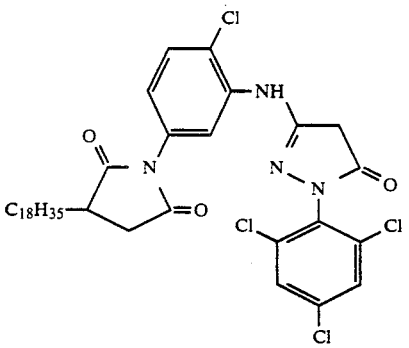
(M-9)
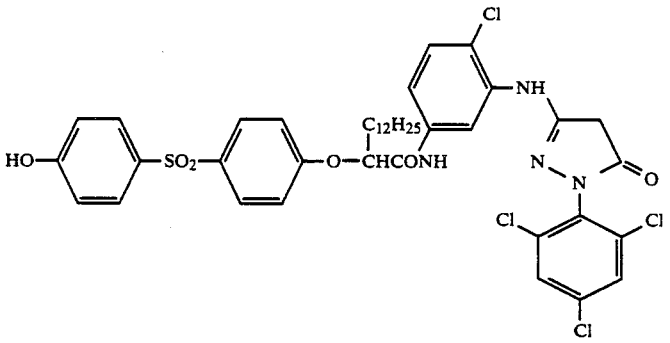
(M-10)
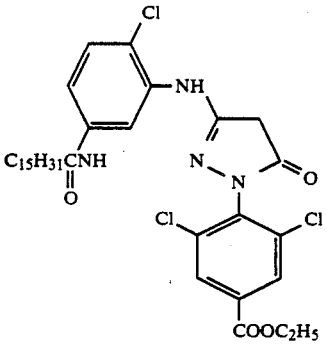
(M-11)
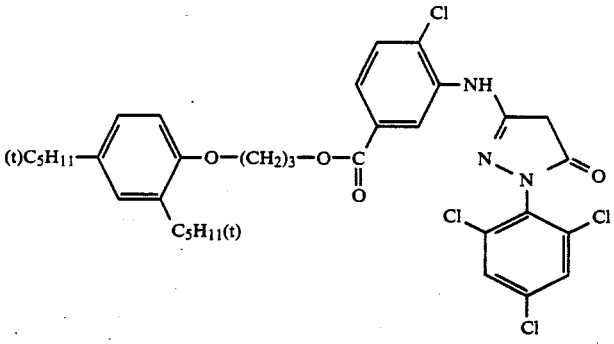
(M-12)
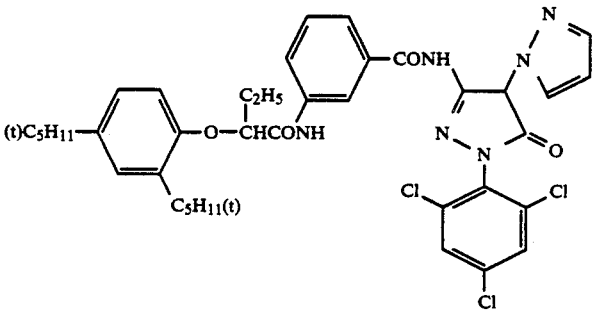

-continued
(M-13)
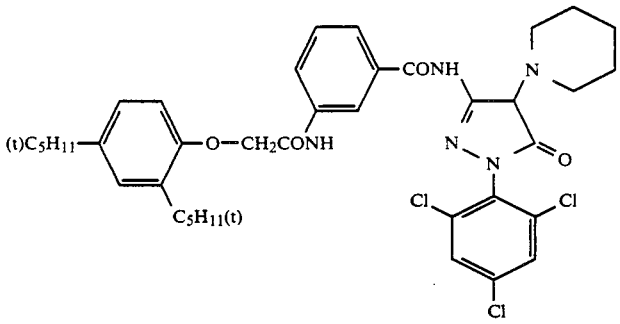
(M-14)
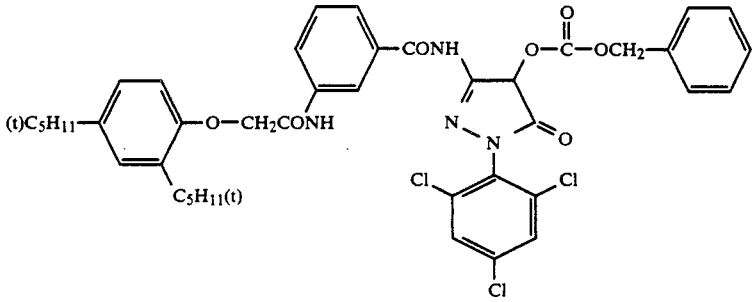
(M-15)
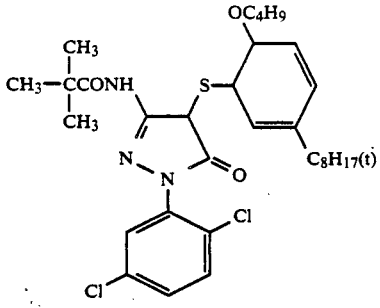
(M-16)
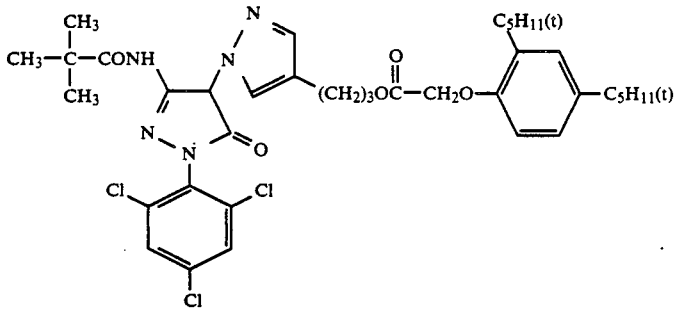
(M-17)
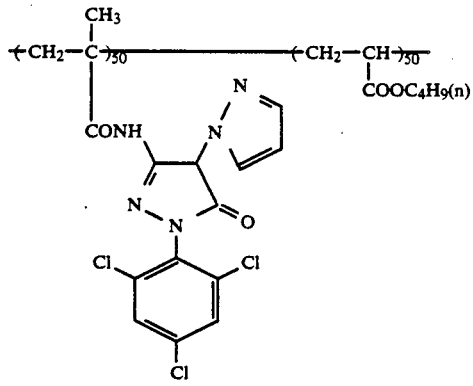

-continued
(M-18)
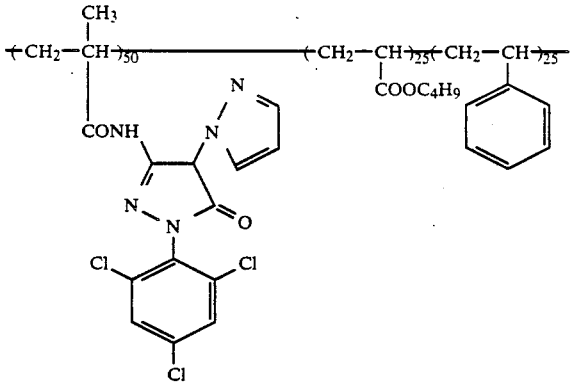
(M-19)
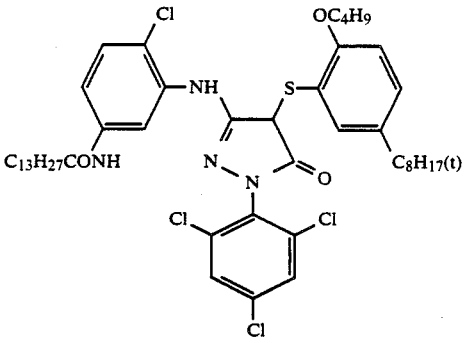
(M-20)
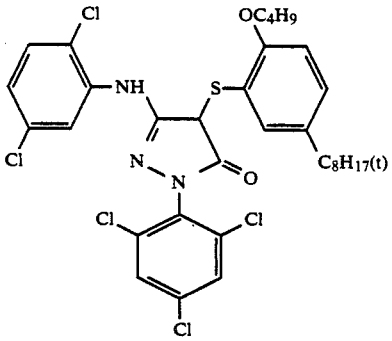
(M-21)
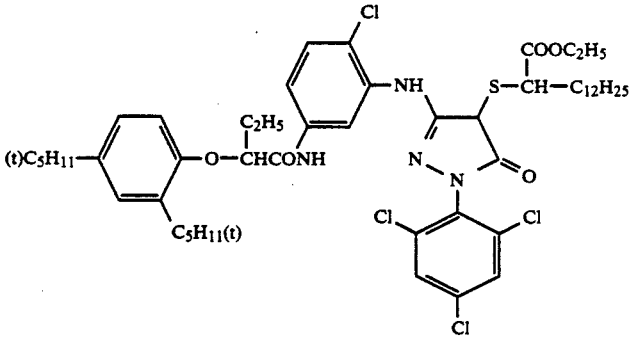

-continued
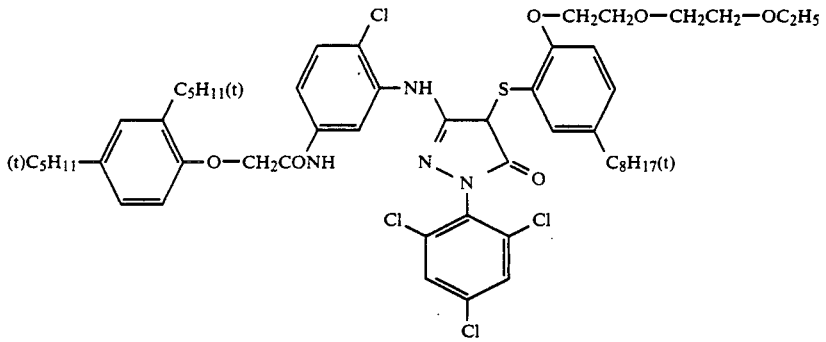
(M-22)
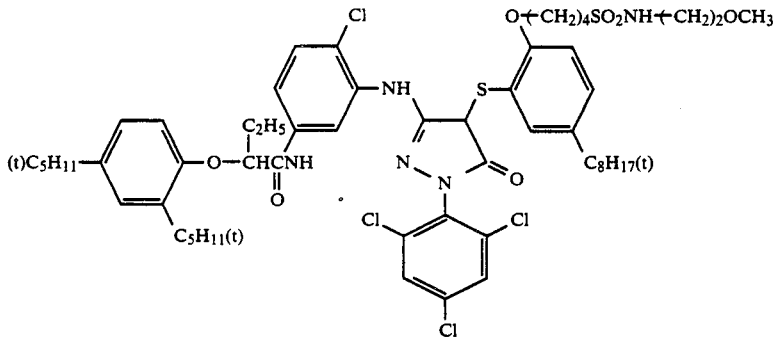
(M-23)
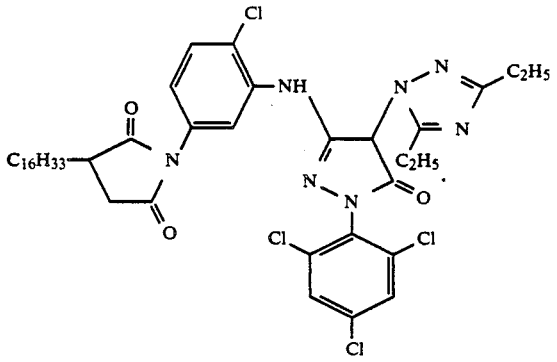
(M-24)
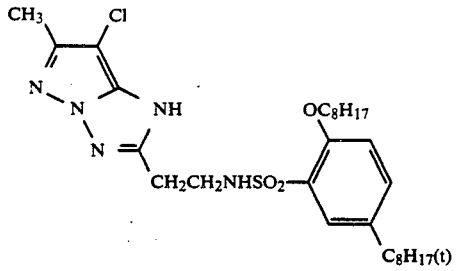
(M-25)
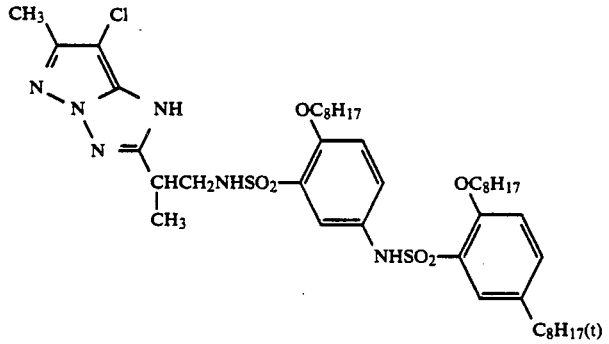
(M-26)

-continued
(M-27)
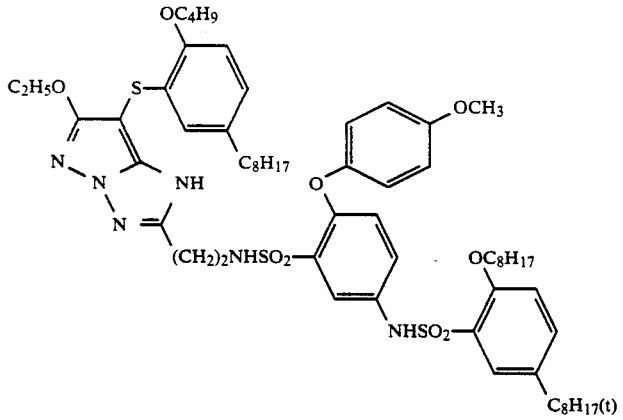
(M-28)
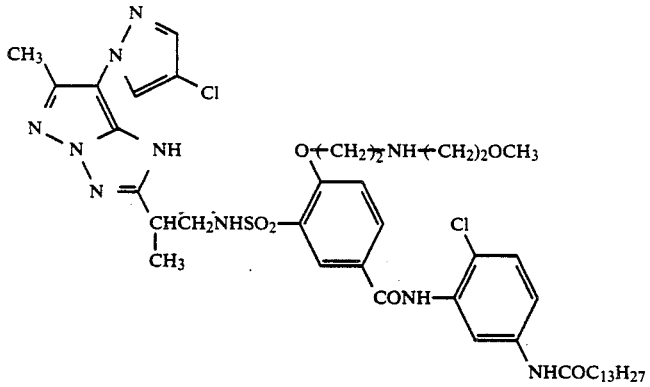
(M-29)
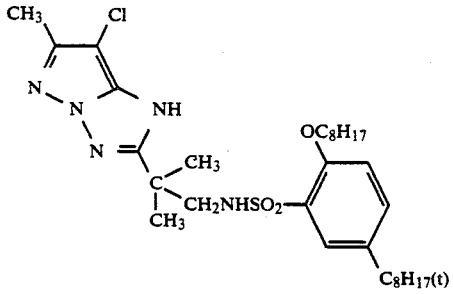
(M-30)
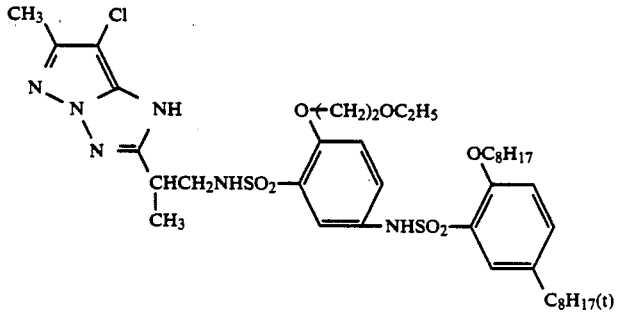

-continued
(M-31)
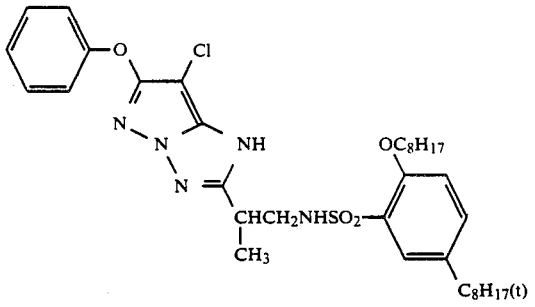
(M-32)
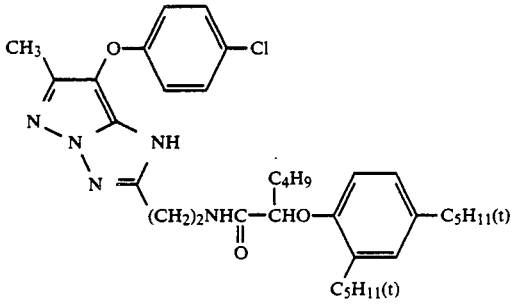
(M-33)
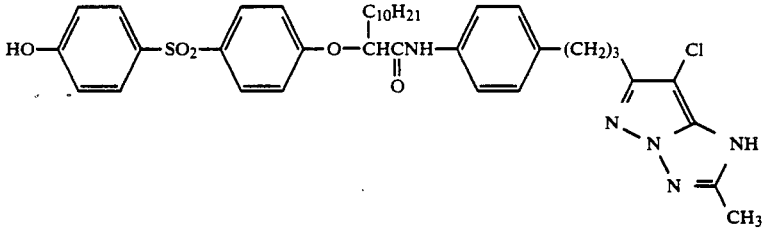
(M-34)
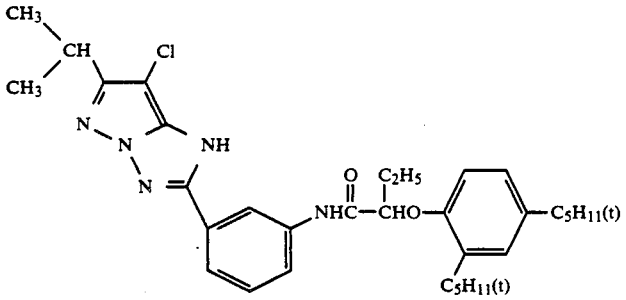
(M-35)
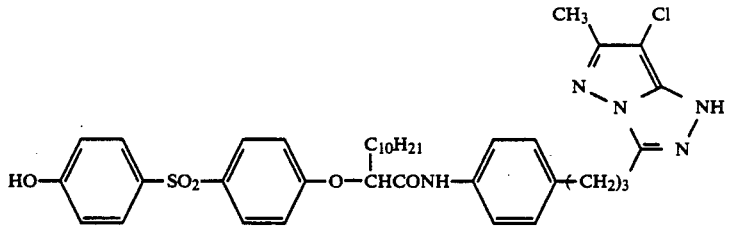
(M-36)
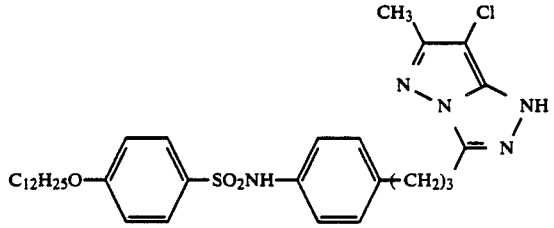

-continued
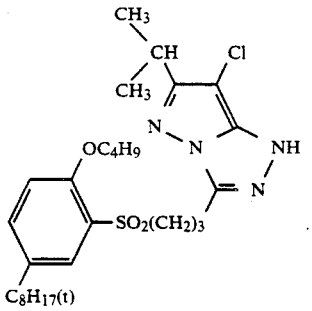
(M-37)
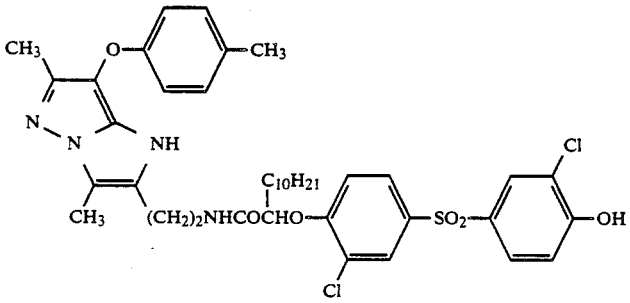
(M-38)
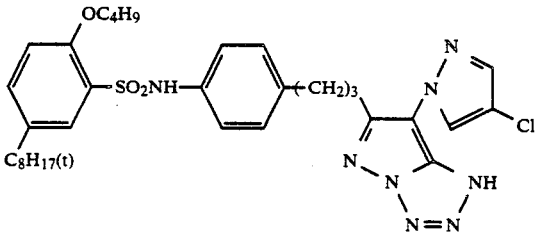
(M-39)
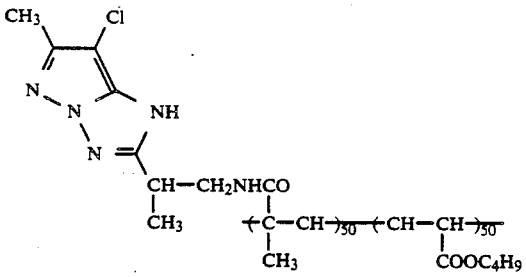
(M-40)
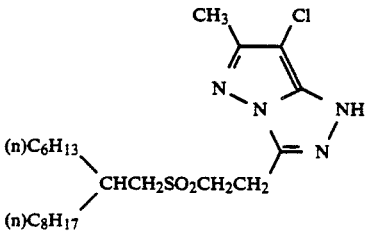
(M-41)

-continued
(M-42)
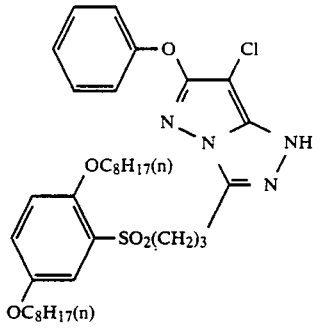
(M-43)
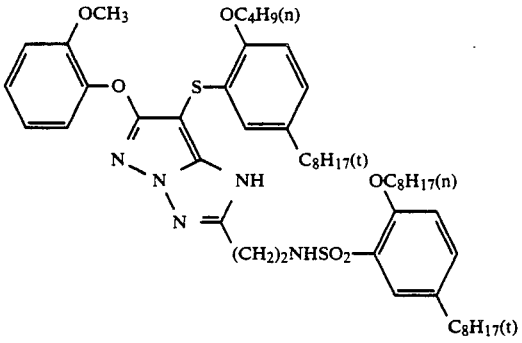
(M-44)
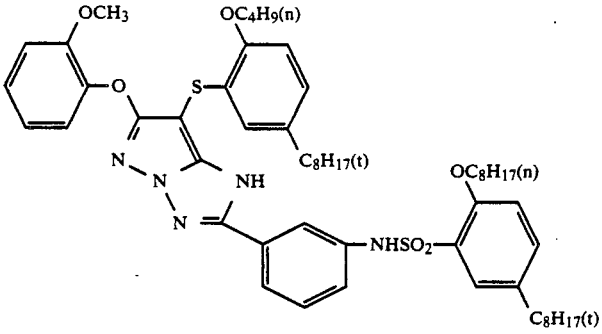
(C-1)
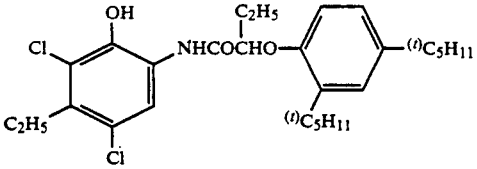
(C-2)
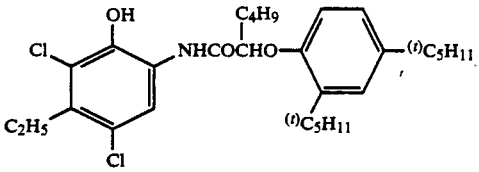
(C-3)
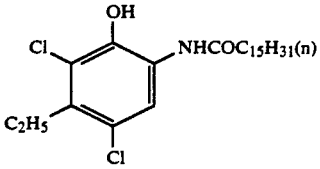

-continued
(C-4)
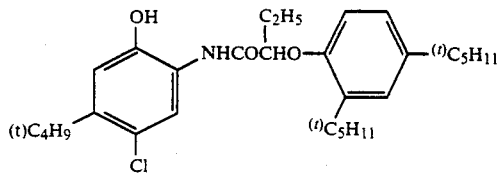
(C-5)
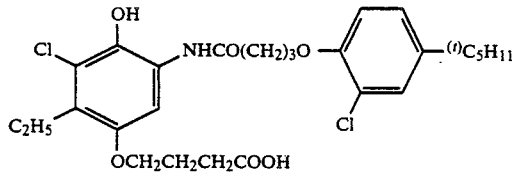
(C-6)
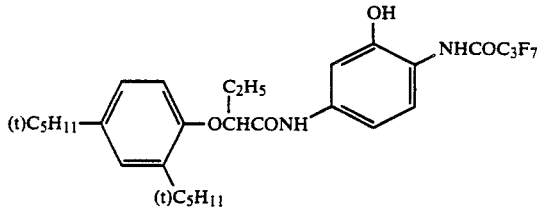
(C-7)
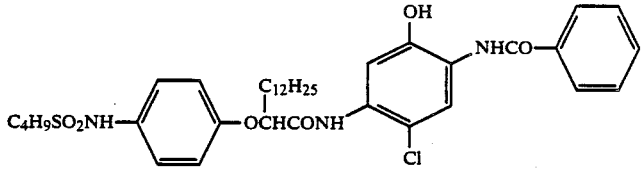
(C-8)
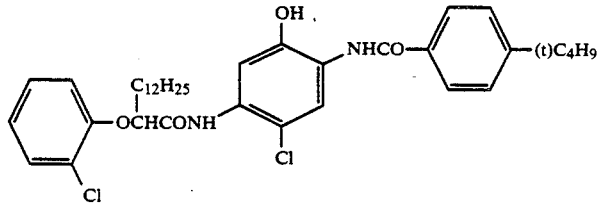
(C-9)
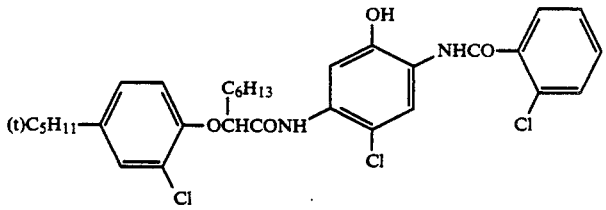
(C-10)
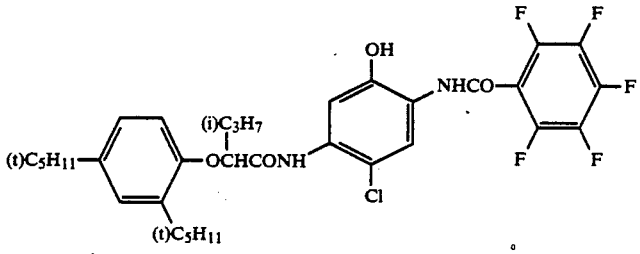

-continued
(C-11)
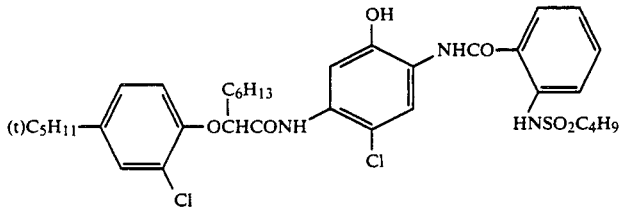
(C-12)
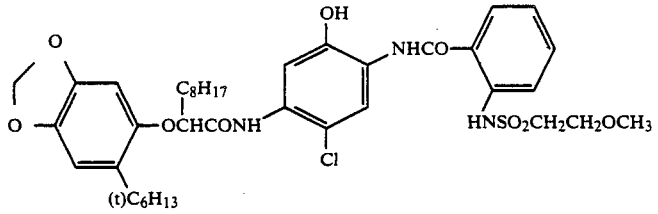
(C-13)
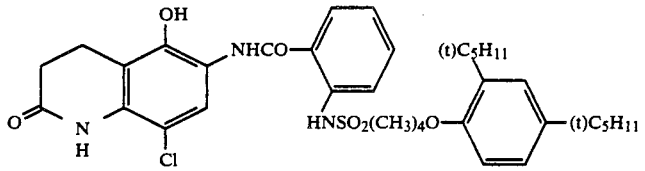
(C-14)
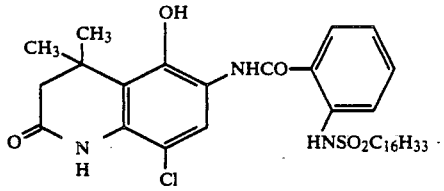
(C-15)
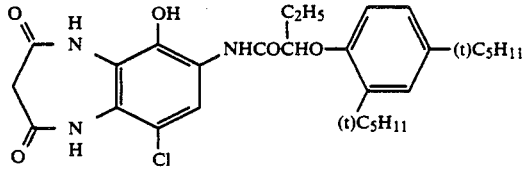
(C-16)
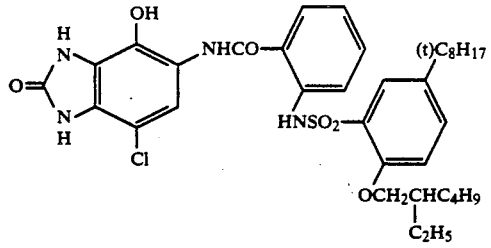
(C-17)
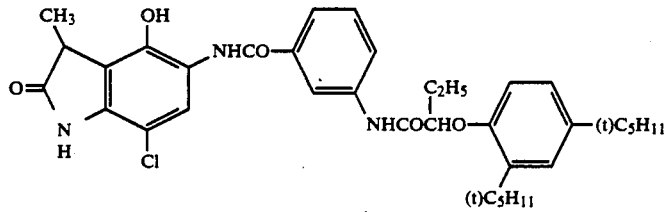

-continued
(C-18)
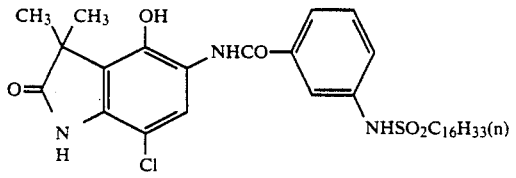
(C-19)
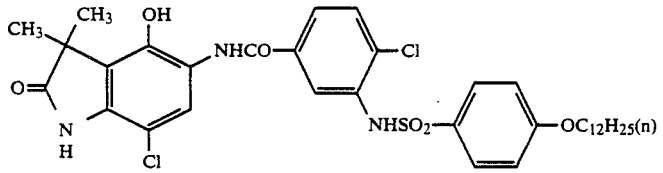
(C-20)
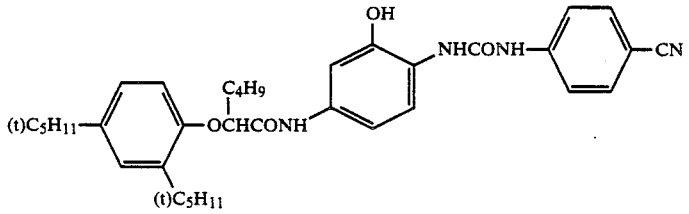
(C-21)
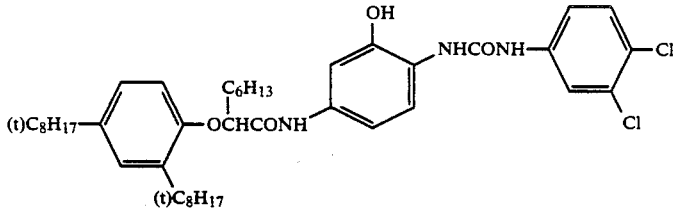
(C-22)
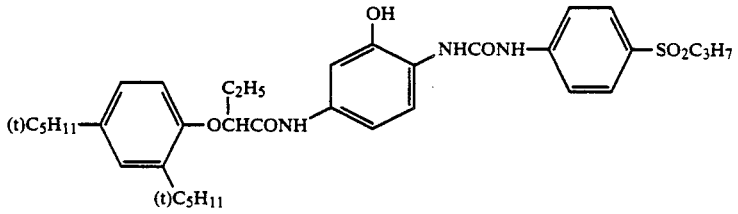
(C-23)
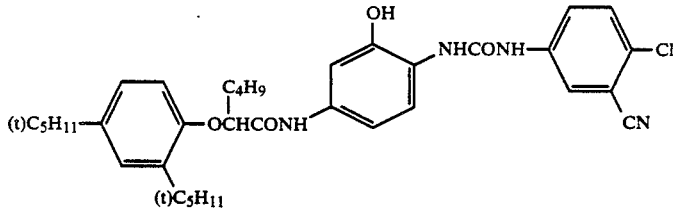
(C-24)
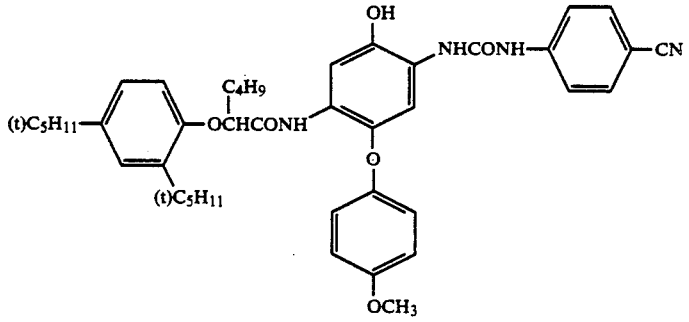

-continued
(C-25)
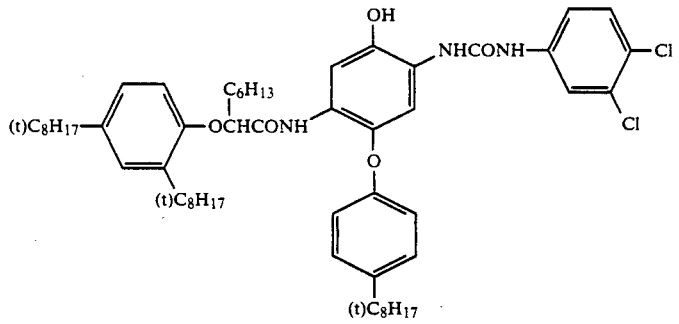
(C-26)
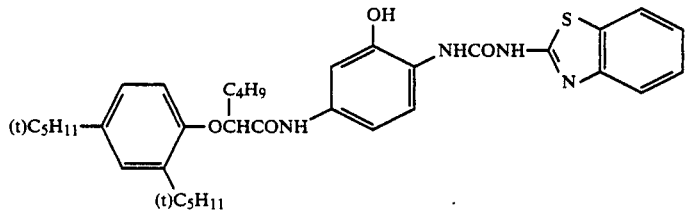
(C-27)
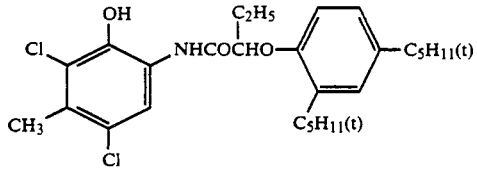
(C-28)
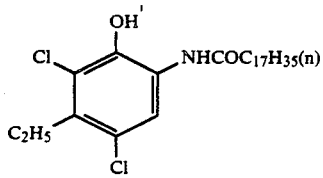
(C-29)
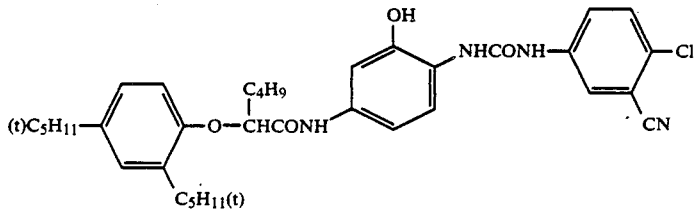
(C-30)
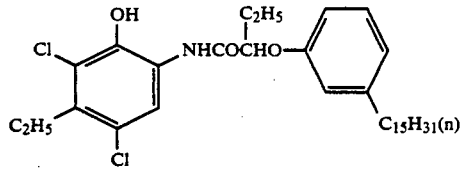
(C-31)
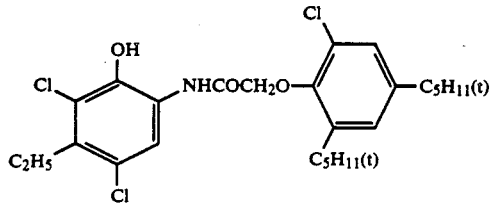
The process for the production of a color photograph of the present invention is the same as the common process for the production of a color photograph, except that compound (A) or (B) is contained suitably in a processing solution.

The silver halide grains used in the present invention may be in the form of regular crystals, such as cubic crystals, octahedral crystals, dodecahedral crystals, and tetradecahedral crystals, or of irregular crystals, such as spherical crystals, or in a tabular form having a length/-thickness ratio of 5 or more. The emulsion may comprise a composite of these crystalline forms or a mixture of them.

The composition of the silver halide comprises silver chloride, silver bromide, or mixed silver halide, and the silver halide that is preferably used in the present invention is silver chloro(iodo)bromide, silver (iodo)chloride or silver (iodo)bromide that contains no silver iodide, or a maximum of 3 mol % of silver iodide if it is contained.

The average grain size of the silver halide grains is preferably a maximum of 2 μm and a minimum of 0.1 μm, more preferably a maximum of 1.3 μm and a minimum of 0.15 μm. The grain size distribution may be narrow or wide, although in the present invention it is preferable to use the "monodisperse" silver halide emulsion having narrow grain size distribution wherein 95% or over of all the grains fall within ±40%, preferably ±30%, and more preferably ±20% of the average grain size in terms of the number of grains or in terms of weight with a view to improving graininess and the sharpness. In order to satisfy the gradation at which the photographic material is aimed, in emulsion layers having substantially identical color sensitivity two or more monodisperse silver halide emulsions different in grain size, or grains having the same size but different in sensitivity, are mixed and applied in the same layer or are applied as separate layers. Further, a combination of two or more polydisperse silver halide emulsions or a combination of a monodisperse emulsion and a polydisperse emulsion can be mixed or applied as separate layers.

In the silver halide emulsion used in the present invention, the inside or the surface of the grains may be chemically sensitized, for example by sulfur sensitization, selenium sensitization, reduction sensitization, or noble metal sensitization, which may be used alone or in combination. Detailed examples thereof are described, for example, in patents cited in Research Disclosure No. 17643-II (Dec. 1978), page 23.

The silver halide emulsion used in the present invention can also be spectrally sensitized in a conventional manner using a cyanine dye or a merocyanine dye.

Gelatin to be used in this invention may be an alkaline-treated gelatin (having an isoelectric point of 4.5 to 5.3), an acid-treated gelatin (having an isoelectric point of 6.0 to 9.5) or an enzyme-treated gelatin. Of these, the acid-treated gelatin is preferable in view of the prevention of stain. Preferred amount of the acid-processed gelatin in total coating amount of gelatin to be added is 10% or more, with being more preferably 25% or more, and most preferably 50% or more, and the upper limit is 100%.

It is preferable that the color developing solution used in the present invention be substantially free from benzyl alcohol. When a low-replenishing type color development replenishing solution is prepared, if benzyl alcohol is contained in some cases it takes a longer time to dissolve the components due to the slow dissolving rate, or a tarry substance is formed. On the other hand, even if a color developing solution free from benzyl alcohol is of a low-replenishing type, since the components can be dissolved within a short period of time and a tarry substance will not be formed, it is easy and advantageous to prepare a low-replenishing type development replenisher. When continuous processing is effected by using a color developing solution free from benzyl alcohol, which is prevented from the composition fluctuation of the solution the replenishing amount can be lowered to half or below (165 ml/m$^2$ or below) the standard replenishing amount, and constant finishing can be obtained without the formation of tarry substances or a change of stain.

As additives used in the color developing solution, use can be made of various compounds described in Japanese Patent Application Nos. 1667/1984, pages 14 to 22, 118418/1984, pages 45 to 50, and 32462/1986, pages 11 to 22.

As antifoggants to be used in the color developing solution, use can be made of tetrazaindenes, benzoindazoles, benzotriazoles, benzimidazoles, benzothiazoles, and benzooxazoles, heterocyclic thiones such as 1-phenyl-5-mercaptotetrazole, aromatic and aliphatic mercapto compound.

The photographic emulsion layer after the color development is generally subjected to a bleaching process. The bleaching process may be carried out as a one-bath bleach/fix simultaneously with a fixing process, or it may be carried out separately from the fixing process. In order to quicken the processing the photographic emulsion layer may be subjected to a bleach/fix process after the bleaching process, or after a fixing process. As a bleaching agent in the bleaching solution or the bleach/fix solution of the present invention, generally use can be made of aminopolycarboxylic acid iron complex salts. As additives used for the bleaching solution or bleach/fix solution of the present invention, use can be made of various compounds described in Japanese Patent Application No. 32462/1986, pages 22 to 30.

When the color developing solution is substantially free from benzyl alcohol, the leucolization reaction of a cyan dye in the bleach/fix solution barely occurs, so that the pH of the bleach/fix solution or the amount of an oxidizing agent can be lowered.

The term "substantially free from benzyl alcohol" means the content of benzyl alcohol is 0.5 ml/l or below.

The replenishing amount of the bleach/fix solution is generally about 330 ml/m$^2$ or below, and if the color developing solution does not contain benzyl alcohol the replenishing amount can be lowered to 60 ml/m$^2$ or below.

After the desilvering step (bleach/fix or fix), water washing and/or stabilizing or the like is carried out. As additives used in the washing and stabilizing steps, use can be made of various compounds described in Japanese Patent Application No. 32462/1986, pages 30 to 36.

It is preferable that the amount of the replenishing solution of each process be smaller. It is preferable that the amount of the replenishing solution is 0.1 to 50 times, more preferably 3 to 30 times, as much as the carried-over amount from the preceding bath per unit area of the photographic material.

According to the invention, an excellent effect can be exhibited wherein after a silver halide color photographic material has been color-developed, bleached, and fixed, the white background of the color photograph can be prevented from discoloring even during long-term storage or display.

Further, according to the invention, an excellent effect can be exhibited wherein deterioration of a dye image due to the remaining color developing agent taken into the photographic material after the color development, bleaching, and fixing processes, or due to its oxidized product, can be prevented. Still further, according to the invention, an excellent effect can be exhibited wherein even if the color photographic material is processed with a processing solution in a running state, a processing solution that will be washed with less water or will not be washed with water, a processing solution that is substantially free from benzyl alcohol, such as a color developing solution, and whose components will be brought into the photographic material in a greater amount, or other processing solutions that will for example, impose a burden on the color development, image deterioration due to the remaining aromatic amine developing agent or its oxidized product and the occurrence of stain or side effects therefrom can be prevented.

EXAMPLES

Examples of the invention are given below, but the invention is not limited to the examples.

EXAMPLE 1

A color photographic material (A-1) was prepared by coatings the first layer (lowermost layer) to the seventh layer (uppermost layer) of the compositions shown in Table 1 on a both-sides polyethylene-laminated paper base.

TABLE 1

| Layer | Main component | | |
|---|---|---|---|
| Seventh Layer | Gelatin | 1.33 | $g/m^2$ |
| (protective layer) | Acryl-Modified Copolymer of Polyvinyl alcohol (modification degree 17%) | 0.17 | " |
| Sixth Layer | Gelatin | 0.54 | $g/m^2$ |
| (UV ray absorbing | UV Absorbent (d) | $5.10 \times 10^{-4}$ | $mol/m^2$ |
| layer) | Solvent (a) | 0.08 | $g/m^2$ |
| Fifth Layer | Silver Chlorobromide Emulsion (silver bromide 70 mol %) Silver: | 0.22 | $g/m^2$ |
| (red-sensitive | Gelatin | 0.90 | " |
| emulsion layer) | Cyan Coupler | $7.05 \times 10^{-4}$ | mol/g |
| | Image Dye Stabilizer (f) | $5.20 \times 10^{-4}$ | " |
| | Solvent (e) | 0.60 | $g/m^2$ |
| Fourth Layer | Gelatin | 1.60 | $g/m^2$ |
| (UV absorbing layer) | UV Absorbent (d) | $1.70 \times 10^{-4}$ | $mol/m^2$ |
| | Color Mix Inhibitor (A-30) | $1.60 \times 10^{-4}$ | " |
| | Solvent (a) | 0.24 | $g/m^2$ |
| Third Layer | Silver Chlorobromide Emulsion (silver bromide 75 mol %) Silver: | 0.15 | $g/m^2$ |
| (green-sensitive | Gelatin | 1.56 | " |
| emulsion layer) | Magenta Coupler | $3.38 \times 10^{-4}$ | $mol/m^2$ |
| | Image Dye Stabilizer (A-18) | 0.19 | $g/m^2$ |
| | Solvent (c) | 0.59 | " |
| Second Layer | Gelatin | 0.90 | $g/m^2$ |
| (color mix preventing layer) | Color Mix Inhibitor (b) | $2.23 \times 10^{-4}$ | $mol/m^2$ |
| First Layer | Silver Chlorobromide Emulsion (silver bromide 80 mol %) Silver: | 0.35 | $g/m^2$ |
| (blue-sensitive | Gelatin | 1.35 | " |
| emulsion layer) | Yellow Coupler | $6.91 \times 10^{-4}$ | $mol/m^2$ |
| | Image Dye Stabilizer (A-43) | 0.13 | $g/m^2$ |
| | Solvent (a) | 0.02 | " |
| Base | Polyethylene Laminate Paper [a white pigment ($TiO_2$) and a bluish dye (ultramarine) were included in the first layer side] | | |

As spectral sensitizers for the respective emulsion layers, the following compounds were used.

Blue-sensitive Emulsion Layer;

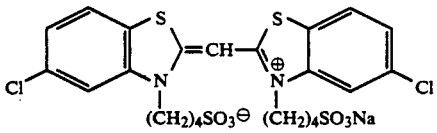

($2 \times 10^{-4}$ mol per mol of silver halide)

Green-sensitive Emulsion Layer;

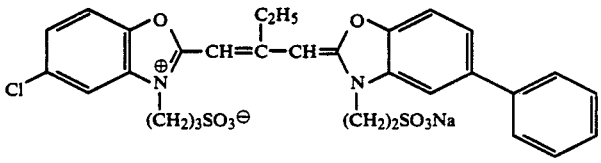

($2.5 \times 10^{-4}$ mol per mol of silver halide)

Red-sensitive Emulsion Layer;

-continued
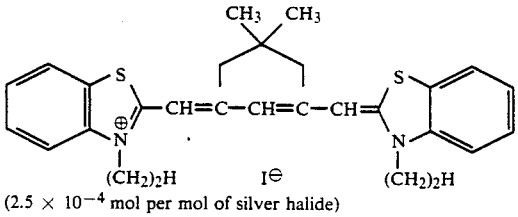
(2.5 × $10^{-4}$ mol per mol of silver halide)
(a) Solvent
(iso $C_9H_{19}O)_3P{=}O$
(b) Color mix inhibitor
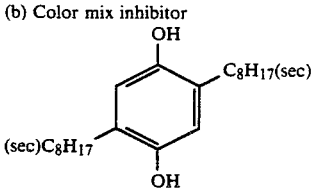
(c) Solvent
$(C_8H_{17}O)_3P{=}O$ and
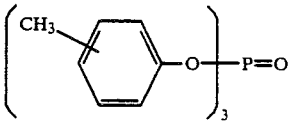
(mixture in weight ratio of 2:1)
(d) UV Absorber
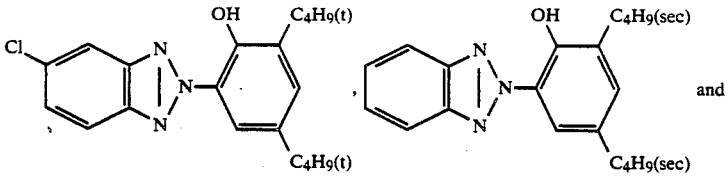
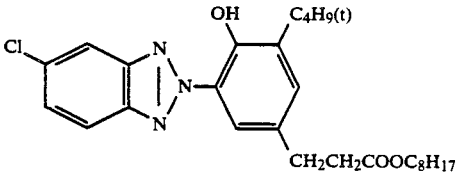
(mixture in molar ratio of 1:5:3)
(e) Solvent
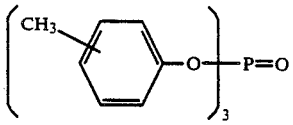
(f) Image Dye Stabilizer
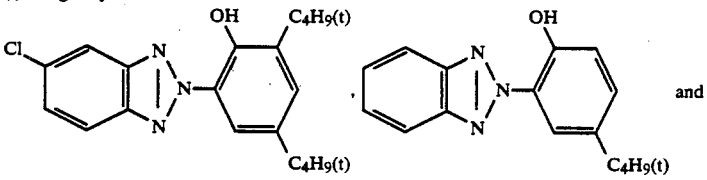
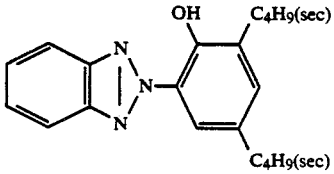
(mixture in molar ratio of 1:3:3)

-continued

A-18

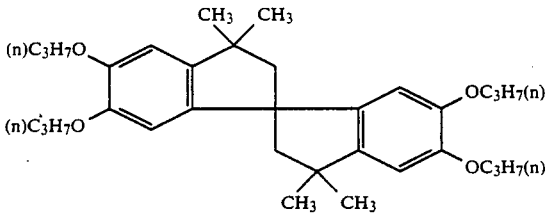

A-30

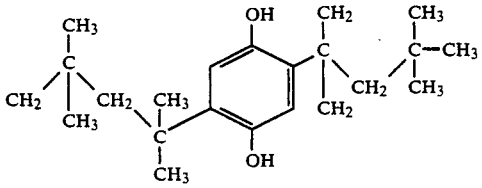

A-43

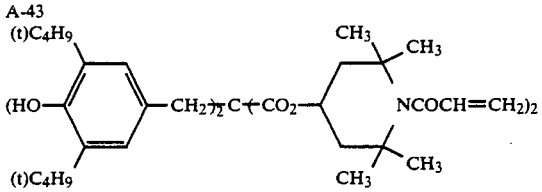

The following dyes were used to protect the respective emulsion layers from irradiation;

Green-sensitive Emulsion Layer;

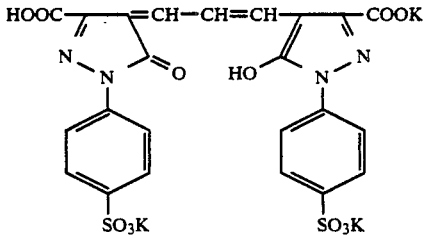

Red-sensitive Emulsion Layer;

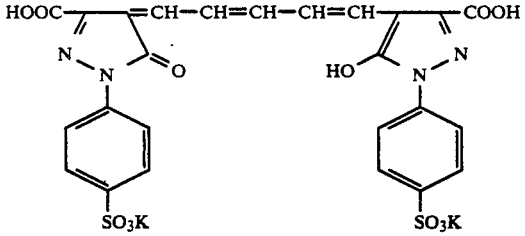

Of these layers, the yellow coupler in the first layer was a mixture of equal mol of the above-mentioned (Y-1) and (Y-7) to obtain a coating amount of $6.91\times10^{-4}$ mol/m$^2$. The cyan coupler in the fifth layer was a mixture of equal mol of the above-mentioned (C-27) and (C-10) to obtain a coating amount of $7.05\times10^{-4}$ mol/m$^2$. The magenta coupler in the third layer was (M-30) to obtain a coating amount of $3.38\times10^{-4}$ mol/m$^2$.

Then Samples (A-2)–(A-12) were prepared by adding the preservative compounds of the present invention in the third layer (green-sensitive layer) of Sample (A-1). In some of these samples the magenta coupler (M-37) was used instead of (M-30). The details of these Samples are shown in Table 2.

Each of the thus prepared Samples was subjected to a exposure through an optical wedge and then processed according to the following processing procedure (I) to obtain a color image.

Processing Procedure (I)

A running developing process was carried out in the following steps and conditions using a Fuji Color Roll Processor FMPP 1000 (partiary reconstructed) (processor made by Fuji Photo Film Co.).

| Step | Time (sec.) | Temperature (°C.) | Tank Capacity (l) | Replenisher amount (ml/m$^2$)* |
|---|---|---|---|---|
| Color developing | 45 | 35 | 88 | 150 |
| Bleach-fixing | 45 | 35 | 35 | 50 |
| Rinsing ① | 20 | 35 | 17 | — |
| Rinsing ② | 20 | 35 | 17 | — |
| Rinsing ③ | 20 | 35 | 17 | 250 |

*per m$^2$ of the photographic material

The rinsing steps were carried out in a three-tank counter-current mode, in which the replenisher is fed to tank of rinsing ③, the overflow rinsing solution from tank or rinsing ③ is fed to the bottom of rinsing tank of rinsing ②, the overflow rinsing solution from tank of rinsing ② is fed to the bottom of rinsing tank of rinsing ①, and the overflow rinsing solution from tank of rinsing ① is drained off. The carried-over amount of solution from each tank was 25 ml/m$^2$ of paper.

The composition of each tank solution and replenisher were as follows:

| | Tank Solution | Replenisher |
|---|---|---|
| Color Developing Solution | | |
| Water | 800 ml | 800 ml |

-continued

| | | |
|---|---|---|
| Diethylenetriaminepenta-acetate | 3.0 g | 3.0 g |
| Benzyl alcohol | 15 ml | 17 ml |
| Diethyleneglycohol | 10 ml | 10 ml |
| Sodium sulfite | 2.0 g | 2.5 g |
| Potassium bromide | 0.5 g | — |
| Sodium carbonate | 30 g | 30 g |
| N-Etyl-N-(β-methanesulfonamido-ethyl)-3-methyl-4-aminoaniline sulfonate | 5.0 g | 7.0 g |
| Hydroxylamine sulfonate | 4.0 g | 4.5 g |
| Brightening agent | 1.0 g | 1.5 g |
| Water to make | 1000 ml | 1000 ml |
| pH | 10.10 | 10.50 |
| **Bleach-fixing Solution** | | |
| Water | 400 ml | 400 ml |
| Ammonium thiosulfite (70% solution) | 150 ml | 300 ml |
| Sodium sulfite | 12 g | 25 g |
| Ammonium iron (III) ethylene-diaminetetraacetate | 55 g | 110 g |
| Disodium ethylenediaminetetraacetate | 5 g | 10 g |
| Water to make | 1000 ml | 1000 ml |
| pH | 6.70 | 6.50 |

| Rinsing Solution | |
|---|---|
| Ethylenediamine-N,N,N',N'-tetra-methylene phosphonate | 0.3 g |
| Benzotriazole | 1.0 g |
| Water to make | 1000 ml |
| pH (by sodium hydroxide) | 7.5 |

Processing Procedure (II)

| Step | Time | Tank Capacity (l) | Replenisher Amount (ml/m²)* |
|---|---|---|---|
| Color developing | 45 sec. | 88 | 150 |
| Bleach-fixing | 2 min. 0 sec. | 35 | 350 |
| Rinsing ① | 1 min. 0 sec. | 17 | — |
| Rinsing ② | 1 min. 0 sec. | 17 | — |
| Rinsing ③ | 1 min. 0 sec. | 17 | 1,300 |

*per m² of the photographic material

Processing solutions and replenishers having the same compositions as the processing procedure (I), respectively, were used.

At the point of one hour after development processing according to the above-mentioned procedure, a magenta reflective density was measured at a non-image area of each processed sample of photographic material. The same measurements were carried out again on the processed samples after being kept for 7 days at 80° C. and 10–15% RH, and on the processed samples after being kept for 8 days at 80° C. and 70% RH. The results are shown in Table 2 in values of increments of stain after one hour.

TABLE 2

| Sample | Magenta Coupler | Additive (Exemplified Compound) | Amount of Additive (mol % to coupler) | Processing Procedure | Increment of Magenta Stain: 7 days at 80° C. | Increment of Magenta Stain: 8 days at 80° C., 70% RH | Remarks |
|---|---|---|---|---|---|---|---|
| A-1 | M-30 | — | — | (I) | 0.06 | 0.02 | Comparative Example |
| A-1 | " | — | — | (II) | 0.04 | 0.09 | Comparative Example |
| A-2 | " | (I-4) | 20 | (I) | 0.02 | 0.08 | Comparative Example |
| A-2 | " | " | 20 | (II) | 0.01 | 0.03 | Comparative Example |
| A-3 | " | (I-27) | 20 | (I) | 0.02 | 0.07 | Comparative Example |
| A-4 | " | (II-5) | 20 | (I) | 0.04 | 0.11 | Comparative Example |
| A-5 | " | (III-7) | 20 | (I) | 0.05 | 0.15 | Comparative Example |
| A-6 | " | (III-18) | 20 | (I) | 0.03 | 0.08 | Comparative Example |
| A-7 | " | (I-4) + (III-7) | 10 + 10 | (I) | 0.01 | 0.02 | This Invention |
| A-8 | " | (I-27) + (III-7) | 10 + 10 | (I) | 0.01 | 0.01 | This Invention |
| A-9 | " | (II-5) + (III-18) | 10 + 10 | (I) | 0.01 | 0.01 | This Invention |
| A-10 | M-37 | — | — | (I) | 0.05 | 0.19 | Comparative Example |
| A-10 | " | — | — | (II) | 0.04 | 0.08 | Comparative Example |
| A-11 | " | (I-22) | 20 | (I) | 0.03 | 0.08 | Comparative Example |
| A-12 | " | (I-30) | 20 | (I) | 0.02 | 0.07 | Comparative Example |
| A-13 | " | (III-21) | 20 | (I) | 0.03 | 0.11 | Comparative Example |
| A-14 | " | (I-22) + (III-21) | 10 + 10 | (I) | 0.01 | 0.02 | This Invention |
| A-15 | " | (I-27) + (III-21) | 10 + 10 | (I) | 0.01 | 0.01 | This Invention |
| A-16 | " | (I-30) + (III-21) | 10 + 10 | (I) | 0.01 | 0.02 | This Invention |
| A-17 | " | (I-22) + (III-18) | 10 + 10 | (I) | 0.01 | 0.01 | This Invention |

As is apparent from the results in Table 2, the increments of magenta stain are relatively small on the samples processed according to the procedure (II) in which the bleaching time and rinsing times were longer and sufficient amounts of replenisher were used, but magenta stain was greatly increased on samples processed by the procedure (I) in which the processing times were shorter and the replenisher amounts were smaller.

From the results described above, it can been seen that satisfactory prevention of magenta stain is possible by the combined used of the preservability improving compounds (A) and (B) of the present invention, although the prevention is not sufficient on samples in which compounds (A) and (B) were used separately.

Compounds to be used in Examples 2-8 are as follows:

Sensitizing dye

ExS-1

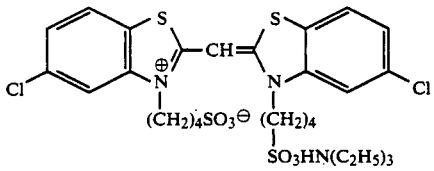

ExS-2

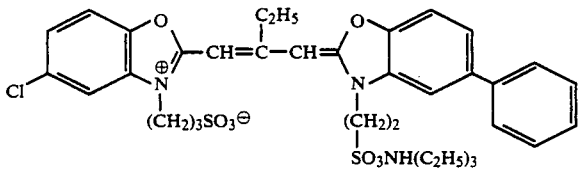

ExS-3

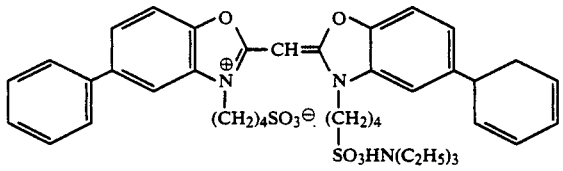

ExS-4

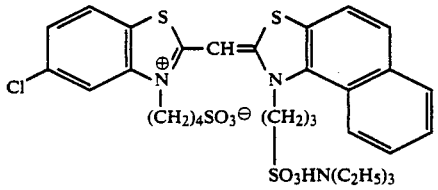

ExS-5

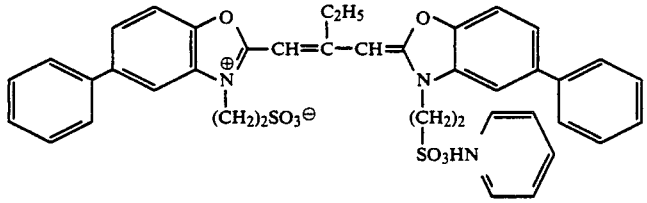

ExS-6

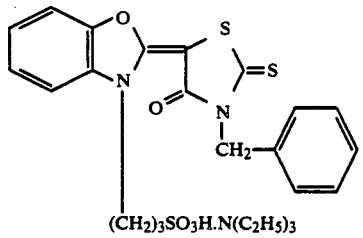

ExS-7

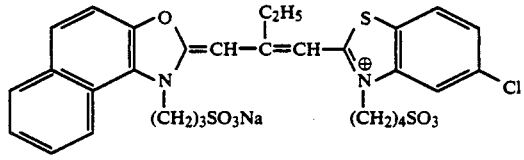

-continued
Sensitizing dye
ExS-8
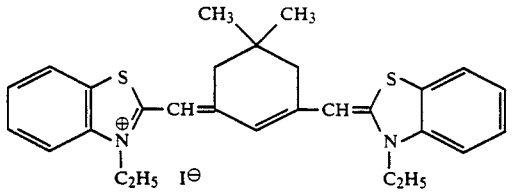
ExS-9
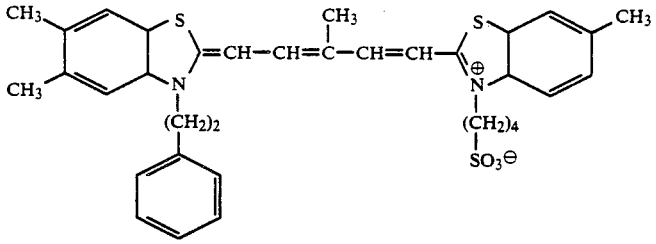
ExS-10
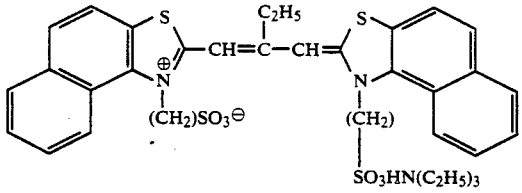
ExS-11
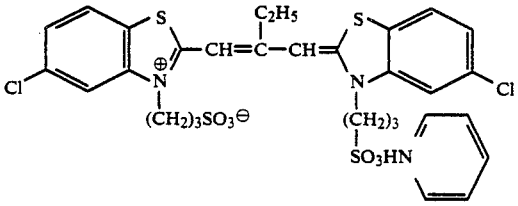
ExS-12
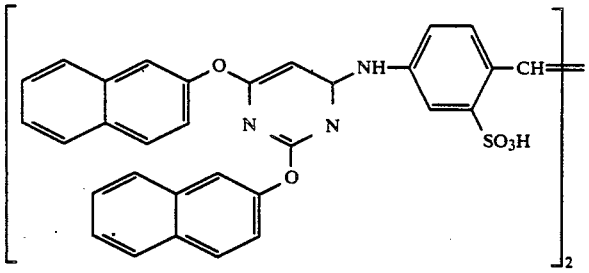
ExY-1
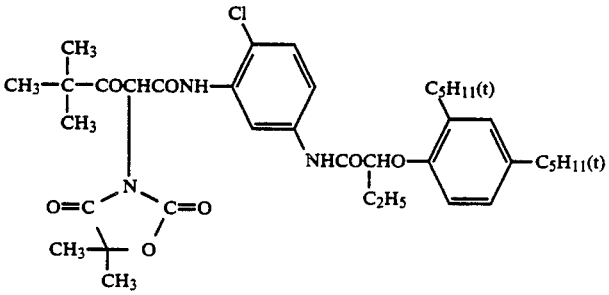

-continued
Sensitizing dye
ExY-2
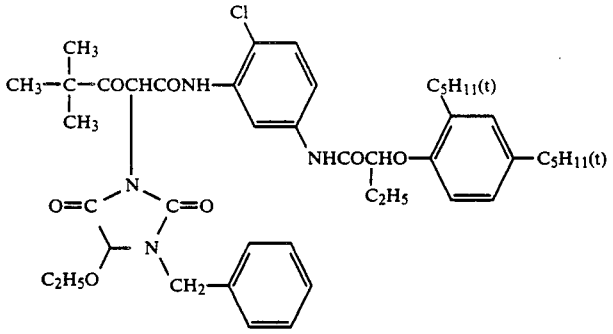
ExY-3
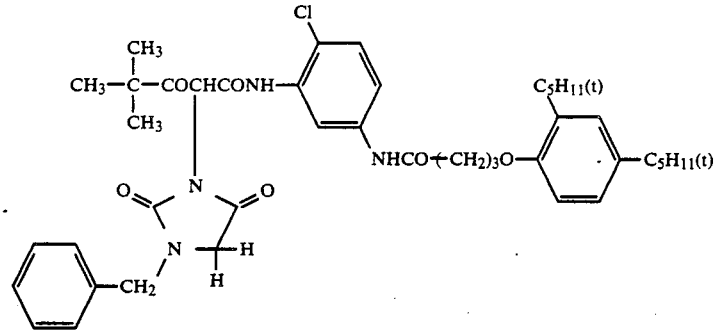
ExM-1
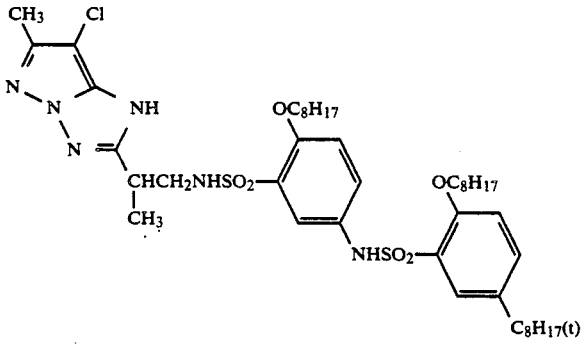
ExM-2
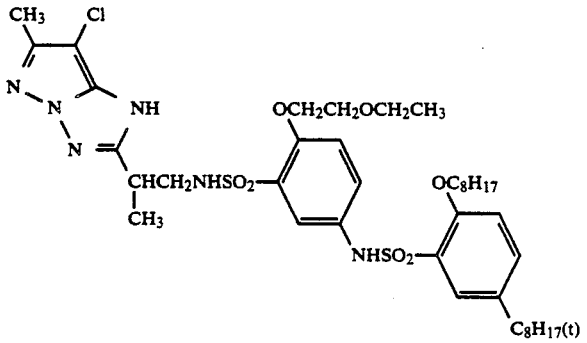

-continued
Sensitizing dye
ExM-3
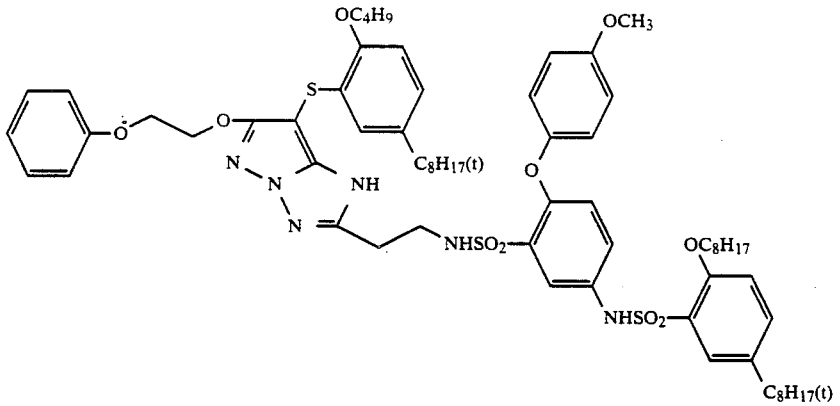
ExM-4
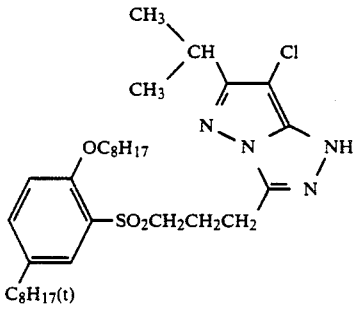
ExM-5
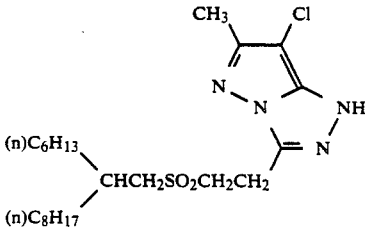
ExM-6
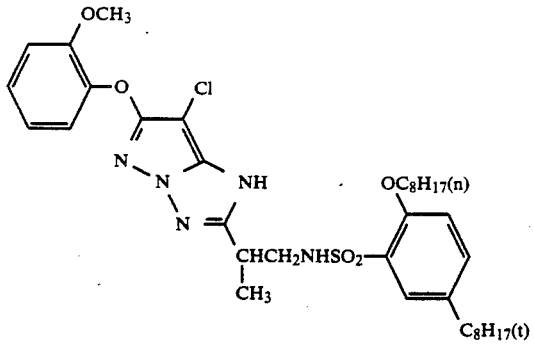
ExC-1
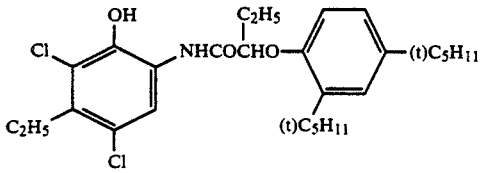

-continued
Sensitizing dye
ExC-2
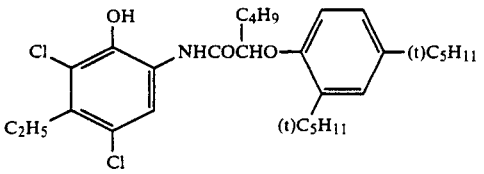
ExC-3
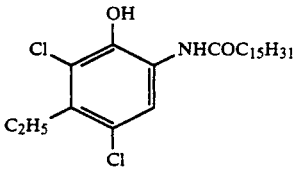
ExC-4
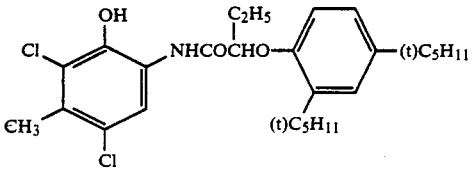
ExC-5
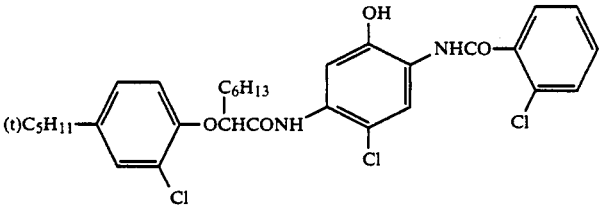
ExC-6
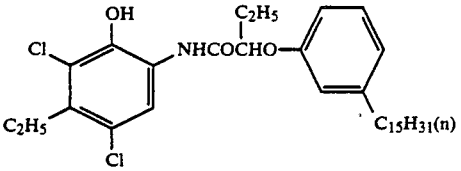
ExC-7
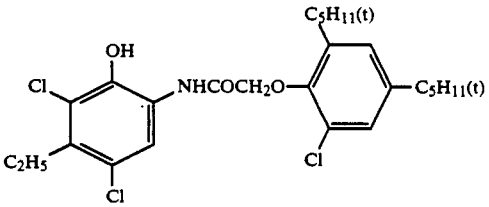
ExC-8
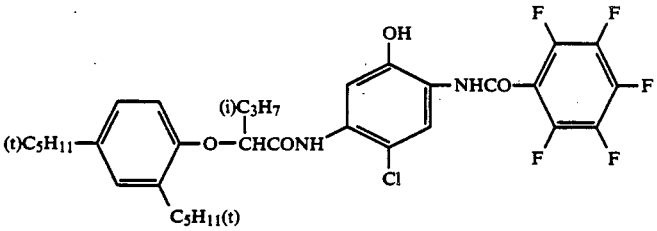
Cpd-1
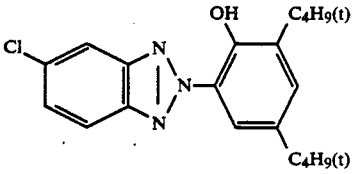

-continued
Sensitizing dye
Cpd-2
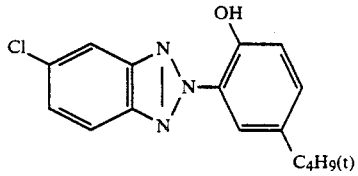
Cpd-3
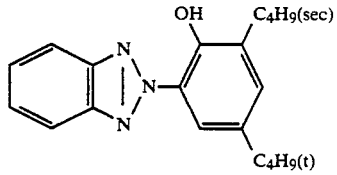
Cpd-4
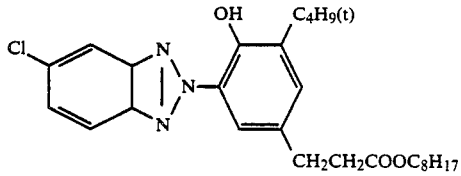
Cpd-5
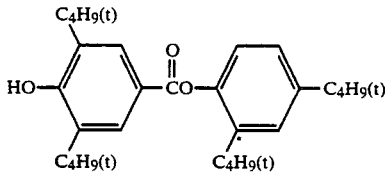
Cpd-6
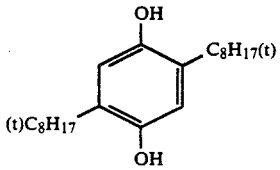
Cpd-7
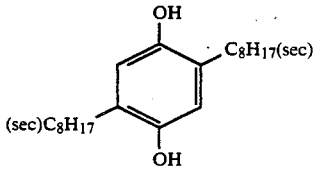
Cpd-8
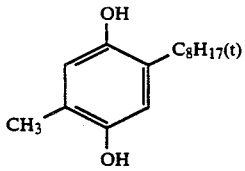
Cpd-9
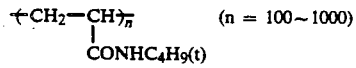
(n = 100~1000)
Cpd-10
Poly(ethyl acrylate)latex
Cpd-11
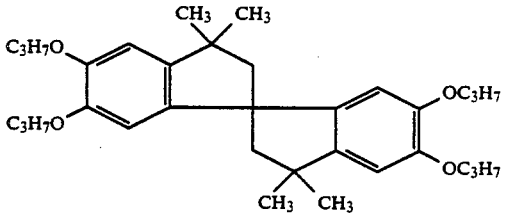

-continued
Sensitizing dye
Cpd-12
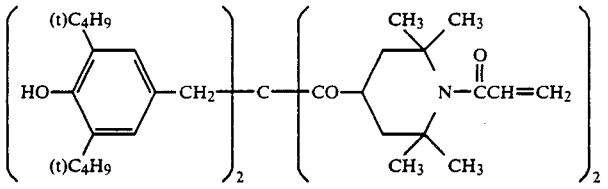
Cpd-13
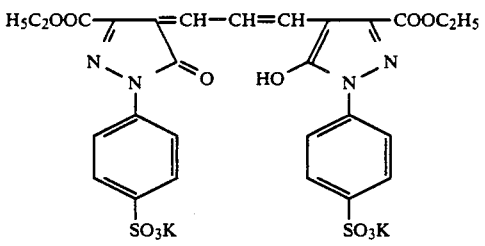
Cpd-14
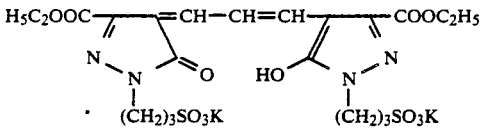
Cpd-15
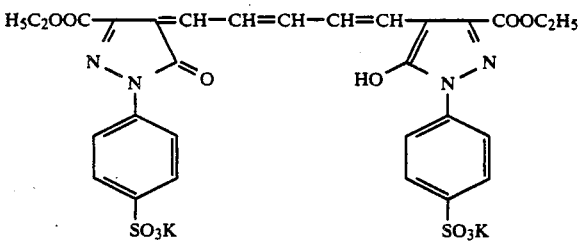
Cpd-16
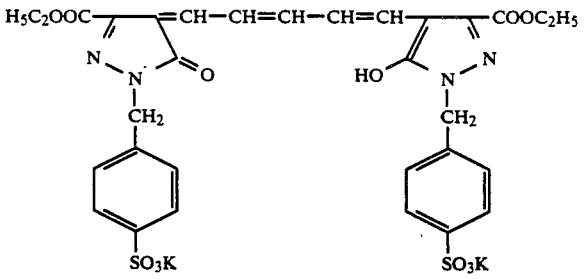
Cpd-17
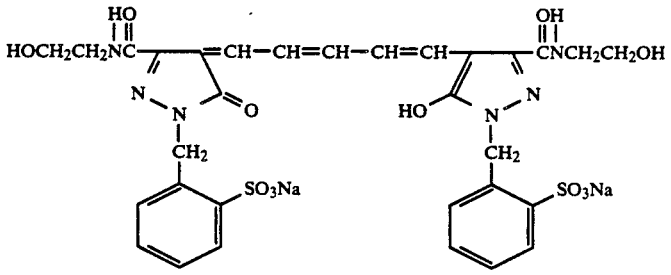

-continued

Sensitizing dye

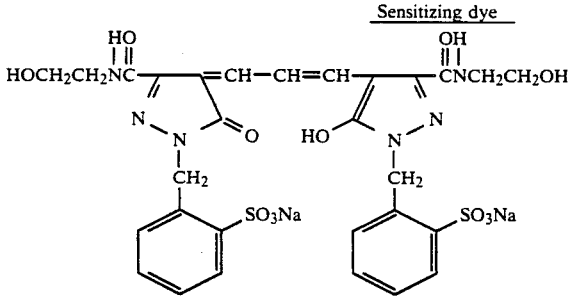

Cpd-18

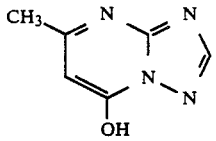

Cpd-19

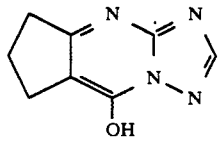

Cpd-20

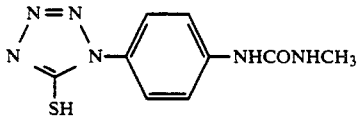

Cpd-21

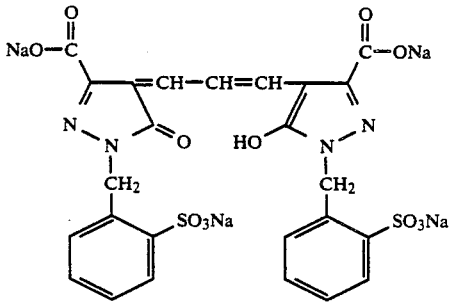

Cpd-22

Solv-1: Di(2-ethylhexyl)phthalate
Solv-2: Trinonylphosphate
Solv-3: Di(3-methylhexyl)phthalate
Solv-4: Tricresylphthalate
Solv-5: Dibutylphthalate
Solv-6: Trioctylphosphate
Solv-7: Diethylazelate
Solv-8: Dioctylsebacate

EXAMPLE 2

A color photographic material (B-1) was prepared by multi-coatings composed of the first to the twelfth layer as hereinbelow defined and coated on a both-sides polyethylene-laminated paper base. A white pigment ($TiO_2$) and a small amount of bluish dye (ultramarine blue) were included in the first layer side of the polyethylene film laminated.

Composition of Photosensitive Layers

In the following compositions, each ingredient is indicated in g/m$^2$ of a coating amount, but the coating amount of the silver halide is shown in g/m$^2$ in terms of silver.

| | |
|---|---|
| First layer: Geratin layer | |
| Gelatin | 1.30 |
| Second layer: Antihalation layer | |
| Black colloidal silver | 0.10 |
| Gelatin | 0.70 |
| Third layer: Red-sensitive emulsion (low sensitivity) layer | |
| Silver chloroiodobromide emulsion spectral-sensitized by red-sensitizing dye (ExS-7, -11 and -12) (silver chloride: 1 mol %, silver iodide: 4 mol %, average grain size: 0.3 μm, grain size distribution: 10%, cubic, core-shell type of iodide core) | 0.06 |
| Silver iodobromide emulsion spectral-sensitized by red-sensitizing dye (ExS-7, -11 and -12) (silver iodide: 5 mol %, average grain size: 0.45 μm, grain size distribution: 20%, plate (aspect ratio: 5)) | 0.10 |
| Gelatin | 1.00 |
| Cyan coupler (ExC-2) | 0.14 |
| Cyan coupler (ExC-5) | 0.07 |
| Discoloration inhibitor (equal amount mixture of Cpd-1, -3, -5 and -11) | 0.12 |
| Dispersion medium for coupler (Cpd-9) | 0.03 |
| Solvent for coupler (Solv-1, -2 and -3) | 0.06 |
| Fourth layer: Red-sensitive emulsion (highly sensitive) layer | |
| Silver iodobromide emulsion spectral-sensitized by | 0.15 |

-continued

| | |
|---|---|
| red-sensitizing dye (ExS-7, -11 and -12) (silver iodide: 6 mol %, average grain size: 0.75 μm, grain size distribution: 25%, plate (aspect ratio: 8, core-shell type of iodide core)) | |
| Gelatin | 1.00 |
| Cyan coupler (ExC-2) | 0.20 |
| Cyan coupler (ExC-5) | 0.10 |
| Discoloration inhibitor (equal amount mixture of Cpd-1, -3, -5 and -11) | 0.15 |
| Dispersion medium for coupler (Cpd-9) | 0.03 |
| Solvent for coupler (Solv-1, -2 and -3) | 0.10 |
| Fifth layer: Intermediate layer | |
| Magenta colloidal silver | 0.02 |
| Gelatin | 1.00 |
| Color mix inhibitor (Cpd-6 and -13) | 0.08 |
| Solvent for color mix inhibitor (Solv-4 and -5) | 0.16 |
| Polymer latex (Cpd-10) | 0.10 |
| Sixth layer: Green-sensitive emulsion (low sensitivity) layer | |
| Silver chloroiodobromide emulsion spectral-sensitized by green-sensitizing dye (ExS-7) (silver chloride: 1 mol %, silver iodide: 2.5 mol %, average grain size: 0.28 μm, grain distribution: 12%, cubic, core-shell type of iodide core) | 0.04 |
| Silver iodobromide emulsion spectral-sensitized by green-sensitizing dye (ExS-7)(silver iodide: 2.8 mol %, average grain size: 0.45 μm, grain size distribution: 12%, plate (aspect ratio: 5)) | 0.06 |
| Gelatin | 0.80 |
| Magenta coupler (ExM-1) | 0.10 |
| Discoloration inhibitor (Cpd-11) | 0.10 |
| Stain inhibitor (Cpd-8) | 0.001 |
| Dispersion medium for coupler (Cpd-9) | 0.05 |
| Solvent for coupler (Solvent-4 and -6) | 0.15 |
| Seventh layer: Green-sensitive emulsion (highly sensitive) layer | |
| Silver iodobromide emulsion spectral-sensitized by green-sensitizing dye (ExS-7) (silver iodide: 3.5 mol %, average grain size: 0.9 μm, grain size distribution: 23%, plate (aspect ratio: 9, uniform iodide type)) | 0.10 |
| Gelatin | 0.80 |
| Magenta coupler (ExM-1) | 0.10 |
| Stain inhibitor (Cpd-8) | 0.001 |
| Dispersion medium for coupler (Cpd-9) | 0.05 |
| Solvent for coupler (Solv-4 and -6) | 0.15 |
| Eighth layer: Yellow filter layer | |
| Yellow colloidal silver | 0.20 |
| Gelatin | 1.00 |
| Color mix inhibitor (Cpd-6) | 0.06 |
| Solvent for color mix inhibitor (Solv-4 and -5) | 0.15 |
| Polymer latex (Cpd-10) | 0.10 |
| Ninth layer: Blue-sensitive emulsion (low sensitivity) layer | |
| Silver chloroiodobromide emulsion spectral-sensitized by blue-sensitizing dye (ExS-5 and -6) (silver chloride: 2 mol %, silveriodobromide: 2.5 mol %, average grain size: 0.35 μm, grain size distribution: 8%, cubic, core-shell type of iodide core) | 0.07 |
| Silver iodobromide emulsion spectral-sensitized by blue-sensitizing dye (ExS-5 and -6) (silver iodobromide: 2.5 mol %, average grain size: 0.45 μm, grain size distribution: 16%, plate (aspect ratio: 6)) | 0.10 |
| Gelatin | 0.50 |
| Yellow coupler (ExY-2) | 0.20 |
| Stain inhibitor (Cpd-8) | 0.001 |
| Discoloration inhibitor (Cpd-12) | 0.10 |
| Dispersion medium for coupler (Cpd-9) | 0.05 |
| Solvent for coupler (Solv-2) | 0.05 |
| Tenth layer: Blue-sensitive emulsion (highly sensitive) layer | |
| Silver iodobromide emulsion spectral-sensitized by blue-sensitizing dye (ExS-5 and -6) (silver iodide: 2.5 mol %, average grain size: 1.2 μm, grain size distribution: 21%, plate (aspect ratio: 14)) | 0.25 |
| Gelatin | 1.00 |
| Yellow coupler (ExY-2) | 0.40 |
| Stain inhibitor (Cpd-8) | 0.002 |
| Discoloration inhibitor (Cpd-12) | 0.10 |

-continued

| | |
|---|---|
| Dispersion medium for coupler (Cpd-9) | 0.05 |
| Solvent for coupler (Solv-2) | 0.10 |
| Eleventh layer: UV absorbing layer | |
| Gelatin | 1.50 |
| UV absorbent (Cpd-1, -3 and -4) | 1.00 |
| Color mix inhibitor (Cpd-6 and -7) | 0.06 |
| Solvent for UV absorbent (Solv-1 and -2) | 0.15 |
| Irradiation preventing dye (Cpd-13 and -14) | 0.02 |
| Irradiation preventing dye (Cpd-15 and -16) | 0.02 |
| Twelfth layer: Protective layer | |
| Fine grain size silver chlorobromide emulsion (silver chloride: 97 mol %, average grain size: 0.2 μm) | 0.07 |
| Modified polyvinyl alcohol | 0.02 |
| Gelatin | 1.50 |
| Sodium 1-oxy-3,5-dichloro-s-triazine | 0.17 |

In addition, Alkanol XC (tradename, made by Dupont) and sodium alkylbenzenesulfonate were used as auxiliary agents for emulsification and dispersion, and succinate ester and Magefac F-120 (tradename, made by Dainippon Ink) were added as coating aids to each layer. Further, Cpd-19, -20 and -21 were used as stabilizers for the layers containing silver halide or colloidal silver.

Samples (B-2) and (B-3) were prepared by repeating the preparation procedure of Sample (B-1), except that magenta coupler (ExM-1) was changed to equal mol of (Exm-2) and (Exm-3) respectively. Then, Samples (B-4) to (B-11) were prepared by adding the preservability improving compounds (A) and/or (B) of the present invention to the sixth layer and the seventh layer of Samples (B-1) to (B-3). The details of the addition of the preservability improving compounds are shown in the following Table 3.

Each of the thus prepared samples was subjected to a exposure through an optical wedge nd then to a color development process according to the processing procedure (III) described below.

Processing Procedure (III)

| Step | Temperature | Time |
|---|---|---|
| First developing (Black and white developing) | 38° C. | 1 min. 15 sec. |
| Water-washing | 38° C. | 1 min. 30 sec. |
| Reversal exposure | over 100 Lux | over 1 min. |
| Color developing | 38° C. | 2 min. 15 sec. |
| Water washing | 38° C. | 45 sec. |
| Bleach-fixing | 38° C. | 2 min. |
| Water washing | 38° C. | 2 min. 15 sec. |

Composition of processing solution

| | |
|---|---|
| First Developing Solution | |
| Pentasodium nitrilo-N,N,N-trimethylenephosphonate | 0.6 g |
| Pentasodium diethylenetriaminepentaacetate | 4.0 g |
| Potassium sulfite | 30.0 g |
| Potassium thiocyanate | 1.2 g |
| Potassium carbonate | 35.0 g |
| Potassium hydroquinonemonosulfonate | 25.0 g |
| Diethyleneglycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make (pH 9.70) | 1000 ml |
| Color Developing Solution | |
| Benzyl alcohol | 15.0 ml |
| Diethylene glycol | 12.0 ml |
| 3,6-Dithia-1,8-octanediol | 0.2 g |
| Pentasodium nitrilo-N,N,N-trimethylenephosphonate | 0.5 g |

-continued

| Composition of processing solution | |
|---|---|
| Pentasodium diethylenetriaminepentaacetate | 2.0 g |
| Sodium sulfite | 2.0 g |
| Sodium carbonate | 25.0 g |
| Hydroxylamine sulfonate | 3.0 g |
| N-Ethyl-N-(β-methanesulfonamidoethyl)-3-methyl-4-aminoaniline sulfonate | 5.0 g |
| Potassium bromide | 0.5 g |
| Potassium iodide | 1.0 mg |
| Water to make (pH 10.40) | 1000 ml |
| Bleach-fixing Solution | |
| 2-Mercapto-1,3,4-triazole | 1.0 g |
| Disodium ethylenediaminetetraacetate dihydrate | 5.0 g |
| Ammonium iron(III) ethylenediaminetetraacetate monohydrate | 80.0 g |
| Sodium sulfite | 15.0 g |
| Sodium thiosulfate (700 g/l solution) | 160.0 ml |
| Glacial acetic acid | 5.0 ml |
| Water to make (pH 6.50) | 1000 ml |

At the point of one hour after development processing according to the above-mentioned procedure, a magenta reflective density (stain) was measured at a non-image area of each processed sample of photographic material. The same stain measurements were carried out again on the processed samples after being kept for 3 days at 80° C. and 70% RH, and on the processed samples after being kept for 100 days at room temperature. The results are shown in Table 3 in values of incrementes of stain after one hour.

TABLE 3

| Sample | Magenta Coupler | Additive (Exemplified Compound) | Amount of Additive (mol % to coupler) | Increment of Magenta Stain: 3 days at 80° C., 70% RH | Increment of Magenta Stain: 100 days at R.T. | Remarks |
|---|---|---|---|---|---|---|
| B-1 | ExM-1 | — | — | 0.08 | 0.07 | Comparative Example |
| B-2 | ExM-2 | — | — | 0.07 | 0.05 | Comparative Example |
| B-3 | ExM-4 | — | — | 0.09 | 0.08 | Comparative Example |
| B-4 | ExM-1 | (I-26) | 20 | 0.03 | 0.02 | Comparative Example |
| B-5 | ExM-1 | (I-26) + (III-19) | 10 + 10 | 0.01 | 0.00 | This Invention |
| B-6 | ExM-2 | (I-5) | 20 | 0.03 | 0.02 | Comparative Example |
| B-7 | ExM-2 | (III-1) | 20 | 0.05 | 0.03 | Comparative Example |
| B-8 | ExM-2 | (I-5) + (III-1) | 10 + 10 | 0.01 | 0.01 | This Invention |
| B-9 | ExM-4 | (II-3) | 20 | 0.07 | 0.05 | Comparative Example |
| B-10 | ExM-4 | (III-24) | 20 | 0.04 | 0.03 | Comparative Example |
| B-11 | ExM-4 | (II-3) + (III-24) | 10 + 10 | 0.01 | 0.01 | This Invention |

As is apparent from the results in Table 3, it can be understood that the stain-preventive effect according to the present invention is quite remarkable, and it can also be seen that this effect does not decline even if the structure of photographic material and the development processing solutions are varied.

EXAMPLE 3

A multi-layer color photographic paper (C-1) was prepared which has such layers as hereinbelow described on a paper laminated on both sides with polyethylene. Coating solutions were prepared as follows:

Preparation of the First Layer Coating Solution

To a mixture of 10.2 g of yellow coupler (ExY-1), 9.1 g of yellow coupler (ExY-2) and 4.4 g of a image dye stabilizer (Cpd-12), 27.2 ml of ethyl acetate and 7.7 ml (8.0 g) of high boiling solvent (Solv-5) were added, and they were dissolved. The resulting solution was emulsified and dispersed in 185 ml of 10% aqueous gelatin solution containing 8 ml of a 10% solution of sodium dodecylbenzenesulfonate. Each of the under-mentioned emulsions EM1 and EM2 was mixed with the above-obtained emusified and dispersed solution and dissolved, and the concentration of gelatin in the mixture was adjusted so as to obtain the composition shown below, thereby preparing the first coating solution. The second to the seventh layer coating solutions were prepared in the same manner as the first coating solution. As a gelatin hardner for the respective layers, the sodium salt of 1-oxy-3,5-dichloro-s-triazine was used.

Compositions of Layers

The composition of each layer is shown below. Each ingredient is indicated in g/m$^2$ of a coating amount, but the coating amount of silver halide is shown in g/m$^2$ in terms of silver.

| | |
|---|---|
| Supporting base | |
| Polyethylene laminated paper (a white pigment, $TiO_2$ and a bluish dye, ultramarine, were included in the first layer side of the polyethylene film laminated). | |
| First layer: Blue-sensitive layer | |
| Monodisperse silver chlorobromide emulsion (EM1) spectral-sensitized by sensitizing dye (ExS-1) | 0.13 |
| Monodisperse silver chlorobromide emulsion (EM2) spectral-sensitized by sensitizing dye (ExS-1) | 0.13 |
| Gelatin | 1.86 |
| Yellow coupler (ExY-1) | 0.44 |
| Yellow coupler (ExY-2) | 0.39 |
| Image dye stabilizer (Cpd-12) | 0.19 |
| Solvent (Solv-5) | 0.35 |
| Second layer: Color mix preventing layer | |
| Gelatin | 0.99 |
| Color mix inhibitor (Cpd-7) | 0.08 |
| Third layer: Green-sensitive emulsion layer | |
| Monodisperse silver chlorobromide emulsion (EM3) spectral-sensitized by sensitizing dye (ExS-2, -3) | 0.05 |
| Monodisperse silver chlorobromide emulsion (EM4) spectral-sensitized by sensitizing dye (ExS-2, -3) | 0.11 |
| Gelatin | 1.80 |
| Magenta coupler (ExM-1) | 0.38 |
| Image dye stabilizer (Cpd-11) | 0.20 |
| Solvent (Solv-4) | 0.12 |
| Solvent (Solv-6) | 0.25 |
| Fourth layer: UV absorbing layer | |

-continued

| | |
|---|---|
| Gelatin | 1.60 |
| UV absorbent (Cpd-1/Cpd-2/Cpd-3 = 3/2/6 in wt. ratio) | 0.70 |
| Color mix inhibitor (Cpd-6) | 0.05 |
| Solvent (Solv-2) | 0.27 |
| Fifth layer: Red-sensitive emulsion layer | |
| Monodisperse silver chlorobromide emulsion (EM5) spectral-sensitized by sensitizing dye (ExS-8, -12) | 0.07 |
| Monodisperse silver chlorobromide emulsion (EM6) spectral-sensitized by sensitizing dye (ExS-8, -12) | 0.16 |
| Gelatin | 0.92 |
| Cyan coupler (ExC-6) | 0.32 |
| Image dye stabilizer (Cpd-2/Cpd-3/Cpd-4 = 3/4/2 in wt. ratio) | 0.17 |
| Polymer for dispersion (Cpd-9) | 0.28 |
| Solvent (Solv-4) | 0.20 |
| Sixth layer: UV absorbing layer | |
| Gelatin | 0.54 |
| UV absorbent (Cpd-1/Cpd-3/Cpd-4 = 1/5/3 in wt. ratio) | 0.21 |
| Solvent (Solv-4) | 0.08 |
| Seventh layer: Protective layer | |
| Gelatin | 1.33 |
| Acryl-modified copolymer of polyvinyl alcohol (modification degree: 17%) | 0.17 |
| Liquid paraffin | 0.03 |

For preventing irradiation, the dyes (Cpd-1 and -2) were used.

Additionally, the same auxiliary agents for emulsification and dispersion, and coating aids as in Example 2 were used. As the stabilizer of silver halide, (Cpd-19) and (Cpd-21) were used. The silver halide emulsion used in this Example were as follows:

| Emulsion | Shape | Grain size (μm) | Br Content (mol %) | Fluctuation coefficient |
|---|---|---|---|---|
| EM1 | Cubic | 1.0 | 80 | 0.08 |
| EM2 | Cubic | 0.75 | 80 | 0.07 |
| EM3 | Cubic | 0.5 | 83 | 0.09 |
| EM4 | Cubic | 0.4 | 83 | 0.10 |
| EM5 | Cubic | 0.5 | 73 | 0.09 |
| EM6 | Cubic | 0.4 | 73 | 0.10 |

Next, Samples (C-2) to (C-16) were prepared by exchanging the magenta coupler in the third layer (green-sensitive layer) of Sample (C-1) and/or by adding the preservability improving compound of the present invention. The details of the Samples are shown in Table 4.

Each of the thus prepared samles were subjected to a exposure through an optical wedge and then to a processing procedure (IV) described below using a Fuji Color Paper Processor FPRR 115 (processor made by Fuji Photo Film Co.) to obtain a color image.

Processing Procedure (IV)

| Step | Temp. (°C.) | Time | Replenisher Amount (ml/m²)* | Tank Capacity (l) |
|---|---|---|---|---|
| Color developing | 37 | 3 min. 30 sec. | 200 | 60 |
| Bleach-fixing | 33 | 1 min. 30 sec. | 55 | 40 |
| Water washing ① | 24–34 | 1 min. | — | 20 |
| Water washing ② | 24–34 | 1 min. | — | 20 |
| Water washing ③ | 24–34 | 1 min. | 10 | 20 |
| Drying | 70–80 | 1 min. | | |

*per m² of the photographic material

Water washing steps were carried out in a three-tank cascade mode from tank of washing ③ toward tank of washing ①.

The compositions of the processing solution were as follows:

| | Tank Solution | Replenisher |
|---|---|---|
| Color Developing Solution | | |
| Water | 800 ml | 800 ml |
| Diethylenetriaminepentaacetate | 1.0 g | 1.0 g |
| Nitolirotriacetic acid | 2.0 g | 2.0 g |
| Benzyl alcohol | 15 ml | 23 ml |
| Diethylene glycol | 10 ml | 10 ml |
| Sodium sulfite | 2.0 g | 3.0 g |
| Potassium bromide | 1.2 g | — |
| Potassium carbonate | 30 g | 25 g |
| N-Ethyl-N-(β-methanesulfonamidoethyl)-3-methyl-4-aminoaniline sulfonate | 5.0 g | 9.0 g |
| Hydroxylaminesulfonate | 3.0 g | 4.5 g |
| Brightening agent (WHITEX4B, tradename, made by Sumitomo Chemical) | 1.0 g | 2.0 g |
| Water to make | 1000 ml | 1000 ml |
| pH (at 25° C.) | 10.20 | 10.80 |
| Bleach fixing Solution | | |
| Water | 400 ml | 400 ml |
| Ammonium thiosulfate (70% solution) | 150 ml | 300 ml |
| Sodium sulfite | 13 g | 26 g |
| Ammonium iron (III) ethylenediaminetetraacetate | 55 g | 110 g |
| Disodium ethylenediaminetetraacetate | 5 g | 10 g |
| Water to make | 1000 ml | 1000 ml |
| pH (at 25° C.) | 6.70 | 6.30 |

At the point of one hour after development processing by the processing procedure (IV), a magenta reflective density (stain) was measured at a non-image area of each processed sample. The same stain measurements were carried out again on the processed samples after being kept for 14 days at 60° C. and 70% RH, and on the processed samples after being kept for 100 days at room temperature. The results are shown in Table 4 in values of increments of stain after one hour.

TABLE 4

| Sample | Magenta Coupler | Additive (Exemplified Compound) | Amount of Additive (mol % to coupler) | Increment of Magenta Stain: 14 days at 60° C., 70% RH | Increment of Magenta Stain: 100 days at R.T. | Remarks |
|---|---|---|---|---|---|---|
| C-1 | ExM-1 | — | — | 0.12 | 0.11 | Comparative Example |
| C-2 | ExM-2 | — | — | 0.10 | 0.10 | Comparative Example |
| C-3 | ExM-3 | — | — | 0.05 | 0.03 | Comparative Example |
| C-4 | ExM-4 | — | — | 0.11 | 0.11 | Comparative Example |
| C-5 | ExM-1 | (I-18) | 20 | 0.05 | 0.04 | Comparative |

TABLE 4-continued

| Sample | Magenta Coupler | Additive (Exemplified Compound) | Amount of Additive (mol % to coupler) | Increment of Magenta Stain 14 days at 60° C., 70% RH | 100 days at R.T. | Remarks |
|---|---|---|---|---|---|---|
| C-6 | ExM-1 | (III-19) | 20 | 0.04 | 0.03 | Comparative Example |
| C-7 | ExM-1 | (I-18) + (III-19) | 10 + 10 | 0.02 | 0.01 | This Invention |
| C-8 | ExM-2 | (I-26) | 20 | 0.04 | 0.04 | Comparative Example |
| C-9 | ExM-2 | (III-7) | 20 | 0.04 | 0.03 | Comparative Example |
| C-10 | ExM-2 | (I-26) + (III-7) | 10 + 10 | 0.01 | 0.01 | This Invention |
| C-11 | ExM-3 | (II-3) | 20 | 0.03 | 0.02 | Comparative Example |
| C-12 | ExM-3 | (III-4) | 20 | 0.02 | 0.02 | Comparative Example |
| C-13 | ExM-3 | (II-3) + (III-4) | 10 + 10 | 0.01 | 0.01 | This Invention |
| C-14 | ExM-4 | (I-5) | 20 | 0.05 | 0.04 | Comparative Example |
| C-15 | ExM-4 | (III-19) | 20 | 0.03 | 0.02 | Comparative Example |
| C-16 | ExM-4 | (I-5) + (III-19) | 10 + 10 | 0.01 | 0.01 | This Invention |

As is apparent from the results in Table 4, it can be understood that the object of the present invention can be attained by the combined used of the preservability improving compounds (A) and (B) of the invention, although magenta stain was not sufficiently prevented by the individual use of compound (A) or (B).

EXAMPLE 4

In a manner similar to Example 1 and Example 3, each of the photographic samples (A-1) to (A-17) of Example 1 and (C-1) to (C-16) of Example 3 was subjected to a exposure through an optical wedge. It was then processed according to the following procedure (V) to obtain a color image.

| Step | Processing Procedure (V) Temperature (°C.) | Time |
|---|---|---|
| Color developing | 38 | 1 min. 40 sec. |
| Bleach-fixing | 30–34 | 1 min. |
| Rinsing ① | 30–34 | 20 sec. |
| Rinsing ② | 30–34 | 20 sec. |
| Rinsing ③ | 30–34 | 20 sec. |
| Drying | 70–80 | 50 sec. |

Rinsing steps were carried out in a three-tank countercurrent mode from tank of rinsing ③ towards tank of rinsing ①.

The composition of the processing solutions were as follows:

| Color Developing Solution | |
|---|---|
| Water | 800 ml |
| Diethylenetriaminetentaacetate | 1.0 g |
| 1-Hyroxyethylidene-1,1-diphosphonate (60%) | 2.0 g |
| Nitolirotriacetic acid | 2.0 g |
| 1,3-Diamino-2-propanol | 4.0 g |
| 1,4-Diazabicyclo [2,2,2] octane | 6.0 g |
| Potassium bromide | 0.5 g |
| Potassium carbonate | 30 g |
| N-Ethyl-N-(β-methanesulfonamidoethyl)-3-methyl-4-aminoaniline sulfonate | 5.5 g |
| Hydoxylamine sulfonate | 4.0 g |
| Brightening agent (UVITEX, tradename, made by Ciba-Geigy) | 1.5 g |
| Water to make | 1000 ml |
| pH (at 25° C.) | 10.25 |
| Bleach-fixing Solution | |
| Water | 400 ml |

-continued

| | |
|---|---|
| Ammonium thiosulfate (70% solution) | 200 ml |
| Sodium sulfite | 20 g |
| Ammonium iron(III) ethylenediaminetetra-acetate | 60 g |
| Disodium ethylenediaminetetraacetate | 10 g |
| Water to make | 1000 ml |
| pH (at 25° C.) | 7.00 |
| Rinsing Solution | |
| Ion-exchanged water (containing under 3 ppm of Ca and Mg, respectively) | |

Then, as in Example 3, magenta reflective density (stain) measurements were taken at a non-image area on the processed samples after one hour lapsed from the development processing, on the processed samples after being kept for 14 days at 60° C. and 70% RH, and on the processed samples after being kept for 100 days at room temperature, respectively. From the results of evaluating the values of increments of magenta stain after one hour, stain increments were not substantially or at all observed on each sample that used preservability improving compounds (A) and (B) of the present invention in combination, although the stain of comparative samples that used compounds (A) and (B) separately did increase.

EXAMPLE 5

A photographic material (D-1) was prepared in the same manner as described in Sample (C-1) of Example 3 except that silver halide emulsions (EM7-EM12) were used instead of silver halide emulsions (EM1-EM6) respectively.

| Emulsion | Shape | Grain size (μm) | Cl Contents (mol %) | Fluctuation coefficient | Sensitizing dye |
|---|---|---|---|---|---|
| EM7 | Cubic | 1.1 | 99.0 | 0.1 | (ExS-4) |
| EM8 | Cubic | 0.8 | 99.0 | 0.1 | (ExS-4) |
| EM9 | Cubic | 0.45 | 98.5 | 0.09 | (ExS-3, -5) |
| EM10 | Cubic | 0.34 | 98.5 | 0.09 | (ExS-3, -5) |
| EM11 | Cubic | 0.45 | 98.5 | 0.09 | (ExS-8, -12) |
| EM12 | Cubic | 0.34 | 98.4 | 0.10 | (ExS-8, -12) |

Then, Samples (D-2)–(D-16) were prepared by exchanging the magenta coupler in the third layer (green-sensitive layer) of Sample (D-1) with another magenta coupler of equal mol and/or by adding a preservability improving compound of the present invention. The details of the Samples (D-2)-(D-16) are shown in Table 5.

Each thus prepared sample was subjected to an exposure through an optical wedge and then to the processing procedure (VI) described below to obtain a color image.

Processing Procedure (VI)

| Step | Temperature (°C.) | Time (sec.) | Replenisher Amount (ml/m²)* | Tank Capacity (l) |
|---|---|---|---|---|
| Color developing | 35 | 45 | 161 | 17 |
| Bleach-fixing | 30-36 | 45 | 215 | 17 |
| Stabilizing (1) | 30-37 | 20 | — | 10 |
| Stabilizing (2) | 30-37 | 20 | — | 10 |
| Stabilizing (3) | 30-37 | 20 | — | 10 |
| Stabilizing (4) | 30-37 | 30 | 248 | 10 |
| Drying | 70-85 | 60 | | |

*per m² of the photographic material

Stabilizing steps were carried out in a four-tank counter-current mode from tank of stabilizing (4) toward tank of stabilizing (1).

The composition of each processing solution was as follows:

| | Tank Solution | Replenisher |
|---|---|---|
| **Color Developing Solution** | | |
| Water | 800 ml | 800 ml |
| Ethylenediaminetetraacetic acid | 2.0 g | 2.0 g |
| 5,6-dihydroxybenzene-1,2,4-trisulfonate | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfonate | 5.0 g | 7.0 g |
| Diethylhydroxylamine | 4.2 g | 6.0 g |
| Brightening agent (4,4-diamino-stilbene series) | 2.0 g | 2.5 g |
| Water to make | 1000 ml | 1000 ml |
| pH (25° C.) | 10.05 | 10.45 |
| **Bleach-fixing Solution (both tank solution and replenisher)** | | |
| Water | 400 ml | |
| Ammonium thiosulfate (70% solution) | 100 ml | |
| Sodium sulfite | 17 g | |
| Ammonium iron (III) ethylenediamine-tetraacetate | 55 g | |
| Disodium ethylenediaminetetraacetate | 5 g | |
| Glacial acetic acid | 9 g | |
| Water to make | 1000 ml | |
| pH (25° C.) | 5.40 | |
| **Stabilizing Solution (both tank solution and replenisher)** | | |
| Formalin (37% solution) | 0.1 g | |
| Formalin-sulfic acid adduct | 0.7 g | |
| 5-Chloro-2-methyl-4-isothiazoline-3-one | 0.02 g | |
| 2-Methyl-4-isothiazoline-3-one | 0.01 g | |
| Copper sulfate | 0.005 g | |
| Water to make | 1000 ml | |
| pH (25° C.) | 4.0 | |

Then, magenta reflective density (stain) measurements were carried out on the samples as in Example 3 and Example 4, that is, on the processed samples after one hour of the development processing, on the processed samples after being kept for 14 days at 60° C. and 70% RH, and on the processed samples after being kept for 100 days at room temperature. The values of increments of magenta stain after one hour were evaluated. The results are shown in Table 5.

TABLE 5

| Sample | Magenta Coupler | Additive (Exemplified Compound) | Amount of Additive (mol % to coupler) | Increment of Magenta Stain: 14 days at 60° C., 70% RH | Increment of Magenta Stain: 100 days at R.T. | Remarks |
|---|---|---|---|---|---|---|
| D - 1 | ExM-1 | — | — | 0.05 | 0.04 | Comparative Example |
| D - 2 | ExM-2 | — | — | 0.04 | 0.04 | Comparative Example |
| D - 3 | ExM-3 | — | — | 0.03 | 0.02 | Comparative Example |
| D - 4 | ExM-4 | — | — | 0.04 | 0.04 | Comparative Example |
| D - 5 | ExM-1 | (I-18) | 10 | 0.02 | 0.02 | Comparative Example |
| D - 6 | " | (III-19) | 10 | 0.02 | 0.01 | Comparative Example |
| D - 7 | " | (I-18) + (III-19) | 5 + 5 | 0.01 | 0.00 | This Invention |
| D - 8 | ExM-2 | (I-26) | 10 | 0.02 | 0.02 | Comparative Example |
| D - 9 | " | (III-7) | 10 | 0.02 | 0.02 | Comparative Example |
| D - 10 | " | (I-26) + (III-7) | 5 + 5 | 0.01 | 0.00 | This Invention |
| D - 11 | ExM-3 | (II-3) | 10 | 0.02 | 0.01 | Comparative Example |
| D - 12 | " | (III-4) | 10 | 0.02 | 0.01 | Comparative Example |
| D - 13 | " | (II-3) + (III-4) | 5 + 5 | 0.00 | 0.00 | This Invention |
| D - 14 | ExM-4 | (I-5) | 10 | 0.02 | 0.02 | Comparative Example |
| D - 15 | " | (III-19) | 10 | 0.02 | 0.02 | Comparative Example |
| D - 16 | " | (I-5) + (III-19) | 5 + 5 | 0.01 | 0.00 | This Invention |

As is apparent from the results in Table 5, as in the above-described Examples, magenta stain increased on each comparative sample, but the increment of stain was not substantially or at all observed on each sample that used the preservability improving compounds (A) and (B) of the present invention in combination, whereas the stain of samples that used compounds (A) or (B) individually were not adequately prevented.

EXAMPLE 6

Photographic samples for comparison (A-1)-(A-3) prepared in Example 1 were respectively subjected to an exposure through an optical wedge and then to processing according to a comparative procedure (VII) and to processing according to the present invention (VIII) and (IX) to obtain color images.

| Processing Procedure (VII) | | |
|---|---|---|
| Step | Temperature (°C.) | Time |
| Color developing | 38 | 1 min. 40 sec. |
| Bleach-fixing | 30–34 | 1 min. |
| Rinsing ① | 30–34 | 20 sec. |
| Rinsing ② | 30–34 | 20 sec. |
| Rinsing ③ | 30–34 | 20 sec. |
| Drying | 70–80 | 50 sec. |

Rinsing steps were carried out in a three-tank countercurrent mode from tank of rinsing ③ toward tank of rinsing ①.

The composition of the processing solutions were as follows:

| Color Developing Solution | |
|---|---|
| Water | 800 ml |
| Diethylenetriaminepentaacetate | 1.0 g |
| 1-Hydroxyethylidene-1,1-diphosphonate (60%) | 2.0 g |
| Nitolirotriacetic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfonate | 5.5 g |
| Brightening agent (WHITEX4B, made by Sumitomo Chemical) | 1.5 g |
| Water to make | 1000 ml |
| pH (25° C.) | 10.25 |

-continued

| Bleach-fixing Solution | |
|---|---|
| Water | 400 ml |
| Ammonium thiosulfate (70%) | 200 ml |
| Sodium sulfite | 20 g |
| Ammonium iron (III) ethylenediaminetetraacetate | 60 g |
| Disodium ethylenediaminetetraacetate | 10 g |
| Water to make | 1000 ml |
| pH (25° C.) | 7.00 |
| **Rinsing Solution** | |
| Benzotriazole | 1.0 g |
| Ethylenediamine-N,N,N',N'-tetramethylenephosphonate | 0.3 g |
| Water to make | 1000 ml |
| pH (25° C.) | 7.50 |

Processing Procedure (VIII) (the present invention)

The same as Processing Procedure (VII), except that 10 g of the exemplified compound (III-10) is contained in the rinsing solution.

Processing Procedure (IX) (the present invention

The same as processing procedure (VII), except that 10 g of the exemplified compound (III-17) is contained in the rinsing solution.

Then, as in Example 3, magenta reflective density (stain) was measured at a non-image area of each sample at the point of one hour after the development process. The same stain measurements were carried out again on the processed samples after being kept for 14 days at 60° C. and 70% RH, and on the processed samples after being kept for 100 days at room temperature. The increments of magenta stain after one hour for the samples were evaluated (Table 6).

TABLE 6

| Sample | Magenta Coupler | Additive (Exemplified Compound) | Amount of Additive (mol % to coupler) | Processing Procedure | Increment of Magenta Stain: 14 days at 60° C., 70% RH | Increment of Magenta Stain: 100 days at R.T. | Remarks |
|---|---|---|---|---|---|---|---|
| A - 1 | M - 30 | — | — | (VII) | 0.16 | 0.15 | Comparative Example |
| A - 2 | " | (I-4) | 20 | (VII) | 0.09 | 0.07 | Comparative Example |
| A - 3 | " | (I-27) | 20 | (VII) | 0.08 | 0.05 | Comparative Example |
| A - 1 | " | — | — | (VIII) | 0.08 | 0.05 | Comparative Example |
| A - 2 | " | (I-4) | 20 | (VIII) | 0.01 | 0.01 | This Invention |
| A - 3 | " | (I-27) | 20 | (VIII) | 0.02 | 0.01 | This Invention |
| A - 1 | " | — | — | (IX) | 0.09 | 0.06 | Comparative Example |
| A - 2 | " | (I-4) | 20 | (IX) | 0.01 | 0.01 | This Invention |
| A - 3 | " | (I-27) | 20 | (IX) | 0.01 | 0.01 | This Invention |

As is apparent from the results in Table 6, with the inclusion of the preservability improving compounds in the photographic materials after the developing steps, the increments of magenta stain are lowest on the samples in which both of the preservability improving compounds (A) and (B) were applied to.

EXAMPLE 7

The preparation procedures of the photographic materials in Examples 1-6 were repeated, except that the cyan couplers were changed to (ExC-1)-(ExC-6), respectively. The thus prepared samples were evaluated for magenta stain in the same manner as Examples 1–6. From the results of the evaluation, it is clear that the most preferable prevention of stain was obtained with the combined use of the preservability improving compounds (A) and (B), as in the above-described Examples.

As is evident from these results, the stain increment with a lapse of time is remarkably prevented by the practice of the present invention, and this excellent effect is maintained even if the structure of photographic materials and processing procedures are varied.

EXAMPLE 8

Samples (C-17) to (C-24) were prepared by repeating the preparation procedures of Sample (C-1) in Example 3, except the changing of the yellow coupler (equal mole exchanging) and the solvent in the first layer (blue-sensitive emulsion layer), with or without adding the preservability improving compounds of the present invention; changing the magenta coupler (equal mole exchanging) and the solvent in the third layer (green-sensitive emulsion layer), with or without adding the preservability improving compounds of the present invention; and changing the cyan coupler (equal mole exchanging) and the solvent in the fifth layer (red-sensitive emulsion layer), with or without adding the preservability improving compounds of the present invention. The details of the exchanged compositions are shown in Table 7.

TABLE 7

| Sample | Main component | First Layer | Third Layer | Fifth Layer |
|---|---|---|---|---|
| (C-17) | Coupler | ExY-3 | ExM-4 | ExC-4/ExC-8 = 1/1 |
| | Preservability improving compound | — | — | — |
| | Solvent | Solv-8 | Solv-1 | Solv-5 |
| (C-18) | Coupler | Same as (C-17) | Same as (C-17) | Same as (C-17) |
| | Preservability improving compound | I-32 (5 mol %)* | I-74 (20 mol %)* | I-82 (5 mol %)* |
| | Solvent | Same as (C-17) | Same as (C-17) | Same as (C-17) |
| (C-19) | Coupler | Same as (C-18) | Same as (C-17) | Same as (C-18) |
| | Preservability improving compound | Same as (C-18) | III-30 (20 mol %)* | Same as (C-18) |
| | Solvent | Same as (C-18) | Same as (C-17) | Same as (C-18) |
| (C-20) | Coupler | Same as (C-18) | Same as (C-17) | Same as (C-18) |
| | Preservability improving compound | Same as (C-18) | I-74 (10 mol %)*, III-30 (10 mol %)* | Same as (C-18) |
| | Solvent | Same as (C-18) | Same as (C-17) | Same as (C-18) |
| (C-21) | Coupler | ExY-1/ExY-2 = 1/1 | ExM-2 | ExC-3 |
| | Preservability improving compound | — | I-70 (20 mol %)* | — |
| | Solvent | Solv-8 | Solv-4/Solv-6 = ½ | Solv-8 |
| (C-22) | Coupler | Same as (C-21) | Same as (C-21) | Same as (C-21) |
| | Preservability improving compound | Same as (C-21) | III-40 (20 mol %)* | Same as (C-21) |
| | Solvent | Same as (C-21) | Same as (C-21) | Same as (C-21) |
| (C-23) | Coupler | Same as (C-21) | Same as (C-21) | Same as (C-21) |
| | Preservability improving compound | Same as (C-21) | I-70 (10 mol %)*, III-40 (10 mol %)* | Same as (C-21) |
| | Solvent | Same as (C-21) | Same as (C-21) | Same as (C-21) |
| (C-24) | Coupler | Same as (C-21) | Same as (C-21) | Same as (C-21) |
| | Preservability improving compound | I-71 (5 mol %)* | I-57 (10 mol %)*, III-30 (10 mol %)* | I-71 (5 mol %)* |
| | Solvent | Same as (C-21) | Same as (C-21) | Same as (C-21) |

Note *mol % based on coupler

Each of the thus prepared samples was subjected to an exposure through an optical wedge and then processed according to the processing procedure (IV) shown in Example 3.

Then, reflective densities of yellow, magenta, and cyan at a non-image area of each processed sample (C-17) to (C-24) were measured at the point of one hour after development processing, and again after being kept for 14 days at 60° C. and 70% RH. The results are shown in Table 8 as values of increments of stain after one hour concerning yellow, magenta, and cyan reflective densities.

TABLE 8

| Sample | Increment of stain (D) after being kept for 14 days at 60° C. 70% RH: Yellow($D_B$) | Magenta($D_G$) | Cyan($D_C$) | Remarks |
|---|---|---|---|---|
| (C-17) | 0.15 | 0.11 | 0.08 | Comparative Example |
| (C-18) | 0.05 | 0.05 | 0.03 | Comparative Example |
| (C-19) | 0.06 | 0.04 | 0.05 | This Invention |
| (C-20) | 0.02 | 0.01 | 0.02 | This Invention |
| (C-21) | 0.14 | 0.10 | 0.15 | Comparative Example |
| (C-22) | 0.11 | 0.05 | 0.11 | Comparative Example |
| (C-23) | 0.07 | 0.02 | 0.10 | This Invention |
| (C-24) | 0.02 | 0.01 | 0.02 | This Invention |

As is apparent from the results of Table 8, yellow stain, magenta stain and cyan stain increase remarkably on the samples (C-17) and (C-21) that did not use the preservability improving compounds in the processing procedure (IV), but the increments of stain are prevented considerably by adding the preservability improving compounds (A) into each layer [Sample (C-18)]. Further better effect is obtained by adding the preservability improving compound (B) [Sample (C-19)]. It is noted that the increments of stain in the first and fifth layers are prevented somewhat by using the preservability improving compound (A) in the third layer [Sample (C-22)]. However, the effect of the preservability improving compound is not sufficient with the individual use of compounds (A) and (B). In contrast, a superior effect is obtained by the combined use of these preservability improving compounds (A) and (B) in the same layer [Samples (C-20), (C-23) and (C-24)]. And also, it is noted that the increment of each stain is almost completely prevented by using a small amount of the preservability improving compound (A) in the processing procedure such as in processing procedure (IV) [Samples (C-20) and (C-24)].

EXAMPLE 9

A color photographic material (H-1) was prepared by multi-coatings composed of the first to the fourteenth layer as hereinbelow described on a both-sides polyethylene-laminated paper base. A white pigment ($TiO_2$) and a small amount of bluish dye (ultramarine blue) were included in the first layer side of the polyethylene film laminated.

Composition of Photosensitive Layers

In the following compositions, each ingredient is indicated in g/m$^2$ of a coating amount, but the coating amount of the silver halide is shown in g/m$^2$ in terms of silver.

| | |
|---|---|
| **First layer: Antihalation layer** | |
| Black colloidal silver | 0.10 |
| Gelatin | 1.30 |
| **Second Layer: Intermediate layer** | |
| Gelatin | 0.70 |
| **Third layer: Red-sensitive emulsion (low sensitivity) layer** | |
| Silver bromide emulsion spectral-sensitized by red-sensitizing dye (ExS-1, -2 and -3)(average grain size: 0.3 μm, grain size distribution: 8%, octahedral) | 0.06 |
| Silver bromide emulsion spectral-sensitized by red-sensitizing dye (ExS-1, -2 and -3)(average grain size: 0.45 μm, grain size distribution: 10%, octahedral) | 0.10 |
| Gelatin | 1.00 |
| Cyan coupler (ExC-1) | 0.14 |
| Cyan coupler (ExC-2) | 0.07 |
| Discoloration inhibitor (equal amount mixture of Cpd-2, -4, -5 and -9) | 0.12 |
| Dispersion medium for coupler (Cpd-5) | 0.20 |
| Solvent for coupler (equal amount mixture of Solv-1, -2 and -3) | 0.06 |
| **Fourth layer: Red-sensitive emulsion (highly sensitive) layer** | |
| Silver bromide emulsion spectral-sensitized by red-sensitizing dye (ExS-1, -2 and -3)(average grain size: 0.75 μm, grain size distribution: 10%, octahedral) | 0.15 |
| Gelatin | 1.00 |
| Cyan coupler (ExC-1) | 0.20 |
| Cyan coupler (ExC-2) | 0.10 |
| Discoloration inhibitor (equal amount mixture of Cpd-2, -3, -4 and -9) | 0.15 |
| Dispersion medium for coupler (Cpd-5) | 0.30 |
| Solvent for coupler (equal amount mixture of Solv-1, -2 and -3) | 0.10 |
| **Fifth layer: Intermediate layer** | |
| Gelatin | 1.00 |
| Color mix inhibitor (Cpd-7) | 0.08 |
| Solvent for color mix inhibitor (Solv-4 and -5) | 0.16 |
| Polymer latex (Cpd-8) | 0.10 |
| **Sixth layer: Green-sensitive emulsion (low sensitivity) layer** | |
| Silver bromide emulsion spectral-sensitized by green-sensitizing dye (ExS-3, and -4)(average grain size: 0.28 μm, grain size distribution: 8%, octahedral) | 0.04 |
| Silver bromide emulsion spectral-sensitized by green-sensitizing dye (ExS-3, and -4)(average grain size: 0.45 μm, grain size distribution: 10%, octahedral) | 0.06 |
| Gelatin | 0.06 |
| Magenta coupler (ExM-1) | 0.80 |
| Discoloration inhibitor (Cpd-9) | 0.10 |
| Stain inhibitor (Cpd-10) | 0.10 |
| Stain inhibitor (Cpd-11) | 0.001 |
| Stain inhibitor (Cpd-12) | 0.01 |
| Dispersion medium for coupler (Cpd-5) | 0.05 |
| Solvent for coupler (equal amount mixture of Solv-4 and -6) | 0.15 |
| **Seventh layer: Green-sensitive emulsion (highly sensitive) layer** | |
| Silver bromide emulsion spectral-sensitized by green-sensitizing dye (ExS-3)(average grain size: 0.9 μm, grain size distribution: 10%, octahedral) | 0.10 |
| Gelatin | 0.80 |
| Magenta coupler (ExM-1) | 0.10 |
| Discoloration inhibitor (Cpd-9) | 0.10 |

-continued

| | |
|---|---|
| Stain inhibitor (Cpd-10) | 0.10 |
| Stain inhibitor (Cpd-11) | 0.001 |
| Stain inhibitor (Cpd-12) | 0.01 |
| Dispersion medium for coupler (Cpd-5) | 0.05 |
| Solvent for coupler (equal amount mixture of Solv-4 and -6) | 0.15 |
| **Eighth layer: Intermediate layer** | |
| Same as the fifth layer. | |
| **Ninth layer: Yellow filter layer** | |
| Yellow colloidal silver | 0.20 |
| Gelatin | 1.00 |
| Color mix inhibitor (Cpd-7) | 0.06 |
| Solvent for color mix inhibitor (equal amount mixture for Sov-4 and -5) | 0.15 |
| Polymer latex (Cpd-8) | 0.10 |
| **Tenth layer: Intermediate layer** | |
| Same as the fifth layer. | |
| **Eleventh layer: Blue-sensitive emulsion (low sensitivity) layer** | |
| Silver bromide emulsion spectral-sensitized by blue-sensitizing dye (ExS-5)(average grain size: 0.35 μm, grain size distribution: 8%, tetradecahedral) | 0.07 |
| Silver bromide emulsion spectral-sensitized by blue-sensitizing dye (ExS-5)(average grain size: 0.45 μm, grain size distribution: 10%, tetradecahedral) | 0.10 |
| Gelatin | 0.50 |
| Yellow coupler (ExY-1) | 0.20 |
| Stain inhibitor (Cpd-11) | 0.001 |
| Discoloration inhibitor (Cpd-6) | 0.10 |
| Dispersion medium for coupler (Cpd-5) | 0.05 |
| Solvent for coupler (Solv-2) | 0.05 |
| **Twelfth layer: Blue-sensitive emulsion (highly sensitive) layer** | |
| Silver bromide emulsion spectral-sensitized by blue-sensitizing dye (ExS-5 and -6)(average grain size: 1.2 μm, grain size distribution: 10%, tetradecahedral) | 0.25 |
| Gelatin | 1.00 |
| Yellow coupler (ExY-1) | 0.40 |
| Stain inhibitor (Cpd-11) | 0.002 |
| Discoloration inhibitor (Cpd-6) | 0.10 |
| Dispersion medium for coupler (Cpd-5) | 0.05 |
| Solvent for coupler (Solv-2) | 0.10 |
| **Thirteenth layer: UV absorbing layer** | |
| Gelatin | 1.50 |
| UV absorbent (equal amounts mixutre of Cpd-1, -3 and -13) | 1.00 |
| Color mix inhibitor (equal amount mixture of Cpd-6 and -14) | 0.06 |
| Dispersion medium (Cpd-5) | 0.20 |
| Solvent for UV absorbent (equal amount mixture of Solv-1 and -2) | 0.15 |
| Irradiation inhibitor dye (equal amount mixture of Cpd-15 and -16) | 0.02 |
| Irradiation inhibitor dye (equal amount mixture of Cpd-17 and -18) | 0.02 |
| **Fourteenth layer: Protective layer** | |
| Fine grain size silver chlorobromide emulsion (silver chloride: 97 mol %, average grain size: 0.2 μm) | 0.15 |
| Modified polyvinyl alcohol | 0.02 |
| Gelatin | 1.50 |
| Gelatin hardner (H-1) | 0.17 |

Next, the preparation procedure of the emulsion for the respective layers, except the fourteenth layer, is exemplified as follows:

Preparation of Emulsion

An aqueous solution containing potassium bromide and silver nitrate was added to an aqueous solution of gelatin containing 0.3 g/mol.Ag of 3,4-dimethyl-1,3-thiazoline-2-thione with vigorous agitation at 75° C. over about 20 min, to obtain a mondisperse silver bromine emulsion of octahedral crystalline particles having an average grain size of 0.40 μm. A chemical sensitizing treatment of the thus obtained emulsion was carried out by adding 6 mg/mol.Ag of sodium thiosulfate and 7 mg/mol.Ag of chloroauric acid (tetrahydrate) and heating it at 75° C. for 80 min. Thus obtained silver bromide grains were bought up as a core in the same precipitating conditions as the first precipitating process to obtain finally a monodisperse core-shell silver bromide emulsion of octahedral shaped grains having an average grain size of 0.7 μm. The fluctuation coefficient of the grain size distribution of this emulsion was about 10%.

A further chemical sensitization of this emulsion was carried out by adding 1.5 mg/mol.Ag of sodium thiosulfate and 1.5 mg/mol.Ag of chloroauric acid (tetrahydrate) and heating it at 60° C. for 60 min, to obtain an internal latent-image type silver halide emulsion.

Further, $10^{-3}$ weight % of the compound (N-1) to the coating amount of silver halide and 10 weight % of the compound (ExZS-1) were included in each layer as a nucleating agent and nucleation accelerator, respectively.

In addition, the same auxiliary agents for emulsification and dispersion and coating aids as in Example 2 were used. As the stabilizer in the layers containing silver halide or colloidal silver, compound (Cpd-19), (Cpd-20), and (Cpd-21) were used.

The compounds used in the examples were as follows:

ExS-1

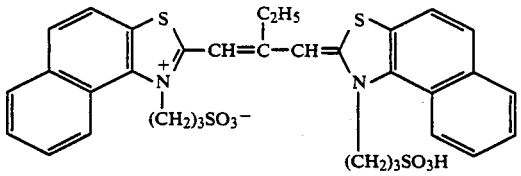

ExS-2

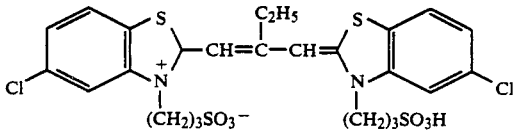

ExS-3

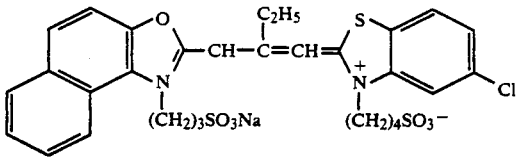

ExS-4

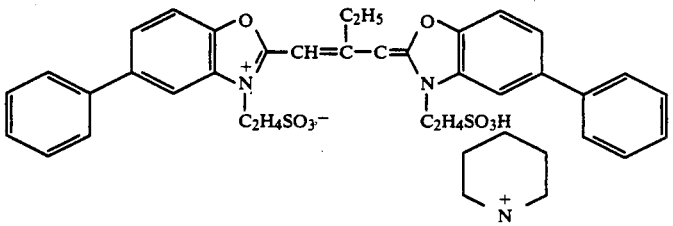

ExS-5

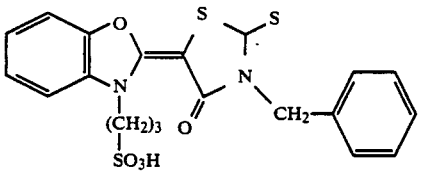

Cpd-1

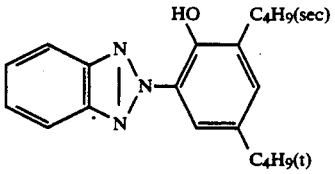

Cpd-2

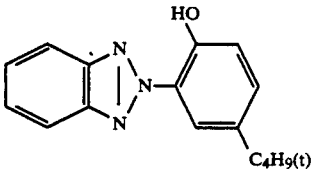

-continued
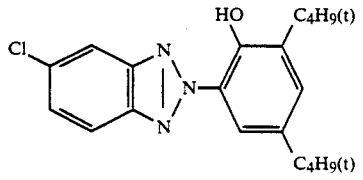
Cpd-3
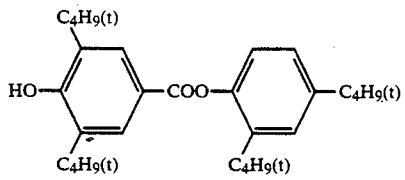
Cpd-4
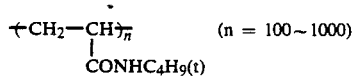
Cpd-5
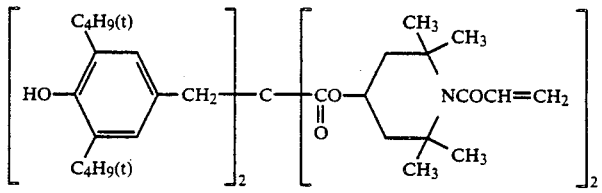
Cpd-6
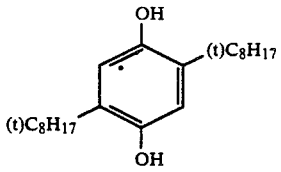
Cpd-7
Polyethyl acrylate
Cpd-8
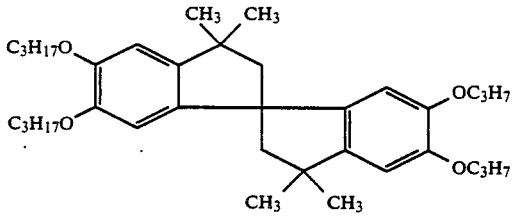
Cpd-10
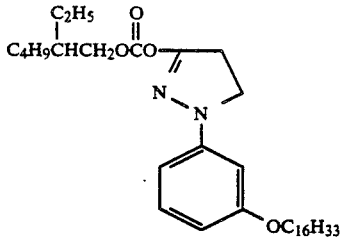
Cpd-10
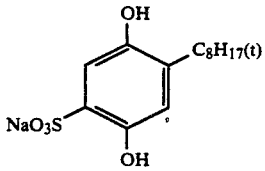
Cpd-11

-continued
Cpd-12
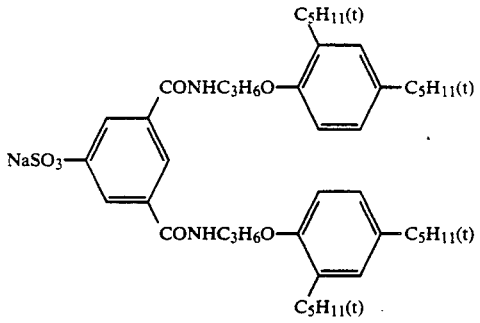
Cpd-13
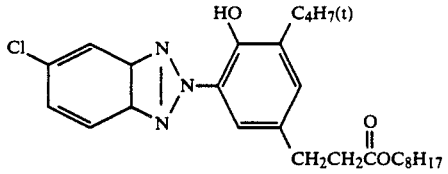
Cpd-14
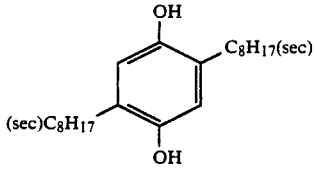
Cpd-15
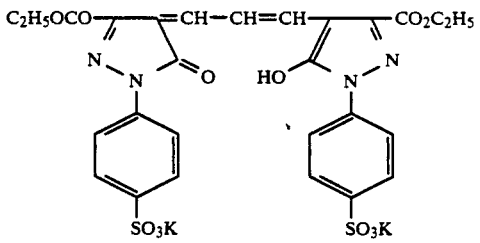
Cpd-16
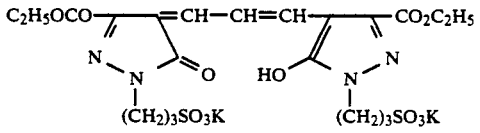
Cpd-17
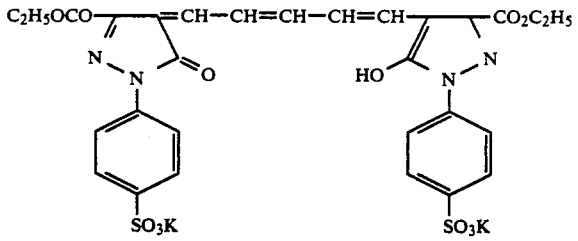
Cpd-18
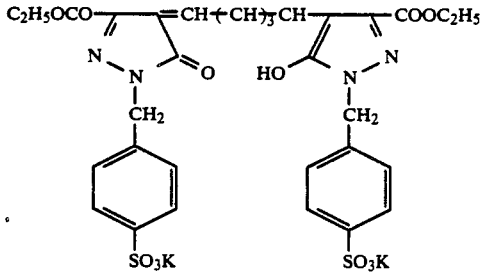

-continued
Cpd-19
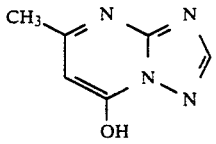
Cpd-20
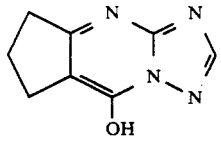
Cpd-21
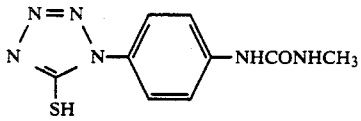
EXC-1
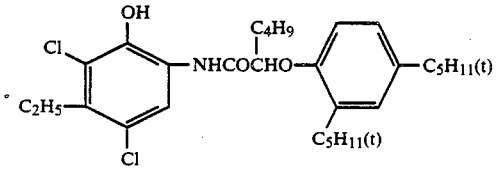
EXC-2
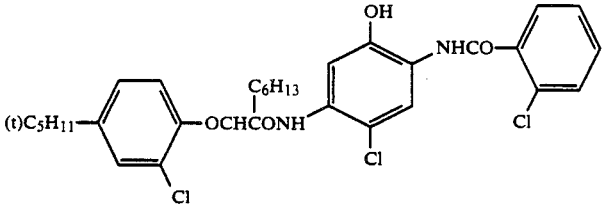
EXM-1
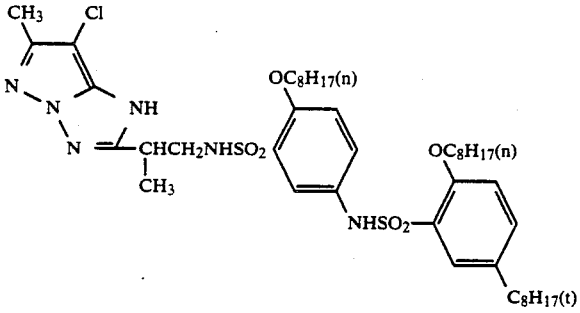
ExY-1
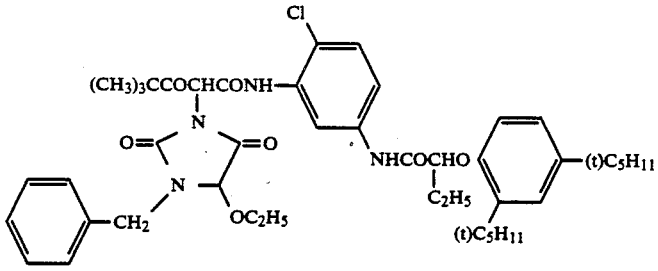
Solv-1 Di(2-ethylhexyl)phthalate
Solv-2 Trinonylphosphate
Solv-3 Di(3-methylhexyl)phthalate
Solv-4 Tricrezylphosphate
Solv-5 Dibutylphthalate
Solv-6 Trioctylphophate
Solv-7 Dioctylsebacate
H-1 1,2-bis(vinylsulfonylacetoamido)ethane

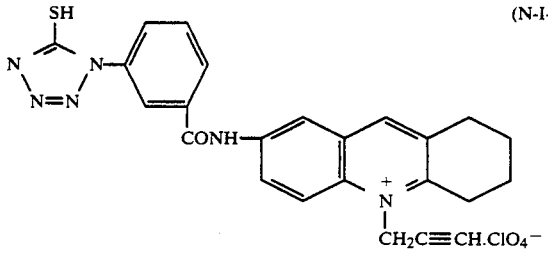

(N-I-9)

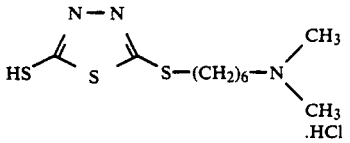

(ExZS-1)

Then, as shown in Table 9, Samples (H-2) to (H-14) were prepared by repeating the preparation procedures of Sample (H-1) except the changing of the magenta couplers and the preservability improving compounds (Cpd-10) and (Cpd-12) in the sixth layer and the seventh layer respectively.

Each of the thus prepared samples was subjected to an exposure through an optical wedge and then to a color development process according to the following processing procedure (X).

| Processing Procedure (X) | | |
|---|---|---|
| Step | Time (sec.) | Temperature (°C.) |
| Color developing | 90 | 38 |
| Bleach-fixing | 45 | 38 |
| Water washing (1) | 45 | 38 |
| Water washing (2) | 45 | 38 |

The water washing steps were carried out by a so-called countercurrent replenishing mode, in which the replenisher is fed to bath of water washing (2), and the overflow water from bath of water washing (2) is fed to bath of water washing (1).

| | Mother solution |
|---|---|
| **Color Developing Solution** | |
| Diethylenetriaminepentaacetic acid | 0.5 g |
| 1-Hydroxyethylidene-1,1-diphosphonate | 0.5 g |
| Diethylene glycohol | 8.0 g |
| Benzyl alcohol | 12.0 g |
| Sodium bromide | 0.7 g |
| Sodium sulfite | 2.0 g |
| N,N-diethylhydroxylamine | 3.5 g |
| Triethylenediamine (1,4-diazabicyclo [2,2,2] octane | 3.5 g |
| 3-Methyl-4-amino-N-ethyl-(β-methanesulfonamido-ethyl)-aniline | 6.0 g |
| Potassium carbonate | 30.0 g |
| Brightening agent (Stilbene series) | 1.0 g |
| Water to make | 1000 ml |
| pH (adjusted with potassium hydroxide or hydrochloric acid) | 10.50 |
| **Bleach-fixing Solution** | |
| Ammonium thiosulfate | 110 g |
| Sodium hydrosulfite | 14.0 g |
| Ammonium iron(III) ethylenediaminetetra-acetate dihydrate | 40.0 g |
| Disodium ethylenediaminetetraacetate dihydrate | 4.0 g |
| Water to make | 1000 ml |
| pH (adjusted with aqueous ammonia or hydrochloric acid) | 10.50 |

Washing Water

Purified water (de-ionized tap water by ion-exchange treatment, containing under 1 ppm of all cations except the hydrogen ion and all anions except the hydroxide ion).

Then, magenta reflective density (stain) was measured at a non-image area of each sample at the point of one hour after the development processing. The same satin measurements were carried out again on the processed samples after being kept for 6 days at 80 C. and 70% RH, and on the processed samples after being kept for 100 days at room temperature. The increments of magenta stain to that of one hour after processing for each sample are shown in Table 9.

TABLE 9

| Sample | Magenta Coupler | Preservability Improving Compound | Amount of Addition (mol %)* | Increment of Magenta Stain: 5 days at 80° C., 70% RH | Increment of Magenta Stain: 100 days at R.T. | Note |
|---|---|---|---|---|---|---|
| (H-1) | ExM-1 | (A): Cpd-10 (I-32) | 10 | 0.01 | 0.00 | This Invention |
| | (M-26) | (B): Cpd-12 (III-30) | 10 | | | |
| (H-2) | ExM-1 | (A): — | — | 0.15 | 0.03 | Comparative Example |
| | (M-26) | (B): — | — | | | |
| (H-3) | ExM-1 | (A): Cpd-10 (I-32) | 20 | 0.05 | 0.03 | " |
| | (M-26) | (B): — | — | | | |
| (H-4) | ExM-1 | (A): — | — | 0.09 | 0.03 | " |
| | (M-26) | (B): Cpd-12 (III-30) | 20 | | | |
| (H-5) | ExM-1 | (A): (I-70) | 20 | 0.06 | 0.03 | " |
| | (M-26) | (B): — | — | | | |
| (H-6) | ExM-1 | (A): — | — | 0.08 | 0.02 | " |
| | (M-26) | (B): (III-40) | 20 | | | |
| (H-7) | ExM-1 | (A): (I-70) | 10 | 0.01 | 0.01 | This Invention |
| | (M-26) | (B): (III-40) | 10 | | | |
| (H-8) | (M-30) | (A): — | — | 0.16 | 0.13 | Comparative Example |
| | | (B): — | — | | | |
| (H-9) | " | (A): (I-57) | 20 | 0.06 | 0.03 | " |
| | | (B): — | — | | | |
| (H-10) | " | (A): (I-57) | 10 | 0.01 | 0.00 | This Invention |
| | | (B): (III-30) | 10 | | | |
| (H-11) | (M-37) | (A): — | — | 0.16 | 0.10 | Comparative Example |
| | | (B): — | — | | | |
| (H-12) | " | (A): (I-74) | 10 | 0.01 | 0.01 | This Invention |
| | | (B): (III-32) | 10 | | | |
| (H-13) | (M-43) | (A): — | — | 0.05 | 0.04 | Comparative Example |
| | | (B): — | — | | | |

TABLE 9-continued

| Sample | Magenta Coupler | Preservability Improving Compound | Amount of Addition (mol %)* | Increment of Magenta Stain 5 days at 80° C., 70% RH | 100 days at R.T. | Note |
|---|---|---|---|---|---|---|
| (H-14) | " | (A): (I-58)<br>(B): (III-36) | 10<br>10 | 0.01 | 0.00 | This Invention |

Note)
*mol % on coupler

As is apparent from the results of Table 9, the stain increments over a lapse of time on the processed photographic material were prevented remarkably by using in combination the preservability improving compounds (A) and (B) of the present invention.

Further, even when the ratio of the silver bromide emulsion to the silver chlorobromide emulsion is varied (in the range that silver chloride is 0.5–99.5 mol %), nearly the same effects as in Table 9 were attained.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material having on a support at least one silver halide emulsion layer containing a color-image forming coupler which forms a dye by a coupling reaction with an oxidized product of an aromatic amine color developing agent, said color photographic material containing both a compound (A), that combines chemically with a non-oxidized aromatic amine developing agent remaining after a color development processing to produce a chemically inactive and substantially colorless compound, and a compound (B), that combines chemically with an oxidized product of the aromatic amine developing agent remaining after the color development processing to produce a chemically inactive and substantially colorless compound, wherein said compound (A) is represented by the following general formula (I) or (II):

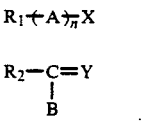

$$R_1\text{-}(A)_n\text{-}X \quad \text{(I)}$$

$$R_2\text{-}\underset{\underset{B}{|}}{C}=Y \quad \text{(II)}$$

wherein $R_1$ and $R_2$ each represents an aliphatic group, an aromatic group, or a heterocyclic group; X represents a group that can react with the aromatic amine developing agent to cause splitting-off; A represents a group that can react with the aromatic amine developing agent to form a chemical bond; n is 1 or 0; B represents a hydrogen atom, an aliphatic group, an aromatic group, a heterocyclic group, an acyl group, or a sulfonyl group; Y represents a group that can facilitate the addition of the aromatic amine developing agent to a compound having general formula (II), and $R_1$ and X together or Y and $R_2$ or B together may combine to form a ring structure, and wherein said compound (B) is represented by the following general formula (III):

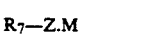

$$R_7\text{—}Z.M \quad \text{(III)}$$

wherein $R_7$ represents an aliphatic group, an aromatic group, or a heterocyclic group, Z represents a nucleophilic group having an oxygen atom, a sulfur atom, or a nitrogen atom to chemically combine with the oxidized product of the aromatic amine developing agent, and M represents a hydrogen atom, a metal cation, an ammonium cation, or a protective group.

2. The silver halide color photographic material as claimed in claim 1, wherein the amount of compound (A) or (B) is $1\times10^{-2}$ to 10 mol per mol of the coupler.

3. The silver halide color photographic material as claimed in claim 1, wherein the amount of compound (B) is from $2\times10^{-2}$ to $2\times10^{-1}$ per mol of the coupler.

4. The silver halide color photographic material as claimed in claim 1, wherein compound (A) or (B) is co-emulsified with the coupler and, the oil/coupler weight ratio is from 0.01 to 2.0.

5. The silver halide color photographic material as claimed in claim 1, wherein the at least one coupler is represented by the following formulae:

General formula (Y-I)

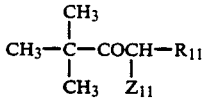

wherein $R_{11}$ represents a substituted or unsubstituted N-phenylcarbamoyl group, and $Z_{11}$ represents a group that can split off in the reaction with the oxidized product of the aromatic primary amine color developing agent;

General formula (Y-II)

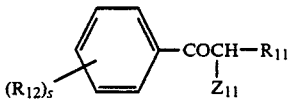

wherein $R_{11}$ represents a substituted or unsubstituted N-phenylcarbamoyl group, $Z_{11}$ represents a group that can split off in the reaction with the oxidized product of the aromatic primary amine color developing agent, $R_{12}$ represents a hydrogen atom or a substituent group, and s is an integer of 1 to 5;

General formula (M-I)

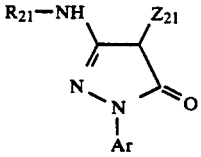

wherein $R_{21}$ represents an alkyl group, an aryl group, an acyl group, or a carbamoyl group; Ar represents a phenyl group or a phenyl group substituted by one or more halogen atoms, alkyl groups, cyano groups, alkoxy groups, alkoxycarbonyl groups, or acylamino groups; and $Z_{21}$ represents a hydrogen atom or a group that can split off in the reaction with the oxidized product of the aromatic primary amine color developing agent;

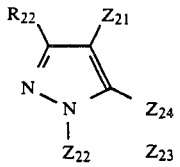

General formula (M-II)

wherein $R_{22}$ represents a hydrogen atom or a substituent group; $Z_{21}$ represents a hydrogen atom or a group that can split off in the reaction with the oxidized product of the aromatic primary amine color developing agent; $Z_{22}$, $Z_{23}$ and $R_{24}$ represent

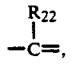

—N= or —NH—; between the bonds of $Z_{24}$-$Z_{23}$ and $Z_{23}$-$Z_{22}$, one is a double bond and the other is a single bond; and when the $Z_{23}$-$Z_{22}$ is a carbon-carbon double bond, the double bond may be part of an aromatic ring;

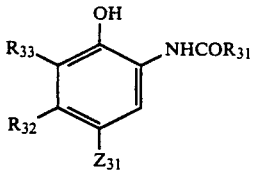

General formula (C-I)

wherein $R_{31}$ represents an alkyl group, a cycloalkyl group, an aryl group, an amino group, or a heterocyclic group; $R_{32}$ represents an acylamino group or an alkyl group; $R_{33}$ represents a hydrogen atom, a halogen atom, an alkyl group or an alkoxy group; $R_{33}$ and $R_{32}$ may bond together to form a ring; and $Z_{31}$ represents a hydrogen atom, a halogen atom, or a group that can split off in the reaction with the oxidized product of the aromatic primary amine color developing agent; and the above couplers may form a dimer or even higher polymer.

6. The silver halide color photographic material as claimed in claim 1, wherein the silver halide comprises silver chloride, silver bromide, or a mixed silver halide.

7. The silver halide color photographic material as claimed in claim 1, wherein the aliphatic group of $R_1$, $R_2$ and B represents a straight chain, branched chain or cyclic alkyl group, alkenyl group or alkynyl group; the aromatic group of $R_1$, $R_2$ and B represents a carbocyclic aromatic group or a heterocyclic aromatic group; and the heterocyclic group of $R_1$, $R_2$ and B represents a 3 to 10-membered heterocyclic group comprising at least one atom selected from a carbon atom, an oxygen atom, a nitrogen atom, and a sulfur atom;

X represents a group that attaches to A via an oxygen atom, a sulfur atom, a nitrogen atom, or a halogen atom, wherein when X is a halogen atom, n is 0;

A represents a group containing a low electron density atom; and

Y is an oxygen atom, a sulfur atom, =N—$R_4$ or

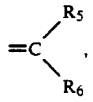

wherein $R_4$, $R_5$ and $R_6$ each represent a hydrogen atom, an aliphatic group, an aromatic group, a heterocyclic group, an acyl group, or a sulfonyl group, and $R_5$ and $R_6$ may bond together to form a ring structure.

8. The silver halide color photographic material as claimed in claim 1, wherein the aliphatic group represented by $R_7$ is a straight chain, branched chain, or cyclic alkyl, alkenyl or alkynyl group; the aromatic group represented by $R_7$ may be any of a carbocyclic aromatic group and a heterocyclic aromatic group; the heterocyclic group represented by $R_7$ has a 3 to 10-membered ring structure comprising at least one atom selected from a carbon atom, oxygen atom, nitrogen atom, and a sulfur atom;

Z represents a nucleophilic group having an oxygen atom, a sulfur atom, or a nitrogen atom to chemically combined with the oxidized product of the aromatic amine developing agent; and M represents a hydrogen atom, a metal cation, an ammonium cation, or a protective group.

9. The silver halide color photographic material as claimed in claim 1, wherein compound (B) is represented by the following general formula (IV):

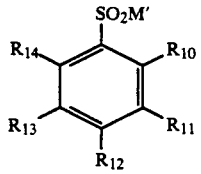

General formula (IV)

wherein M' represents an atom or an atomic group forming an inorganic or organic salt,

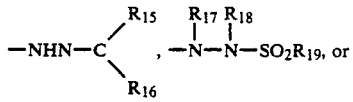

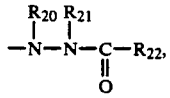

in which $R_{15}$ and $R_{16}$, which may be the same or different, each represent a hydrogen atom, an aliphatic group, an aromatic group, or a heterocyclic group, or $R_{15}$ and $R_{16}$ may bond together to form a 5 to 7-membered ring; $R_{17}$, $R_{18}$, $R_{20}$ and $R_{21}$, which may be the same or different, each represent a hydrogen atom, an aliphatic group, an aromatic group, a heterocyclic group, an acyl group, an alkoxycarbonyl group, a sulfonyl group, a ureido group, or a urethane group, provided that at least one of $R_{17}$ and $R_{18}$ and at least one of $R_{20}$ and $R_{21}$ are hydrogen atoms; $R_{19}$ and $R_{22}$ represent a hydrogen atom, an aliphatic group, an aromatic group, or a heterocyclic group; $R_{22}$ further represents an alkylamino group, an arylamino group, an alkoxy group, an aryloxy group, an acyl group, and alkoxycarbonyl group, or an aryloxycarbonyl group; at least two of $R_{17}$, $R_{18}$ and $R_{19}$ may bond together to form a 5 to 7-membered ring;

$R_{10}$, $R_{11}$, $R_{12}$, $R_{13}$ and $R_{14}$, which may be the same or different, each represent a hydrogen atom, an aliphatic group, an aromatic group, a heterocyclic group, a halogen atom, $—SR_8$, $—OR_8$, $$—\underset{\underset{R_9}{|}}{N}—R_8,$$

an acyl group, an alkoxycarbonyl group, an aryloxycarbonyl group, a sulfonyl group, a sulfonamido group, a sulfamoyl group, a ureido group, a urethane group, a carbamoyl group, a sulfo group, a carboxyl group, a nitro group, a cyano group, an alkoxalyl, an aryloxalyl group, a sulfonyloxy group, $—P(R_8)_3$, $$—\overset{\overset{O}{\|}}{P}(R_8)_2,\ —\overset{\overset{S}{\|}}{P}(R_8)_2,$$

$—P(OR_8)_3$ or a formyl group, wherein $R_8$ and $R_9$ each represent a hydrogen atom, an aliphatic group, an alkoxy group, or an aromatic group.

10. The silver halide color photographic material as claimed in claim 1, wherein the silver halide photographic material contains a support having thereon one or more hydrophilic colloid layers and compound (A) and compound (B) are contained in one of the hydrophilic colloid layers.

11. The silver halide color photographic material as claimed in claim 1, wherein compound (A) is represented by general formula (I-a), (I-b), (I-c) or (I-d) that can react with the rate constant $K_2$ (at 80° C.) of the secondary reaction with p-anisidine within the range of $1\times10^{-1}$ to $1\times10^{-5}$ l/mol.sec

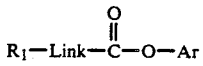
(I-a)

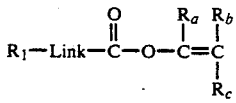
(I-b)

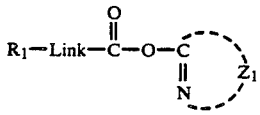
(I-c)

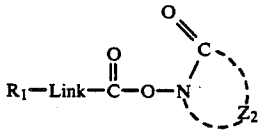
(I-d)

wherein $R_1$ represents an aliphatic group, an aromatic group, or a heterocyclic group; Link represents a single bond or —O—; Ar represents an aromatic group, provided that the group released as a result of reaction with an aromatic amine developing agent is not a group useful as a photographic reducing agent; Ra, Rb and Rc, which may be the same or different, each represent a hydrogen atom, an aliphatic, aromatic or heterocyclic group, alkoxy group, aryloxy group, heterocyclooxy group, alkylthio group, arylthio group, heterocyclothio group, amino group, alkylamino group, acyl group, amido group, sulfonamide group, sulfonyl group, alkoxycarbonyl group, sulfo group, carboxyl group, hydroxyl group, acyloxy group, ureido group, urthane group, carbamoyl group or sulfamoyl group, may combine together to form a 5 to 7-membered heterocyclic ring which may be further substituted by a substituent, may form, a spirocyclic ring or bicyclo ring, or may be condensed by an aromatic ring; $Z_1$ and $Z_2$ each represent a non-metal atom group necessary to form a 5 to 7-membered heterocyclic ring which may be further substituted by a substituent, may form a spirocyclic ring or bicyclo ring, or may be condensed by an aromatic ring, provided that the compound released as a result of the reaction of $Z_1$ with an aromatic amine developing agent is not a coupler or 1-phenyl-3-pyrazolidones.

12. The silver halide color photographic material as claimed in claim 11, wherein compound (A) is represented by general formula (I-a).

13. A process for preparing a color photograph in which a silver halide color photographic material having on a support at least one silver halide emulsion layer containing a color-image forming coupler which forms a dye by a coupling reaction with an oxidized product of an aromatic amine color developing agent is subjected to a color processing including a color developing step with a color developing solution which contains a non-oxidized aromatic amine developing agent, which comprises processing the silver halide color photographic material with a processing solution in the presence of a compound (A), that combines chemically with the non-oxidized aromatic amine developing agent remaining after the color developing step to produce a chemically inactive and substantially colorless compound, and a compound (B), that combines chemically with an oxidized product of the aromatic amine developing agent remaining after the color developing step to produce a chemically inactive and substantially colorless compound, wherein said compound (A) is represented by the following general formula (I) or (II):

$$R_1\text{-}(A)_n\text{-}X \qquad \text{(I)}$$

$$R_2—\underset{\underset{B}{|}}{C}=Y \qquad \text{(II)}$$

wherein $R_1$ and $R_2$ each represents an aliphatic group, an aromatic group, or a heterocyclic group; X represents a group that can react with the aromatic amine developing agent to cause splitting-off; A represents a group that can react with the aromatic amine developing agent to form a chemical bond; n is 1 or 0; B represents a hydrogen atom, an aliphatic group, an aromatic group, a heterocyclic group, an acyl group, or a sulfonyl group; Y represents a group that can facilitate the addition of the aromatic amine developing agent to a compound having general formula (II), and $R_1$ and X together or Y and $R_2$ or B together may combine to form a ring structure, and wherein said compound (B) is represented by the following general formula (III):

$$R_7—Z.M \qquad \text{(III)}$$

wherein $R_7$ represents an aliphatic group, an aromatic group, or a heterocyclic group, Z represents a nucleophilic group having an oxygen atom, a sulfur atom, or a nitrogen atom to chemically combine with the oxidized product of the aromatic amine developing agent, and M represents a hydrogen atom, a metal cation, an ammonium cation, or a protective group.

14. The process for preparing a color photograph as claimed in claim 13, wherein the silver halide photographic material contains a support having thereon one or more hydrophilic colloid layers and compound (A) and/or compound (B) are containeds in one one more more of the hydrophilic colloid layers.

15. The process for preparing a color photograph as claimed in claim 13, wherein the processing solution is a processing solution to which compound (A) and/or compound (B) has been added, and before, during, or after the color developing step the photographic material is processed with the processing solution to which compound (A) and/or compound (B) has been added, thus allowing them to be contained in the color photograph.

16. The process for preparing a color photograph as claimed in claim 13, wherein the aromatic amine developing agent is selected from a group consisting of aromatic primary, secondary, and tertiary amine compounds.

17. The process for preparing a color photograph as claimed in claim 13, wherein the processing solution is a processing solution which contains compound (A) or (B) and is a color developing solution, a bleaching solution, a fixing solution, a washing solution, or a rinsing solution, the concentration of compound (A) or (B) in the processing solution being $10^{-5}$ mol/l to $10^{-1}$ mol/l.

18. The process for preparing a color photograph as claimed in claim 13, wherein the color developing solution of the color development processing is substantially free from benzyl alcohol.

19. The process for preparing a color photograph as claimed in claim 13, wherein compound (A) or (B) is present in the photographic material in an amount of $1\times10^{-2}$ to 10 mol per mol of the coupler.

20. A color photograph obtained by processing a silver halide color photographic material with an aromatic amine developing agent, said silver halide photographic material having on a support at least one silver halide emulsion layer containing a color-image forming coupler which forms a dye by a coupling reaction with an oxidized product of the aromatic amine color developing agent, said color photograph being improved in preservability and comprising both a compound (A), that combines chemically with an aromatic amine developing agent remaining after a color development processing to produce a chemically inactive and substantially colorless compound, and a compound (B), that combines chemically with an oxidized product of the aromatic amine developing agent remaining after the color development processing to produce a chemically inactive and substantially colorless compound, wherein said compound (A) is represented by the following general formula (I) or (II):

$$R_1\text{-}(A)_n\text{-}X \qquad \text{(I)}$$

$$R_2\text{-}\underset{\underset{B}{|}}{C}=Y \qquad \text{(II)}$$

wherein $R_1$ and $R_2$ each represents an aliphatic group, an aromatic group, or a heterocyclic group; X represents a group that can react with the aromatic amine developing agent to cause splitting-off; A represents a group that can react with the aromatic amine developing agent to form a chemical bond; n is 1 or 0; B represents a hydrogen atom, an aliphatic group, an aromatic group, a heterocyclic group, an acyl group, or a sulfonyl group; Y represents a group that can facilitate the addition of the aromatic amine developing agent to a compound having general formula (II), and $R_1$ and X together or Y and $R_2$ or B together may combine to form a ring structure, and wherein said compound (B) is represented by the following general formula (III):

$$R_7\text{—}Z.M \qquad \text{(III)}$$

wherein $R_7$ represents an aliphatic group, an aromatic group, or a heterocyclic group, Z represents a nucleophilic group having an oxygen atom, a sulfur atom, or a nitrogen atom to chemically combine with the oxidized product of the aromatic amine developing agent, and M represents a hydrogen atom, a metal cation, an ammonium cation, or a protective group.

21. The color photograph as claimed in claim 20, wherein compound (A) or (B) is present in the photographic material in an amount of $1\times10^{-2}$ to 10 mol per mol of the coupler.

* * * * *